US008007972B2

(12) United States Patent
Kurimoto et al.

(10) Patent No.: US 8,007,972 B2
(45) **Date of Patent: *Aug. 30, 2011**

(54) ELECTROPHOTOGRAPHIC PHOTOCONDUCTOR, AND IMAGE FORMING APPARATUS, PROCESS CARTRIDGE AND IMAGE FORMING METHOD USING THE SAME

(75) Inventors: Eiji Kurimoto, Numazu (JP); Keisuke Shimoyama, Numazu (JP); Michio Kimura, Numazu (JP); Shinichi Kawamura, Kawasaki (JP); Takeshi Takada, Yokohama (JP); Yasuyuki Yamashita, Zama (JP); Naohiro Toda, Yokohama (JP); Hideo Nakamori, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 768 days.

This patent is subject to a terminal disclaimer.

(21) Appl. No.: 11/521,493

(22) Filed: Sep. 15, 2006

(65) Prior Publication Data

US 2007/0059618 A1 Mar. 15, 2007

(30) Foreign Application Priority Data

| | | |
|---|---|---|
| Sep. 15, 2005 | (JP) | 2005-267882 |
| Sep. 15, 2005 | (JP) | 2005-268478 |
| Sep. 15, 2005 | (JP) | 2005-269156 |
| Sep. 15, 2005 | (JP) | 2005-269163 |
| Sep. 15, 2005 | (JP) | 2005-269165 |
| Sep. 16, 2005 | (JP) | 2005-270493 |
| Sep. 16, 2005 | (JP) | 2005-271008 |
| Mar. 2, 2006 | (JP) | 2006-056505 |

(51) Int. Cl.
*G03G 5/06* (2006.01)

(52) U.S. Cl. ..... 430/78; 430/126.1; 399/159

(58) Field of Classification Search ..... 430/78, 430/126.1, 58.5; 399/159
See application file for complete search history.

(56) References Cited

U.S. PATENT DOCUMENTS

| | | | | |
|---|---|---|---|---|
| 5,052,090 | A * | 10/1991 | Kitaura et al. | 492/18 |
| 5,264,903 | A * | 11/1993 | Nagame et al. | 399/357 |
| 6,363,237 | B1 * | 3/2002 | Nagame et al. | 399/343 |
| 7,022,450 | B2 * | 4/2006 | Asano et al. | 430/120.1 |
| 7,747,197 | B2 * | 6/2010 | Shimoyama et al. | 399/159 |
| 2004/0033428 | A1 * | 2/2004 | Niimi | 430/59.5 |
| 2007/0219375 | A1 * | 9/2007 | Fujiyama et al. | 430/78 |

FOREIGN PATENT DOCUMENTS

| | | |
|---|---|---|
| JP | 8-6452 | 1/1996 |
| JP | 8-254850 | 10/1996 |
| JP | 2718048 | 11/1997 |
| JP | 3028270 | 2/2000 |
| JP | 2001-215818 | 8/2001 |
| JP | 2001-255678 | 9/2001 |
| JP | 2001-290296 | 10/2001 |
| JP | 3239244 | 10/2001 |
| JP | 2002-40683 | 2/2002 |
| JP | 2002-229225 | 8/2002 |
| JP | 3345689 | 9/2002 |
| JP | 2004-251967 | 9/2004 |
| JP | 2004-252066 | 9/2004 |
| JP | 2005-37524 | 2/2005 |
| JP | 2005-43443 | 2/2005 |
| JP | 2005-62830 | 3/2005 |
| JP | 2005-126367 | 5/2005 |
| JP | 2005-154409 | 6/2005 |
| JP | 2005-157212 | 6/2005 |
| JP | 2005-227742 | 8/2005 |
| JP | 2006-84543 | 3/2006 |
| WO | WO 2005092901 A1 * | 10/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-168.*

U.S. Appl. No. 11/873,876, filed Oct. 17, 2007, Nakamori, et al.

U.S. Appl. No. 11/876,396, filed Jan. 22, 2007, Nakamori, et al.

U.S. Appl. No. 11/929,083, filed Oct. 30, 2007, Shimoyama, et al.

U.S. Appl. No. 11/695,750, filed Apr. 3, 2007, Takada, et al.

U.S. Appl. No. 12/043,407, filed Mar. 6, 2008, Nakamori, et al.

U.S. Appl. No. 11/736,919, filed Apr. 18, 2007, Shimoyama, et al.

U.S. Appl. No. 11/762,296, filed Jun. 13, 2007, Gondoh, et al.

U.S. Appl. No. 11/518,944, filed Sep. 12, 2006, Shimoyama, et al.

* cited by examiner

*Primary Examiner* — Christopher RoDee
(74) *Attorney, Agent, or Firm* — Oblon, Spivak, McClelland, Maier & Neustadt, L.L.P.

(57) ABSTRACT

An object of the present invention is to provide an image forming apparatus containing an electrophotographic photoconductor, a charging unit, an exposing unit, a developing unit, a transfer unit and a cleaning unit, wherein the electrophotographic photoconductor contains a support and at least a photosensitive layer disposed on the support, wherein the photosensitive layer contains a charge generating material and a compound expressed by the following Structural Formula (1), and Structural Formula (1)

-continued wherein, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

32 Claims, 18 Drawing Sheets

Image Degraded by Transfer during Negative Charging

ELECTROPHOTOGRAPHIC PHOTOCONDUCTOR, AND IMAGE FORMING APPARATUS, PROCESS CARTRIDGE AND IMAGE FORMING METHOD USING THE SAME

BACKGROUND OF THE INVENTION

1. Field of the Invention

The present invention relates to an electrophotographic photoconductor by which image forming is performed by electrostatic copying process of copiers, facsimiles, printers and the like, and image forming apparatus, image forming method and process cartridge using the electrophotographic photoconductor.

2. Description of the Related Art

In recent years, developments of information processing system employing electrophotography are remarkable. Particularly the optical printers by which information is converted to digital signals to be recorded by light have been notably improved in terms of printing quality and reliability. The digital recording technique of this type is also applied to general copiers as well as printers and what is called "digital copiers" have been developed. Moreover, the demand for the copiers, the conventional copiers which have been provided with the digital recording technique is expected to increase more in the future because of additional various information processing functions. Furthermore, developments of digital color printers for performing output of color images and documents are drastically advancing with popularization and upgrade of personal computers.

The electrophotographic photoconductor used in the image forming apparatuses as described above can by classified broadly into organic photoconductor and inorganic photoconductor. Organic photoconductors are being widely used recently because it can be manufactured easily and inexpensively as compared with the conventional inorganic photoconductors, and there is a lot of flexibility in functional designs because of various choices for photoconductor materials including charge transporting material, charge generating material and binding resin, etc.

There are two types of organic photoconductors: single-layer photoconductor in which charge transporting material (hole transporting material or electron transporting material) is dispersed with charge generating material in the same photosensitive layer and multilayer photoconductor in which charge generating layer containing charge generating material and charge transporting layer containing charge transporting material are laminated.

The single-layer photoconductor has been drawing attention recently because it includes charge generating material and charge transporting material in a single photosensitive layer thereby enabling to manufacture with a simple manufacturing process and also, optical properties can be improved and either one of positive charging and negative charging can be applied because of fewer layer interfaces.

In contrast, the multilayer photoconductor is mostly of negative charging type and the multilayer photoconductor of positive charing type has not been put to practical use. This is because the electron transporting material which excels in electron transporting function, is less toxic and highly compatible with binder resins has not been put to practical use. Although single-layer photoconductor in general has bipolar sensitivity of negative and positive, most of them are used for positive charging because electron transporting material has low transportability of electron.

In general, image forming is performed by charging a photoconductor (main charging step), forming a latent electrostatic image by exposing images (exposure step), developing the latent electrostatic image by using a toner (developing step), transferring the formed toner image to a transfer medium (transferring step) and fixing in the image forming apparatus using electrophotography. The residual toner on the photoconductor is removed by cleaning blade, and the like (cleaning step) and residual charge on the photoconductor is erased by charge removing lamp, and the like (charge removing step). The reversal development method in which a toner of the same polarity as of the charging polarity applied to the photoconductor is used in charging step to develop is widely used in digital image forming apparatuses.

When an electrophotographic photoconductor is used in a digital image forming apparatus of reversal development type, transfer voltage applied to the photoconductor in transferring step becomes opposite of the charging polarity of the photoconductor. Generally, the transfer voltage is not applied to the photoconductor directly but through a transfer medium (paper) and it is not applied until the transfer medium passes through the transferring step, however, controlling ON/OFF timing of transfer voltage is difficult and in some areas of anterior and rear ends of the transfer medium, transfer voltage is often applied directly. As stated another way, because the transfer voltage begins to be applied before leading end of the transfer medium comes to the position of the transfer unit and also, the transfer voltage is continually applied even when part of the transfer unit is exposed due to passing through of the rear end of the transfer medium, the transfer voltage is directly applied to the photoconductor in some areas of anterior and rear ends of the transfer medium.

For example, because polarity of the voltage applied in the transfer device is negative in the case of a single-layer photoconductor of positive charging, negative space charge remains in part of the photoconductor where negative voltage is applied. As described above, since the single-layer photoconductor has sensitivity in both polarity, negative space charge is erased in the next charge removing step.

However, when negative polarity sensitivity of the positive charging single-layer photoconductor is inappropriate (electron transporting material has low electron transporting function), negative space charge is not erased sufficiently, and lowering of electric potential is induced by the effect of space charge even the photoconductor is positively charged in the next charging step.

As a result of the lowering of electric potential, lowering of the electric potential after exposure occurs in the exposing step and image defects (image degraded by transfer) such that the image density of the corresponding area is increased after developing by the toner occur.

The single-layer photoconductor is positively charged uniformly in the next charging step after going through the exposing step and developing step and then the charge on the surface of the photoconductor is erased uniformly in the charge removing step in general. However, when the polarity sensitivity of opposite charge of the positive charging single-layer photoconductor is inappropriate, space charge density of opposite of the charge polarity in the area where image is exposed is increased more than in the area without exposure, lowering of electric potential occurs in the next charging step and image degraded by image exposure tends to occur. When the single-layer photoconductor is used in the image forming apparatus which does not include charge removing step, the density difference between exposed area and non-exposed area in the image degraded by image exposure becomes further notable because the photoconductor surface is not exposed uniformly.

Techniques in which types of the constituent material of the single-layer photoconductor and a range of optical sensitivity difference between positive and negative are predetermined have been disclosed in Japanese Patent (JP-B) Nos. 3532808 and 3638500, Japanese Patent Application Laid-Open (JP-A) Nos. 2001-255678 and 2001-312075, for example, to solve above described problems. However, in any of the techniques, electron transporting function of the electron transporting material is not sufficient and resulted image defects by transfer and image exposure are not sufficiently prevented.

Moreover, illustrations of preventing and reducing image defects by assigning predetermined composition and condition of the transfer unit for the image degraded by transfer have been proposed. (JP-A Nos. 11-24446, 2000-242089, 2001-215818 and 2002-49194 and JP-B No. 3538389, for example). However, transfer units of complicated mechanisms are required, and compactification or cost reduction may be difficult, transfer efficiency of the toner may be deficient, and dust may be generated in transferring of the toner, thereby being insufficient as fundamental techniques for preventing image degraded by transfer.

As described above, satisfactory result for the technique for preventing or reducing image defects caused by transfer and exposure of the electrophotographic photoconductor having bipolar optical sensitivity of positive and negative has not been obtained in the present circumstances.

In recent years, spherical toner of the small diameter is attracting attention with the demand for higher image quality of the market. However, because properties of such spherical toner of the small diameter notably changes on the photoconductor and tend to cause cleaning defects, and the like, it is a contributing factor for image degradation due to toner filming or fusion and also is an important problem.

The methods in which fluorine resin particles are contained in a surface layer of the photoconductor as a lubricant agent to produce surface releasing effect for reducing coefficient of surface friction such as the ones proposed in JP-A Nos. 5-45920 and 2000-19918, for example, are very effective for solving the above problem of the negative charging electrophotographic photoconductor.

And because the same problem also occurs in the positive charging electrophotographic photoconductor, a photoconductor which has high tolerance to image degradation due to toner filming or fusion without causing cleaning defects even when a spherical toner of small diameter is used in the positive charging electrophotographic photoconductor is needed.

As an electron transporting material in the organic photoconductor, a new naphthalene carboxylic acid derivative expressed by the following Structural Formula (A) and an electrophotographic photoconductor of high sensitivity using the above material has been proposed (JP-A No. 2005-154409).

Structural Formula (A)

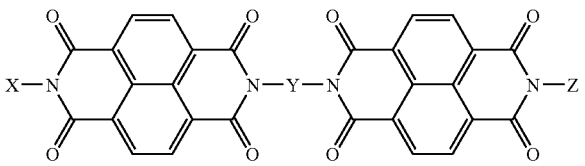

Where, in the above Structural Formula (A), X and Z represent groups each selected independently from hydrogen atom, substituted or unsubstituted alkyl group, substituted or unsubstituted cycloalkyl group, substituted or unsubstituted aralkyl group and substituted or unsubstituted aryl group and Y represents substituted or unsubstituted alkylene group or substituted or unsubstituted cyclo alkylene group.

Although the electrophotographic photoconductor in this example has higher sensitivity than that of the conventional photoconductor, there is no description about sensitivity and only durability of approximately 5,000 pieces has been evaluated.

An image forming apparatus equipped with a magnetic brush roller by which a photosensitive layer having a charge injecting layer is disposed on a conductive base substrate through which a light is transmitted so as to be facing the photoconductor to form a developing nip with the photoconductor, and charging and developing are performed by the developing nip and an exposing unit which exposes the photosensitive layer from the back side has been proposed in which a direct voltage superimposed with alternating voltage is applied to the magnetic brush roller to pull back the toner in a non-image area on the photoconductor drum to the developing sleeve (JP-A No. 6-202412).

In this image forming apparatus, however, direct voltage of −200V and alternating voltage of sine wave of 1,800 Hz frequency and 2 kV voltage between peaks are needed to be superimposed in order to perform charge injection because it has OPC photoconductor of negative charging type and positive charging cannot be performed.

A charging device which has a magnetic brush charger equipped with a magnetic brush of magnetic particles which comes in contact with charged body having a charge injecting layer of $10^9$ Ω·cm to $10^{14}$ Ω·cm on its surface to charge the charged body, a voltage applying unit which applies a voltage to the magnetic brush charger and a resistive element which is connected in a charging circuit which has the charged body, has been proposed. In this charging device, the separation of conductive magnetic particles from the magnetic brush is prevented or reduced in order to prevent degradation of charging ability due to separation of conductive magnetic particles by having a resistance of the magnetic particles of $10^6$ Ω·cm to $10^9$ Ω·cm, the resistive element of 0.5 times or more of the resistance of the magnetic brush charger alone and the resistance of the charging circuit of $10^7$ Ω·cm or less and by having appropriate environmental stability such that the resistance variation of the resistive element is smaller than the resistance variation of the magnetic brush charger alone relative to the variation in hygrothermal environment of 15° C. and 10% RH to 33° C. and 90% RH (JP-B No. 3495839).

However, charge injection to the OPC photoconductor to which a charge injecting layer is disposed on its surface is only exemplified by applying a direct voltage of −700V, and there is no example of positive charging for this charging device.

An image forming apparatus, which has an electrophotographic photoconductor, contact charging member, exposing unit, developing unit and transfer unit, in which a surface layer of the electrophotographic photoconductor contains a resin which is formed by polymerization of curable acrylic monomer or oligomer having a reactive acrylic group or methacrylic group and a conductive fine particle, a surface of the conductive fine particle is processed with a coupling agent having a reactive acrylic group or methacrylic group and appropriate charge injection can be performed by charge injection, has been proposed and excellent images can be obtained and duration of life of the photoconductor is sufficiently prolonged by the image forming apparatus (JP-A No. 11-95474).

However, charge injection of −680V is only exemplified by applying a DC voltage of −700V from the charge bias power source, and there is no example of positive charging for this image forming apparatus.

A color image forming apparatus in which charge injection is performed by applying a low voltage through a magnetic brush which is in contact with a photoconductor drum having a charge injecting layer on an outer side of the photosensitive layer has been proposed. In this color image forming apparatus, the residual toner which remains after transferring a toner image on the photoconductor drum is collected by developing devices corresponding to toners of each color for toner recycling (JP-A No. 2001-125375).

However, in this color image forming apparatus, image blur tends to occur during repetitive use in high temperature and high humidity environment because of the surface protective layer having diamond carbon structure containing hydrogen or non-crystalline carbon structure and in addition, ozone tends to occur because it is charged at −500V by charge injection.

A charge transporting agent for electrophotographic photoconductor containing a diphenoquinone compound expressed by the following Structural Formula (B) has been proposed.

Structural Formula (B)

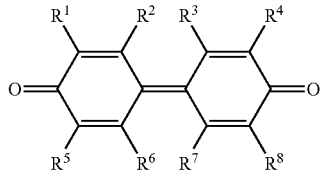

Where, in the above Structural Formula (B), $R^1$ to $R^8$ represent one or two or more types selected from hydrogen atom, alkyl group, cycloalkyl group, aryl group, amino group and alkoxy group having 1 to 20 carbon atoms, however, all $R^1$ to $R^8$ are not to represent hydrogen atoms simultaneously.

The charge transporting agent for electrophotographic photoconductor has a problem of slow sensitivity when a sensitivity of the multilayer electrophotographic photoconductor is measured by positive charging.

In general, "electrophotographic process" is one of image forming methods in which a photoconductive photoconductor is charged with a corona discharge in dark place, for example and an image is exposed, a latent electrostatic image is obtained by selectively dissipating the charge of exposed area only and the latent image is developed by a detective particle (toner) consisting of colorants such as dyes and pigments and binding agents such as high-molecular substances to visualize and form an image.

In recent years, higher durability is demanded as well as higher image quality for the image forming apparatus using electrophotographic process such as electrophotographic copiers and electrophotographic printers.

Life duration of the image forming apparatus using the electrophotographic process as described above is often determined by the photoconductor.

Since the charging ability of the photoconductor is gradually degraded or electric potential of the exposed area is increased due to repetitive cycle of charging and exposing for extended period, sufficient electrostatic contrast for forming a latent electrostatic image cannot be obtained.

In order to solve this problem, it is necessary to improve the charge transporting material, a main material for forming a photosensitive layer. Even though initial properties are appropriate, when electrostatic fatigue of the photoconductor is added in the repeatedly performed electrophotographic process, sufficient properties cannot be obtained with the photoconductor in which conventional charge transporting material is used.

Another contributing factor for determining durability of the photoconductor includes wear of the photoconductor with time. This is because the photoconductor is gradually degraded and becomes worn by receiving mechanical and chemical influences in repetitive steps of charging, exposure, developing, transferring and cleaning in the electrophotographic process.

As wear of the photoconductor is progressed, it leads to lowering of charging ability and causes degraded images. Therefore, it becomes extremely important to use a photoconductor which excels in wear resistance in order to achieve higher durability of the photoconductor in the image forming apparatus using the electrophotographic process.

Many techniques in which protective layers are disposed in order to improve wear resistance of the photoconductor have been proposed (JP-A Nos. 1-205171, 7-333881, 8-15887, 8-123053 and 8-146641).

Even though wear resistance is improved by these proposals, electric potential of the exposed area is increased due to repetitive use of the photoconductor for prolonged period and image degradation such as lowering of image density occur. Furthermore, although wear resistance of the protective layer is improved due to high mechanical strength, when a foreign material is attached on a photoconductor surface for some reason, scratch tends to occur, causing image defects and it may be difficult to be used in the electrophotographic process.

The toner of small particle diameter is being used increasingly for higher image quality in recent years. This is because the image quality is remarkably improved by using the toner of small particle diameter. By contrast, removal of toner on the photoconductor is difficult due to small particle diameter of the toner and in addition, unremoved toner on the photoconductor tends to be fixed on the photoconductor.

Moreover, accumulation of the paper dust from the used paper and attachment of the foreign material such as agglomerated product of toner additives or other foreign materials on the photoconductor have been observed sometimes with higher durability of the information forming apparatus.

When these phenomenon occur, output image is degraded and so-called image defects occur. If such image defects occur, it is considered that the operating life of the image forming apparatus is over on the spot even though the photoconductor may have high durability.

With that, a method in which removal of foreign materials such as residual toner on the photoconductor after transferring or paper dust, etc. is emphasized to improve cleaning condition of the photoconductor. However, if the cleaning condition is improved more than is necessary, cleaning defects may occur at an early date, often causing image defects adversely because of abnormal wear or more roughened surface of the photoconductor.

For example, when toner removal capability is improved by conventionally used cutpile brush, a firm thick brush with a thickness of original yarn must be employed. However, if a thick yarn is used to form a cutpile brush, an edge of the fracture cross section comes in point-contact with the photoconductor, the surface of the photoconductor is scratched and abnormal wear occurs leading to image defects.

Moreover, when the cleaning condition is improved more than is necessary, scratches caused by repetitive friction is increased and problems of various image defects caused by the scratches occur such as streak defects caused by residual toner after transferring which slips through the scratched part in the cleaning unit or microscopic spotty defects caused by toner particles which get into the scratched part and become fixed, for example.

These image defects tend to increase when the toner of small particle diameter which is being increasingly employed for the purpose of achieving higher image quality, particularly when spherical toner such as polymerization toner is used and it had been extremely difficult for simultaneous pursuit of images of high quality without occurrence of image defects, and high durability for maintaining images of high quality.

In order to obtain an image forming apparatus of high image quality and durability, a cleaning device which produces no scratches on the photoconductor surface by making full use of the durability as well as changing the main material of the photoconductor, which is a cornerstone of image forming, to improve electrostatic durability for higher durability are indispensable. However, the image forming apparatus of high image quality and durability has not been obtained because it was impossible to fulfill these requirements.

The toner of small particle diameter and a small particle diameter distribution is known to be used for achieving higher image quality. However, the conventional pulverization toner is manufactured by melting/mixing colorants, charge controlling agents and offset preventing agents, etc. in a thermoplastic resin to be dispersed uniformly and by pulverizing and classifying the obtained composition. There are problems in this type of manufacturing method of the toner such that the particle diameter distribution tends to cover a wide range and fine and coarse powders must be removed by classification for obtaining duplicated images with an appropriate resolution and tone, resulting in very low yield. To solve the above problem, measures as disclosed in JP-A No. 9-222750, for example, have been taken, but they are not necessarily sufficient.

An organic photoconductor (OPC) containing charge generating materials and charge transporting materials have broadly been in practical use as an image bearing member used for the image forming apparatus for reasons such as no pollution and low cost. Hole transporting material and electron transporting material, etc. have been known as the charge transporting materials, but when the hole transporting material is used, negative charging process becomes indispensable and the photoconductor is degraded by ozone generation, etc. When the electron transporting material is used, a problem arises such that the carrier mobility is lower than that of the hole transporting material. In order to solve the problem of the charge transporting material, the use of predetermined charge transporting material has been proposed in JP-A Nos. 1-206349 and 5-142812, however, a problem arises in terms of compatibility with the binder resin.

In the image forming apparatus in which images are formed by using indirect electrophotography as exemplified by facsimile, laser beam printer, copier, and the like, each unit of charging, image exposure, development, transfer, separation, cleaning and charge removal is arranged centering around an electrophotographic photoconductor (hereinafter, may be referred to as "photoconductor") and images are formed by sequential operations of each unit toward the photoconductor.

There is growing demand for higher image quality and durability of the image forming apparatus recently. In order to achieve compactification and higher durability, improvement of the charge transporting material, a main constituent material in the photosensitive layer of the photoconductor is indispensable. This is because the charging ability of the photoconductor is gradually degraded or electric potential during exposure is increased due to repetitive loads added by each unit such as charging and exposing, etc. and sufficient electrostatic contrast for forming a latent electrostatic image cannot be obtained.

At the same time, it is necessary to improve mechanical durability against repetitive operations as well as to improve repetition property of the photoconductor relative to static electricity in order to improve durability of the image forming apparatus as a whole. This is because a slight twist or warp may appear on the photoconductor by the force added for rotating the photoconductor for extended period.

The drive power is transmitted to the photoconductor through a member which is normally set at both ends of the photoconductor, a flange, and slight twist or warp appears at the flange joint after performing drive power transmission for extended period and runout accuracy during rotation of the photoconductor is changed. This slight twist or warp has been observed in the conventional image forming apparatus though it does not cause any problems, in some cases however, this slight twist or warp affects output images of the image forming apparatus which is demanded recently, particularly the full-color image forming apparatus which uses a high-level technique of color lamination.

Moreover, in order to suppress twist or warp of flange joint as described above, the size of the flange member for strengthening the joint may be slightly made equal to or more than the inner diameter of the drum, which is a support of the photoconductor. When this method is employed, however, problems such that the circularity of the drum is changed or runout accuracy is degraded arise due to force added when the flange is mounted. Furthermore, fixation of the flange by using an adhesive bond which has been operated conventionally also causes a slight change in accuracy of the flange joint due to contraction or expansion generated during fixation of the adhesive bond.

Other than this, resonance generated during charging or frictional noise caused by contact with the cleaning member have also been a problem.

The charging of the photoconductor will be explained below. The photoconductor is charged (electron is provided) at −300V to −800V by means of a charging unit. There are two methods for applying a voltage to the charging unit: a method in which direct voltage is applied and a method in which direct voltage superimposed with alternating voltage is applied. Although forming an image which is practically usable is possible by applying direct voltage alone, the image can be more independent of the environmental condition and uneven electric potential, which is thought to be caused by irregularity of the charging member and the photoconductor and slight nonuniformity in the member which are produced when contact charging is employed, can be considerably reduced.

The charging method generally employed now include corona charging in which a photoconductor is charged by applying a high voltage of approximately −4,000V to −6,000V to a metal wire with a diameter of 40 μm to 80 μm which is extended in a shield case such as tungsten wire and nickel wire, contact charging in which a photoconductor is charged by applying a direct voltage of −1,200V to −2,000V or a direct voltage of −500V to −900V superimposed with an alternating voltage of 1,000V to 2,500V/500 Hz to 4,500 Hz to a charging member having a resistance of approximately $10^2$ Ω·cm to $10^8$ Ω·cm which is roller-shaped or brush-shaped, and a proximity noncontact charging in which a photoconductor and a charging member are arranged so as to have a distance of approximately 30 μm to 250 μm in between and the photoconductor is charged by applying the above voltage.

In corona charging, high density ozone is generated because of the application of high voltage, causing environmental problems by ozone odor or contamination problem of metal wires such as the tungsten wire and nickel wire due to discharge product produced by repetitive use. Because of this, the contact charging in which a photoconductor can be charged by applying a low voltage is employed recently and ozone generation is reduced to as low as 0.1 ppm or less. Therefore, many image forming apparatuses use contact charging which produces less ozone in recent years and direct voltage superimposed with alternating voltage is applied to the charging member.

However, when direct voltage superimposed with alternating voltage is applied to the charging member, noise problem caused by annoying charging noise generated during charging arises other than ozone and nitrogen oxide which cause image quality degradation. This charging noise is not generated with direct voltage, and it is a unique phenomenon related to oscillating current and as the amplitude increases and the material of the support in the photoconductor transmits more sound, charging noise increases. Therefore, it is desirable to set the condition so as to lower the noise as much as possible, however, the condition will be toughened as charging stability is increased, resulting in an increase of charging noise, and it is indispensable to take measures to solve above noise problem.

Methods such as the one in which the support in the photoconductor is thickened, vibration suppressing material (filling material) is inserted inside of the drum-shaped photoconductor, or charging member side is improved, etc. have been proposed as measures to improve the above phenomenon. These methods in which generation of charging noise (high-frequency sound) during charging is improved by inserting an vibration suppressing material inside of the drum-shaped photoconductor for suppressing sound transmittance in the photoconductor and shifting resonant frequency toward the range where it is not well transmitted to human ears have been proposed as follow. Examples include (1) a method in which cushioning material is pressed and inserted inside of the photoconductor drum (JP-A No. 63-60481), (2) a method in which viscoelastic material is filled inside of the photoconductor (JP-A No. 3-105348), (3) a method in which a rigid body of 2.0 g/cm$^3$ or more density is inserted inside of the photoconductor (JP-A No. 5-197321), (4) a method in which a member consisting of two or more elastic bodies (O ring) and cylindrical member [a plastic with 1.5 or more specific gravity (polybutylene terephthalate resin containing 20% or more of glass fiber)] is inserted in the photoconductor (JP-A No. 11-184308) and (5) a method in which a resin-made cylindrical member having a built-in metal spring is inserted and fixed to the inner wall of the photoconductor by suppress strength (JP-A No. 2000-321929).

A method in which a support in the photoconductor has an vibration suppressing member and the thickness other than that of vibration suppressing member is set at 1.9 mm or more has been proposed as a method for enhancing vibration suppressing effect by thickening the thickness of the support in the photoconductor (JP-A No. 2000-19761). Moreover, a method in which deposit density of the photoconductor is set at 0.6 g/cm$^3$ or more and 2.0 g/cm$^3$ or less to obtain vibration suppressing effect has been proposed (JP-A No. 2000-155500). Moreover, a method in which the charging noise is improved by disposing a coating layer on a surface of the hollow charging member (roller) and inserting elastic body inside of the charging member to have a structure in which a cored bar is supported through the elastic body has been proposed as a method for achieving charging noise suppression through charging members (JP-A No. 9-230671). Furthermore, measures will be different depending on whether the charging noise is suppressed by shifting the vibrational frequency toward the area where it is not annoying to human ears or vibration itself is suppressed.

The above methods have effects to a greater or lesser degree respectively. Though the charging noise is improved in the contact charging, it may not be as effective in noncontact charging in which the charging member is arranged to be close to the photoconductor. For example, sufficient effect are not likely to be obtained by a method in which charging noise is suppressed by the charging member or just by thickening the support in the photoconductor. The method in which the sound (noise) is suppressed by inserting a filling material inside of the support in the photoconductor may be effective, however, when a space still exists between the support and the inserted material after insertion, expected effect is not likely to be obtained when the weight is small. Moreover, the effect may be lowered when the constituent member is of single composition. Furthermore, environmental problems mush be taken into account in recent years and recycling and reuse are required and should be in consideration.

Moreover, the support is slightly deformed when the above filling material is inserted inside of the support for suppressing vibration. This is because the support is pressed by the filling material and deformed slightly when there is a need to attach the support and the filling material firmly to eliminate the space which exists between the support and the filling material for suppressing noise.

As described above, annoying noise caused by sympathetic vibration and sympathetic resonance may be heard during charging depending on charging method. In addition, frictional noise or fluttering noise generated by a member which comes in contact with the photoconductor such as cleaning blade has also been heard during rotating of the photoconductor. A method in which sound (noise) is suppressed by inserting a filling material inside of the photoconductor and increasing the mass as described above has been employed as a measure to this kind of the problem, however, slight degradation of the photoconductor accuracy is unavoidable as described above and therefore, it is not satisfactory for fulfilling the increasing demand of higher image quality in recent years.

There are two types of the full-color image forming apparatus using electrophotography known in general. One is called single type, or single drum type and the apparatus is equipped with one electrophotographic photoconductor (hereinafter, may be referred to as "photoconductor", "electrophotographic photoconductor", "image bearing member" or "latent electrostatic image bearing member") and 4 developing members which correspond to 4 colors of cyan, magenta, yellow and black. In the single method, toner images of 4 colors are formed on the photoconductor or recording medium. It is possible to standardize charging member, exposing member, transfer member, cleaning member and fixing member arranged around the photoconductor, allowing more compact design at low cost as compared to the tandem type mentioned below.

The other type is called tandem type or tandem drum type (JP-A No. 5-341617). The apparatus of this type is equipped with multiple photoconductors. In general, each one of charging member, exposing member, developing member, transfer member and cleaning member are arranged for one photoconductor drum to form one image forming element and multiple image forming elements (four in general) are mounted in the apparatus. In the apparatus of tandem type, a toner image of single color is formed by one image forming element and toner images are transferred to a recording medium sequentially to form a full color image. The tandem type has an advantage in being able to form an image at high speed. This is because toner images of each color can be formed in parallel. Therefore, image forming process only takes about one-fourth of the single type, and it is applicable for four times as much of high speed printing. Moreover, it also has an advantage of substantively improving durability of each member contained in the image forming elements such as photoconductor. In single type, each step of charging, exposure and developing is performed 4 times by using one photoconductor to form a full color image and in contrast, the above operation is performed only once by using one photoconductor in tandem type.

However, the tandem type also has disadvantage in terms of size of the apparatus which grows in size because image forming elements are arranged in plural numbers, thereby making it costly.

In order to solve the above problem, one image forming element has been minimized in size by downsizing the photoconductor and each member arranged around the photoconductor. By doing this, material cost has also been reduced as well as downsizing of the apparatus and overall cost of the apparatus has also been reduced in some degree. However, a new problem has arisen such that the photoconductor included in the image forming element must be of high sensitivity and stability must also be increased considerably with compactification and downsizing of the above apparatus.

It is necessary to perform an image forming process at high speed for achieving higher speed printing, which is the first purpose of the tandem type. Therefore, it is necessary to be optically attenuated rapidly when being exposed because of sensitivity and charged condition of the used photoconductor. Furthermore, it is necessary for the optical attenuation property to be maintained stably during repetitive use. Particularly in the full color electrophotographic apparatus of tandem type in which image forming elements are arranged in plural numbers, a particular color (black, for example) is generally used in large amount according to the percentage of colors printed by users and burden on each photoconductor are not uniform. In this case, optical attenuation property of some of the photoconductors is degraded resulting in tone change when a full color image on which colors are overlapped is printed during repetitive use.

As described above, quality of printed image becomes inappropriate when the property of the photoconductors during repetitive use is unstable, causing degraded images such as tone change and background smear during repetitive use for prolonged period.

SUMMARY OF THE INVENTION

The first object of the present invention is to provide an image forming apparatus in which an electrophotographic photoconductor is charged by injection by applying a voltage to a charging unit which is arranged so as to be in contact with the electrophotographic photoconductor having a composition in which a photosensitive layer and a surface protective layer are laminated sequentially, wherein the electrophotographic photoconductor has high sensitivity and low residual potential and can be charged by positive charge injection.

The second object of the present invention is to provide an image forming apparatus and a process cartridge through which high quality images with high resolution and tone property can be obtained stably.

The third object of the present invention is to provide an image forming apparatus which has excellent electrostatic durability, high image quality and longer operating life without causing scratches on photoconductor and image defects even after long term use.

The fourth object of the present invention is to provide an electrophotographic photoconductor and an image forming apparatus which can output high quality images for prolonged period without causing image degradation caused by cleaning defects of toner on the photoconductor surface or toner filming or fusion to the electrophotographic photoconductor even when a spherical toner of small diameter is used.

The fifth object of the present invention is to provide an image forming apparatus and a process cartridge which are capable of outputting high quality, high durability images by suppressing image degradation caused by the degradation of constituent material of the photosensitive layer due to repetitive use for prolonged period and by correcting warp of the photoconductor due to repetitive use for prolonged period (accuracy improvement of support in the photoconductor).

The sixth object of the present invention is to solve image problems caused by transfer and exposure of the conventional electrophotographic photoconductor which has bipolar optical sensitivity of positive and negative and to achieve the following object. The object of the present invention is to provide an electrophotographic photoconductor, an image forming apparatus and a process cartridge which prevent occurrence of images degraded by transfer and exposure in the image forming apparatus using the electrophotographic photoconductor which has bipolar optical sensitivity of positive and negative, and are capable of outputting high quality images even when image forming is repeated for prolonged period.

The seventh object of the present invention is to provide an image forming apparatus, a process cartridge and an image forming method which are capable of obtaining stable images for prolonged period by uniformly maintaining charging ability of the toner in the developing device.

In the first embodiment, the electrophotographic photoconductor of the present invention contains a support and at least a photosensitive layer disposed on the support, wherein the photosensitive layer contains at least a charge generating material and a compound expressed by the following Structural Formula (1), and the electrophotographic photoconductor contains a bipolar optical sensitivity of positive and negative, and a ratio of optical sensitivity at each polarity, E½ (positive) and E½ (negative), [E½ (negative)/E½ (positive)], where "E½" is an exposure energy ($\mu J/cm^2$) required for a surface potential to be ½ by exposing with a single light after the electrophotographic photoconductor is charged at ±800V, is 0.5 to 3.0.

Structural Formula (1)

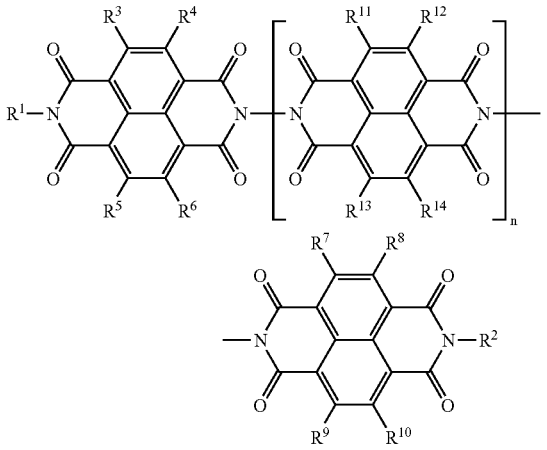

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

Since the compound expressed by the above Structural Formula (1) used in the present invention exhibits exceptional electron transporting property, it becomes possible to drastically improve the sensitivity for negative charging which has been a weak point of the conventional, single-layer photoconductor by containing the above compound in the photosensitive layer as an electron transporting material. By doing this, it becomes possible to significantly reduce the space charge of opposite polarity which generates during transfer and exposure of images as described above to thereby prevent degradation of images.

Moreover, since positive and negative charge sensitivities change depending on the constituent ratio of the material for the photoconductor even though the charge transporting material which exhibits excellent charge transporting function expressed by the above Structural Formula (1) is used, it is necessary to select the constituent ratio of the material in a way so as for a ratio of the optical sensitivities of positive and negative (E½) to be within the range of 0.5 to 3. By doing so, lowering amount of the charge due to negative space charge generated by transfer and image exposure can be made notably small and as a result, an image forming apparatus which is capable of obtaining high quality images for prolonged period without occurrence of image degradation can be provided.

In the first embodiment, the image forming apparatus of the present invention contains at least an electrophotographic photoconductor, a charging unit configured to charge the photoconductor, an exposing unit configured to expose the charged photoconductor to form a latent electrostatic image, a developing unit configured to develop the latent electrostatic image by using a toner and a transfer unit configured to transfer the visible image developed by the toner to a recording medium, wherein the electrophotographic photoconductor is the electrophotographic photoconductor of the first embodiment of the present invention.

The process cartridge of the present invention contains at least an electrophotographic photoconductor and a developing unit configured to develop a latent electrostatic image formed on the electrophotographic photoconductor by using a toner to form a visible image, wherein the process cartridge can be attached to and removed from the image forming apparatus body, and wherein the electrophotographic photoconductor is the electrophotographic photoconductor of the first embodiment of the present invention.

In the second embodiment, the electrophotographic photoconductor of the present invention contains a support and at least a photosensitive layer disposed on the support, wherein the photosensitive layer contains a charge generating material, a compound expressed by the following Structural Formula (1) and a fluorine resin particle.

Structural Formula (1)

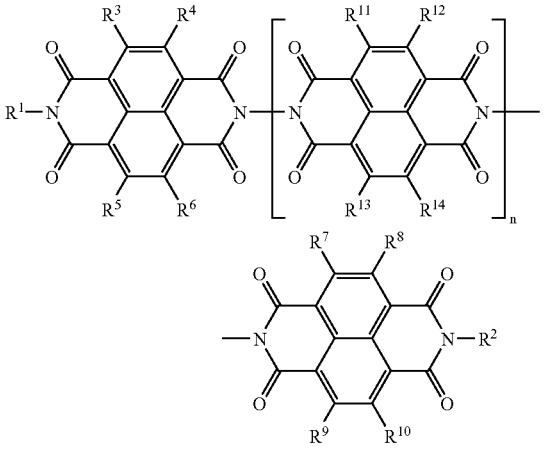

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

In the present invention, fluorine resin particles are contained in the photosensitive layer of the electrophotographic photoconductor. Since the fluorine resin particle has very low surface energy, the friction coefficient of the electrophotographic photoconductor surface can be lowered by containing the fluorine resin in the outermost layer.

Because of low friction coefficient of the electrophotographic photoconductor surface, it is possible to prevent spherical toner of the small diameter, which remains on the photoconductor without being transferred, from getting into spaces between cleaning blade and the photoconductor during cleaning by cleaning blade.

By this, it is possible to prevent cleaning defects of the toner caused by the toner slipping through the cleaning blade and to provide aid for cleaning of the toner.

In the second embodiment, the image forming apparatus of the present invention contains at least an electrophotographic photoconductor, a charging unit configured to charge the photoconductor, an exposing unit configured to expose the charged photoconductor to form a latent electrostatic image, a developing unit configured to develop the latent electrostatic image by using a toner, a transfer unit configured to transfer the visible image developed by the toner to a recording medium, wherein the electrophotographic photoconductor is the electrophotographic photoconductor of the second embodiment of the present invention.

In the second embodiment, the process cartridge of the present invention contains at least an electrophotographic photoconductor and a developing unit configured to develop a latent electrostatic image formed on the electrophotographic photoconductor by using a toner to form a visible image, wherein the process cartridge can be attached to and removed from the image forming apparatus body, and wherein the electrophotographic photoconductor is the electrophotographic photoconductor of the second embodiment of the present invention.

In the third embodiment, the image forming apparatus of the present invention contains at least an electrophotographic photoconductor, a charging unit configured to charge the photoconductor, an exposing unit configured to expose the charged photoconductor to form a latent electrostatic image, a developing unit configured to develop the latent electrostatic image by using a toner, a transfer unit configured to transfer the visible image developed by the toner to a recording medium and a cleaning unit configured to remove the residual toner on the photoconductor, wherein the electrophotographic photoconductor contains a support and at least a photosensitive layer disposed on the support, wherein the photosensitive layer contains a charge generating material and a compound expressed by the following Structural Formula (1)

Structural Formula (1)

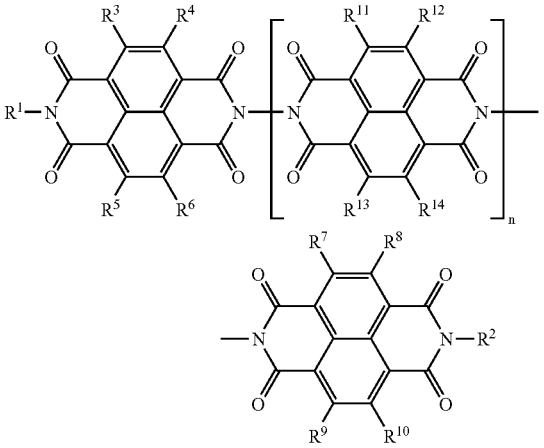

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

In this case, an embodiment wherein an average degree of circularity of the toner is 0.93 to 0.99, an embodiment wherein the cleaning unit contains a brush with a loop-shaped leading end which rotates while in contact with the photoconductor and the loop-shaped leading end side of the brush is turned to upstream side of the rotation direction of the brush from base side, an embodiment wherein the support is drum-shaped, and the image forming apparatus contains flanges which have a pair of roller bearing holes fitted to openings of both ends of the support and to the drum-shaped support respectively and a shaft which is fixed to the center of each flange and run through the support as a central rotating axis, and an embodiment wherein the image forming element containing at least an electrophotographic photoconductor, a latent electrostatic image forming unit configured to form a latent electrostatic image on the electrophotographic photoconductor, a developing unit configured to develop the latent electrostatic image by using a toner to form a visible image and a transfer unit configured to transfer the visible image to a recording medium, is arranged in plural numbers are preferable.

In the third embodiment, the process cartridge of the present invention contains at least an electrophotographic photoconductor, a developing unit configured to develop a latent electrostatic image formed on the electrophotographic photoconductor by using a toner to form a visible image and a cleaning unit, wherein the process cartridge can be attached to and removed from the image forming apparatus body, the electrophotographic photoconductor contains a support and at least a photosensitive layer on the support, the photosensitive layer contains a charge generating material and a compound expressed by the following Structural Formula (1).

Structural Formula (1)

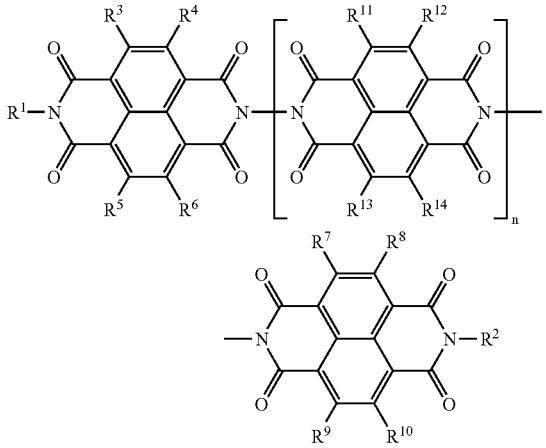

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

The image forming method of the present invention contains at least charging an electrophotographic photoconductor, exposing the charged photoconductor to form a latent electrostatic image, developing the latent electrostatic image by using a toner, transferring the visible image developed by the toner to a recording medium and cleaning the residual toner on the photoconductor, wherein the electrophotographic photoconductor contains a compound expressed by the following Structural Formula (1).

Structural Formula (1)

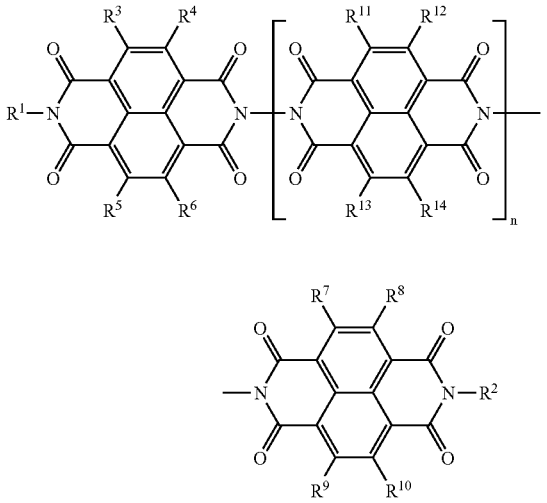

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

In the fourth embodiment, the image forming apparatus of the present invention contains an electrophotographic photoconductor and a charging unit which is arranged so as to be in contact with the electrophotographic photoconductor, wherein a charge is injected to the electrophotographic photoconductor by applying a voltage to the charging unit, the electrophotographic photoconductor contains at least a photosensitive layer and a surface protective layer on a support in this order, and the surface protective layer contains a conductive metal oxide, and any one of the photosensitive layer and the surface protective layer contains a compound expressed by the following Structural Formula (1).

Structural Formula (1)

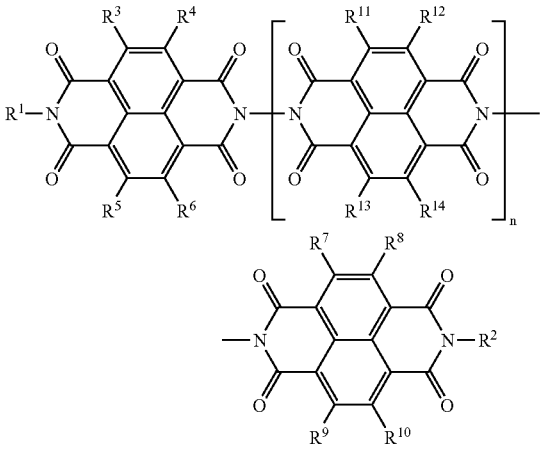

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

Figure 1:
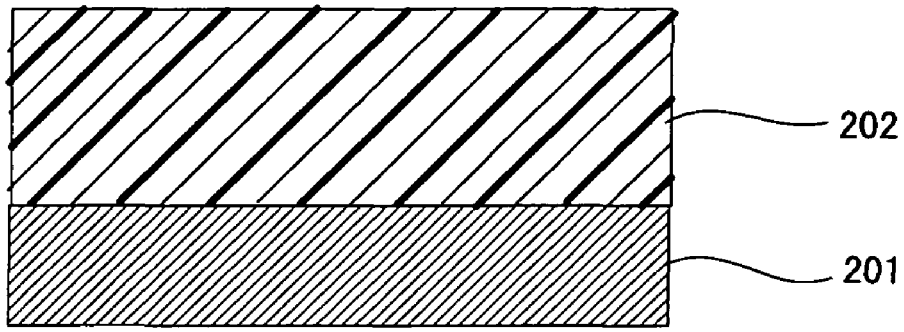
FIG. 1 is a schematic cross-sectional diagram showing an example of the single-layer latent electrostatic image bearing member of the present invention.

DESCRIPTION OF THE PREFERRED EMBODIMENTS (Electrophotographic Photocondutor)

In the first embodiment, the electrophotographic photoconductor of the present invention contains a support and at least a photosensitive layer disposed on the support, wherein the photosensitive layer contains at least a charge generating material and a compound expressed by the following Structural Formula (1), and the electrophotographic photoconductor contains a bipolar optical sensitivity of positive and negative, and a ratio of optical sensitivity at each polarity, E½ (positive) and E½ (negative), [E½ (negative)/E½ (positive)], where "E½" is an exposure energy (μJ/cm$^2$) required for a surface potential to be ½ by exposing with a single light after the electrophotographic photoconductor is charged at ±800V, is 0.5 to 3.0.

Structural Formula (1)

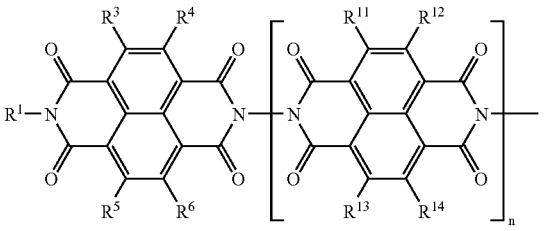

-continued

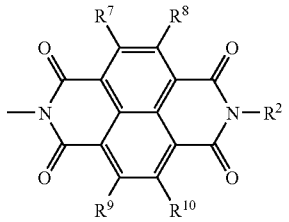

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

It is possible to prevent occurrence of image degradation by transfer and image exposure by using an electrophotographic photoconductor which contains the electron transporting material of the above Structural Formula (1) and has bipolar optical sensitivity of positive and negative, and a ratio of optical sensitivity at each polarity, E½ (positive) and E½ (negative), [E½ (negative)/E½ (positive)] is 0.5 to 3.0. The ratio [E½ (negative)/E½ (positive)] is preferably 0.7 to 2.8.

The ratio [E½ (negative)/E½ (positive)] can be obtained by exposing and charge-removing the obtained sheet photoconductor with a single light of 780 nm after mounting the photoconductor in Model EPA8100 by Kawaguchi Electric Works and charging it at ±800V to measure a half light exposure (E½) at each charge polarity.

In the second embodiment, the electrophotographic photoconductor of the present invention contains a support and at least a photosensitive layer disposed on the support, wherein the photosensitive layer contains an electron generating material, a compound expressed by the above Structural Formula (1) and a fluorine resin particle.

—Fluorine Resin Particle—

The fluorine resin particle is preferably contained in the outermost layer in order to exert its function.

Examples of the fluorine resin particle which can be used in the present invention include ethylene tetrafluoride resin particle, perfluoroalcoxy resin particle, chlorotrifluoroethylene resin particle, ethylene propylene hexafluoride resin particle, vinyl fluoride resin particle, vinylidene fluoride resin particle, dichlorofluoroethylene resin particle and copolymers thereof. Among them, one or more is suitably selected and it is preferably ethylene tetrafluoride resin particle and perfluoroalcoxy resin particle in particular.

The particle diameter of the fluorine resin particle is preferably 0.05 μm to 10 μm and more preferably 0.1 μm to 2.0 μm.

The additive amount of the fluorine resin particle is preferably 5 parts by mass to 100 parts by mass, more preferably 5 parts by mass to 50 parts by mass and most preferably 10 parts by mass to 20 parts by mass relative to 100 parts by mass of the binder resin component for producing additive effect of the fluorine resin particle sufficiently. If the content of the fluorine resin particle is too much, basic properties as a photoconductor may be degraded and if the content is too small, the effect produced by containing fluorine resin particle is not exerted sufficiently.

Examples of the solvent used include all solvents used for the charge transporting layer such as tetrahydrofran, dioxane, toluene, dichloromethane, monochloro benzene, dichloroethane, cyclohexanone, methyl ethyl ketone and acetone.

Meanwhile, high viscosity solvents are preferable during dispersion and high volatility solvents are preferable during coating.

When there are no solvents which satisfy these conditions, it is possible to use a combination of two or more solvents with different properties and it may produce a profound effect on dispersablity of the fluorine resin particle.

The fluorine resin particle can be dispersed by using conventional methods such as atrighter, sand mill, vibrating mill and ultrasonic wave at least with organic solvents. Of these, dispersing by means of a ball mill with which incorporation of impurities from outside is unlikely or dispersing by means of a vibrating mill is more preferable in terms of dispersability.

All material of media conventionally used such as zirconia, alumina and agate, etc. may be used and zirconia is particularly preferable to be used because of excellent effect produced on dispersability of the fluorine resin particle. The dispersability may be increased by combining these dispersion methods in some cases.

Furthermore, dispersing agent may be added to the resins for the purpose of controlling dispersability of the fluorine resin particle. Examples of the dispersing agent include fluorine surfactant, graft polymer, block polymer and coupling agent.

The electrophotographic photoconductor contains a support and at least a photosensitive layer on the support and further contains other layers as necessary.

In the first embodiment, the electrophotographic photoconductor contains a photosensitive layer (hereinafter, may be referred to as "single-layer photosensitive layer") of single layer composition on the support and further contains other layers such as undercoat layer as necessary.

In the second embodiment, the electrophotographic photoconductor contains a support and a photosensitive layer having a laminated composition of the charge generating layer and the charge transporting layer (hereinafter, may be referred to as "multilayer photosensitive layer") disposed on the support and further contains other layers such as undercoat layer as necessary. Meanwhile, the charge generating layer and the charge transporting layer may be laminated reversely in the second embodiment.

The sensitivity of the photosensitive layer in the electrophotographic photoconductor can be improved more by separating its function to the charge generating layer containing charge generating material and the charge transporting layer containing charge transporting material. Moreover, it becomes possible to widen the selectivity of the material used.

In contrast, by making the photosensitive layer in the electrophotographic photoconductor a layer of single layer composition containing charge generating material and charge transporting material in a single layer, it becomes possible to lessen the change in sensitivity due to wear and to suppress the change in property due to repetitive use to the minimum.

Figure 2:
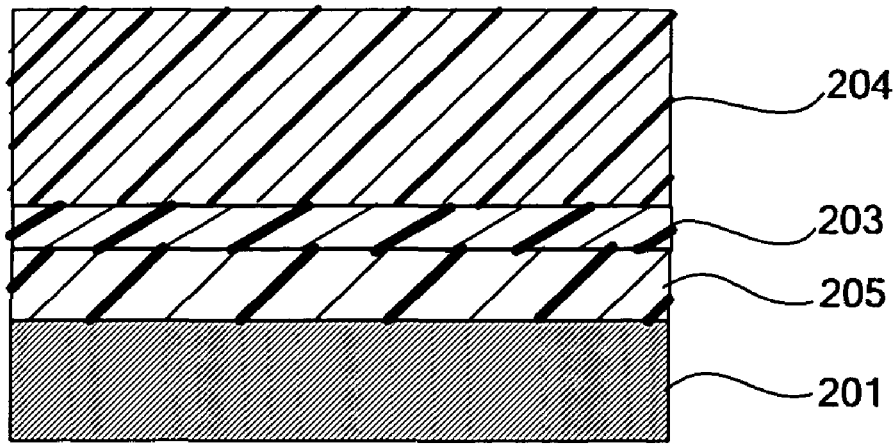
FIG. 2 is a schematic cross-sectional diagram showing an example of the multilayer latent electrostatic image bearing member of the present invention.

FIG. 1 is a cross-sectional pattern diagram of the electrophotographic photoconductor of the present invention and has a composition in which a photosensitive layer 202 is disposed on a support 201. The electrophotographic photoconductor in FIG. 2 is a functional separation type having a photosensitive layer containing a charge generating layer (CGL) 203 and a charge transporting layer (CTL) 204 and an undercoat layer 205 is disposed between the support 201 and the charge generating layer 203. Meanwhile, the other layers and the type of the photosensitive layer may be combined at will as long as the electrophotographic photoconductor of the present invention contains at least the photosensitive layer 202 on the support 201.

The photosensitive layer contains at least the charge transporting layer expressed by the following Structural Formula (1) and a charge generating material and further contains other components as necessary.

—Charge Transporting Material—

The compound expressed by the following Structural Formula (1) is used as the charge transporting material.

Structural Formula (1)

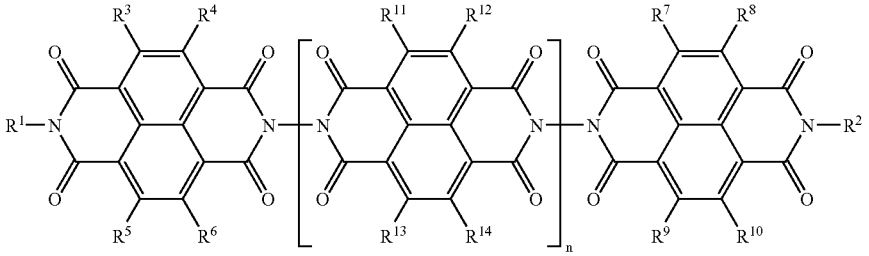

In the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

The alkyl group in the Structural Formula (1) is preferably having a carbon number of 1 to 25 and more preferably having a carbon number of 1 to 10. Preferred examples include straight chain alkyl group such as methyl group, ethyl group, n-propyl group, n-butyl group, n-pentyl group, n-hexyl group, n-peptyl group, n-octyl group, n-nonyl group and n-decyl group; branched alkyl group such as i-propyl group, s-butyl group, t-butyl group, methylpropyl group, dimethylpropyl group, ethylpropyl group, diethylpropyl group, methylbutyl group, dimethylbutyl group, methylpentyl group, dimethylpentyl group, methylhexyl group and dimethylhexyl group; alkoxylalkyl group, monoalkylaminoalkyl group, dialkylaminoalkyl group, halogen-substituted alkyl group, alkylcarbonylalkyl group, calboxylic alkyl group, alkanoyloxylalkyl group, aminoalkyl group, carboxyl group-substituted alkyl group which may be esterified and cyano group-substituted alkyl group. Meanwhile, substitution site of these substituents is not particularly limited and the substituted alkyl group also includes a group of which part of the carbon atom in the above substituted or unsubstituted alkyl group is substituted with hetero atom (N, O, S, and the like).

The cycloalkyl group in the Structural Formula (1) is preferably having a carbon number of 3 to 25 and more preferably having a carbon number of 3 to 10. Preferred examples include the same cyclic group from cyclopropane to cyclodecane; cycloalkyl group having alkyl substituent such as methylcyclopentane, dimethylcyclopentane, methylcyclohexane, dimethylcyclohexane, trimethylcyclohexane, tetramethylcyclohexane, ethylcyclohexane, diethylcyclohexane and t-butylcyclohexane; alkoxylalkyl group, monoalkylaminoalkyl group, dialkylaminoalkyl group, halogen-substituted alkyl group, alkoxylcarbonylalkyl group, calboxylic alkyl group, alkanoyloxyalkyl group, aminoalkyl group, halogen atom, amino group, carboxyl group-substituted cycloalkyl group which may be esterified and cyano group-substituted cycloalkyl group. Meanwhile, substitution site of these substituents is not particularly limited and the substituted cycloalkyl group also includes a group of which part of the carbon atom in the above substituted or unsubstituted cycloalkyl group is substituted with hetero atom (N, O, S, and the like). Examples of halogen atom include fluorine atom, chlorine atom, bromine atom and iodine atom.

Examples of the aralkyl group in the above Structural Formula (1) include substituted or unsubstituted alkyl group which is substituted with aromatic ring and it is preferably having a carbon number of 6 to 14. Preferred examples include benzyl group, perfluorophenylethyl group, 1-phenylethyl group, 2-phenylethyl group, dimethylphenylethyl group, diethylphenylethyl group, t-butylphenylethyl group, 3-phenylpropyl group, 4-phenylbutyl group, 5-phenylpentyl group, 6-phenylhexyl group, benzhydryl group and trityl group.

"n" is a number of replication and represents an integer of 0 to 100 and it is preferably an integer of 0 to 5. "n" is obtained from mass average molecular weight (Mw). More specifically, the compound exists having a molecular weight distribution. When "n" is more than 100, molecular weight of the compound increases and solubility relative to various solvents is lowered and thus, it is, preferably 100 or less. When "n" is 1, it is a trimer of naphthalenecarboxylic acid and excellent electron transfer property can be obtained even with the oligomer if substituents of "$R^1$" and "$R^2$" are selected appropriately. With the number "n" of repeating unit, naphthalenecarboxylic acid derivatives ranging broadly from oligomer to polymer are synthesized.

In the range where molecular weight of the oligomer region is small, a monodispersed compound can be obtained by phased synthesis. For a compound with a large molecular weight, a compound with a molecular weight distribution can be obtained.

Of these, the charge transporting material expressed by the following Structural Formula (1-1) in which "n" is 0 is particularly preferable.

Structural Formula (1-1)

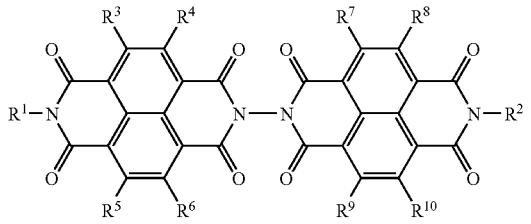

In the above Structural Formula (1-1), "$R^1$", "$R^2$", "$R^3$", "$R^4$", "$R^5$", "$R^6$", "$R^7$", "$R^8$", "$R^9$" and "$R^{10}$" represent the same thing as in the above Structural Formula (1).

Furthermore, the charge transporting material expressed by the following Structural Formula (1-2) is preferable.

Structural Formula (1-2)

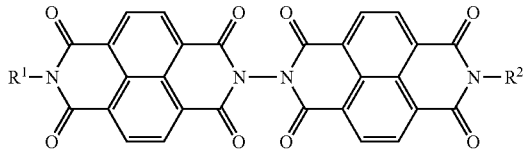

In the above Structural Formula (1-2), "$R^1$" and "$R^2$" represent the same thing as in the above Structural Formula (1).

Specifically, the charge transporting materials expressed by the following Structural Formulas (3) to (10) are preferable for obtaining high quality images. Meanwhile, "Me" represents a methyl group in these Structural Formulas.

Structural Formula (3)

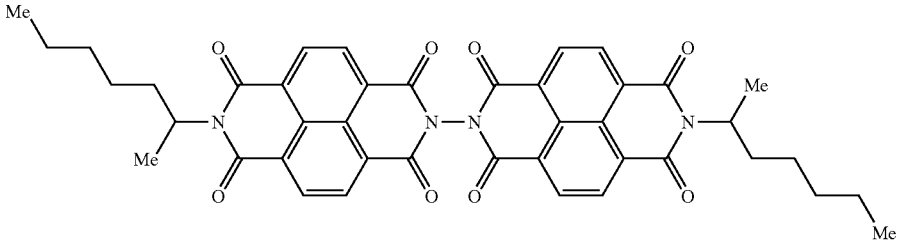

-continued
Structural Formula (4)
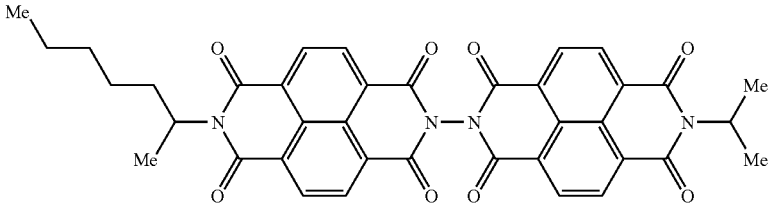
Structural Formula (5)
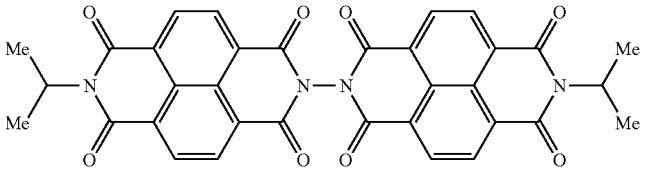
Structural Formula (6)
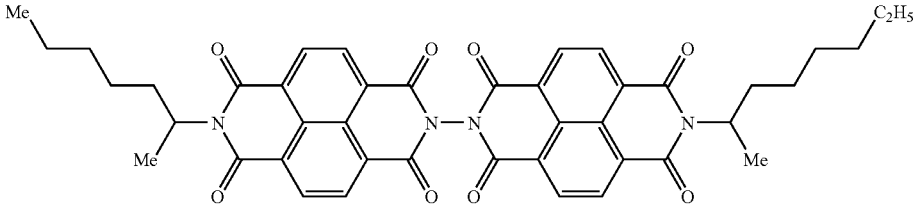
Structural Formula (7)
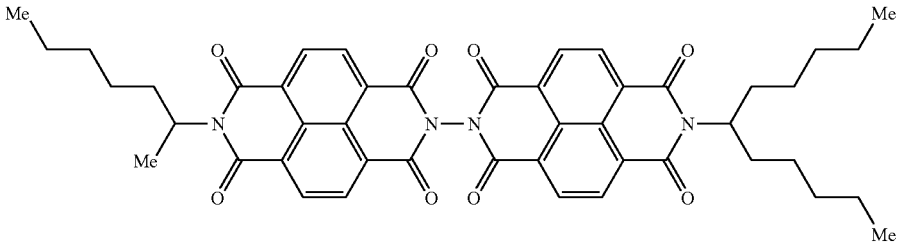
Structural Formula (8)
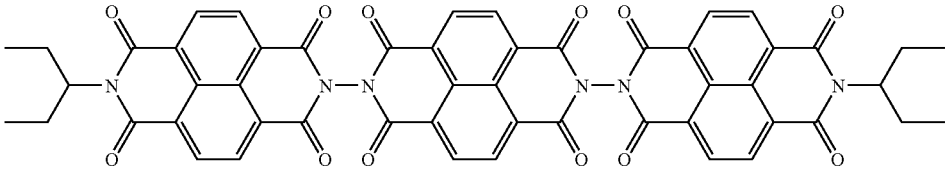
In the above Structural Formula (8), end group of both ends represent Me (methyl) group.
Structural Formula (9)
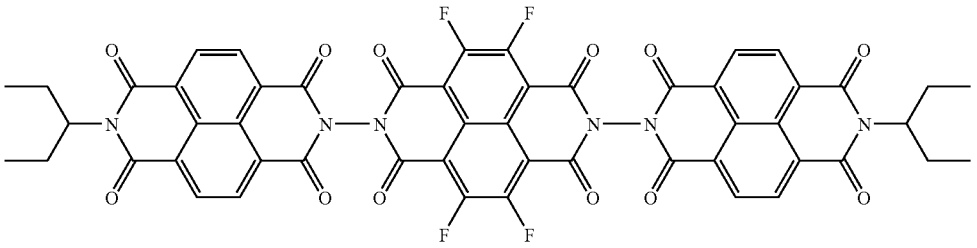

In the above Structural Formula (9), end group of both ends represent Me (methyl) group.

Structural Formula (10)

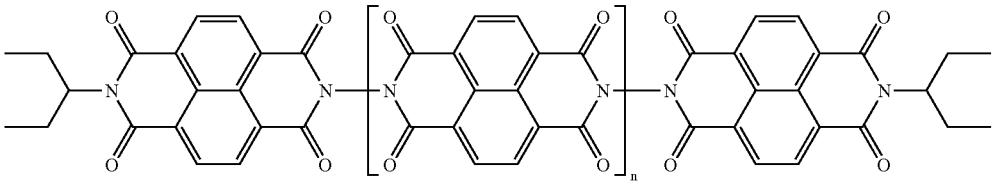

In the above Structural Formula (10), end group of both ends represent Me (methyl) group and "n" represents an integer of 1 to 100.

The charge transporting material expressed by the above Structural Formula (1) can be synthesized typically by the following 2 methods.

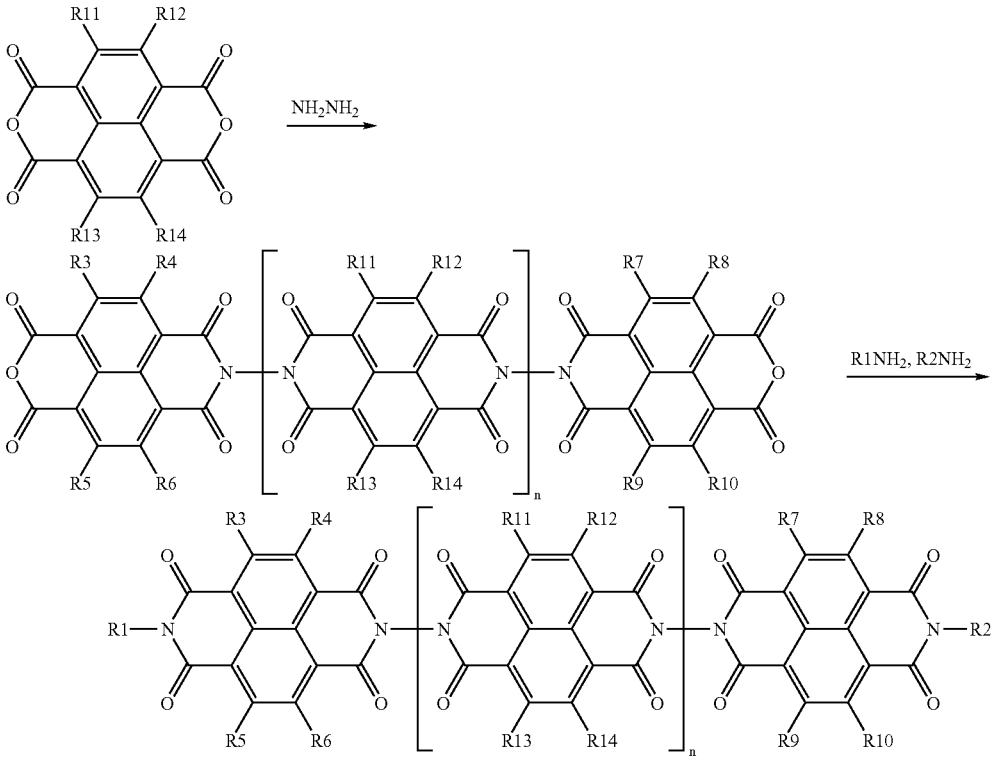

In the above reaction formula, "$R^1$" to "$R^{14}$" and "n" represent the same thing as in the above Structural Formula (1).

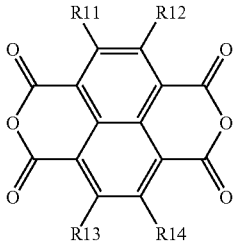

-continued

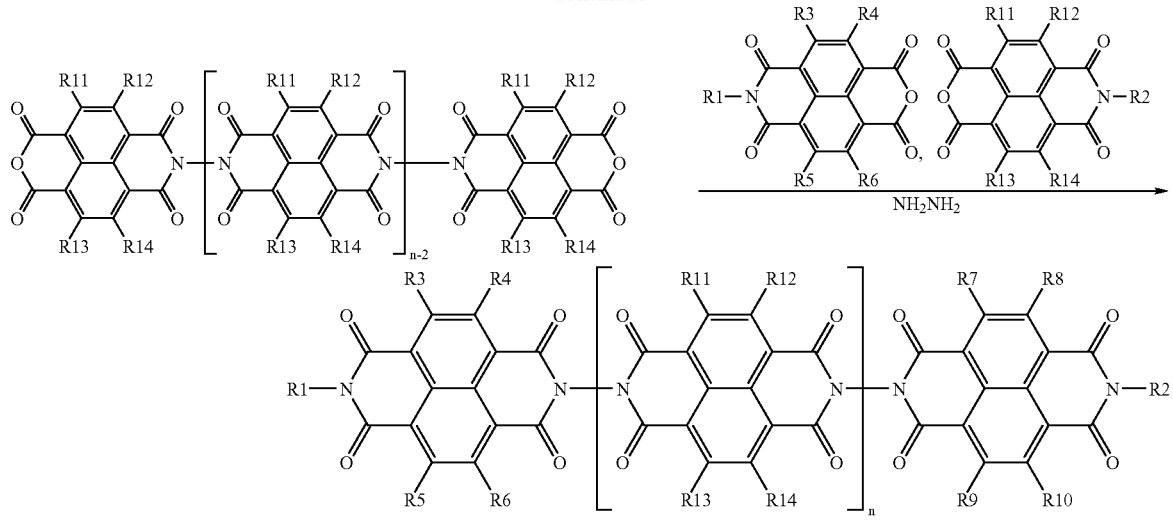

In the above reaction formula, "$R^1$" to "$R^{14}$" and "n" represent the same thing as in the above Structural Formula (1).

Examples of the method for manufacturing the charge transporting material expressed by the above Structural Formula (1-1) include (i) a method in which naphthalenecarboxylic acid or anhydride thereof is subject to reaction with amines to be made into monoimide and (ii) a method in which naphthalenecarboxylic acid or anhydride thereof is pH adjusted with buffering solution and is subject to reaction with diamines.

The above method for making monoimide (i) is performed without solvents or in the presence of solvents. The solvents are not particularly limited and may be selected accordingly. The solvents which do not react with raw material or product and reaction takes place at a temperature of 50° C. to 250° C. are preferably used and examples include benzene, toluene, xylene, chloronaphthalene, acetic acid, pyridine, methylpyridine, dimethylformamide, dimethylacetamide, dimethylethyleneurea and dimethylsuloxide and. Moreover, it is preferable to use a buffering solution prepared by mixing basic water solution such as lithium hydroxide and potassium hydroxide with an acid such as phosphoric acid for pH adjustment.

The dehydration reaction of carboxylic acid derivatives in which carboxylic acid is subject to reaction with amines or diamines as described above (i) and (ii) is performed without solvents or in presence of solvents. The solvents are not particularly limited and may be selected accordingly. The solvents which do not react with raw material or product and reaction takes place at a temperature of 50° C. to 250° C. are preferably used and examples include benzene, toluene, chloronaphthalene, bromonaphthalene and acetic anhydride. Any one of above reaction can be performed without solvents or in presence of solvents and is not particularly limited and molecular sieves, benzenesulfonic acid or p-toluenesulfonic acid can be used as a dehydrating agent, for example.

The charge transporting material expressed by the above Structural Formula (3) can be manufactured by the following method.

<First Step>

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 2.14 g (18.6 mmol) of 2-aminoheptane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 2.14 g (yield: 31.5% by mass) of monoimide A.

<Second Step>

2.0 g (5.47 mmol) of monoimide A, 0.137 g (2.73 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to synthesize 0.668 g (yield: 33.7% by mass) of the charge transporting material expressed by the above Structural Formula (3).

The charge transporting material expressed by the above Structural Formula (4) can be manufactured by the following method.

<First Step>

First, 10 g (37.3 mmol) of 1,4,5,8-naphthalenetetracarboxylic acid dianhydride, 0.931 g (18.6 mmol) of hydrazine monohydrate, 20 mg of p-toluenesulfonic acid and 100 ml of toluene were put in a 4-necked flask of 200 ml and heated to reflux for 5 hours. After reaction was completed, the container was cooled and then condensed under reduced pressure. The residue was purified by silica gel column chromatography. The recovered product was further recrystallized with toluene/ethyl acetate to obtain 2.84 g (yield: 28.7%) of dimer C.

<Second Step>

2.5 g (4.67 mmol) of dimer C and 30 ml of N,N-dimethylformamide (DMF) were put in a 4-necked flask of 100 ml and heated to reflux. A mixture containing 0.278 g (4.67 mmol) of 2-aminopropane and 10 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 0.556 g (yield: 38.5% by mass) of monoimide C.

<Third Step>

0.50 g (1.62 mmol) of monoimide C and 10 ml of N,N-dimethylformamide (DMF) were put in a 4-necked flask of 50 ml and heated to reflux. A mixture containing 0.186 g (1.62 mmol) of 2-aminoheptane and 5 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to synthesize 0.243 g (yield: 22.4% by mass) of the charge transporting material expressed by the above Structural Formula (4).

The charge transporting material expressed by the above Structural Formula (5) can be manufactured by the following method.

<First Step>

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.10 g (18.6 mmol) of 2-aminopropane and 25 ml of N-dimethylformamide (DMF) were allowed to drip into the flask while stirring. After dripping, it was heated to reflux for 6 hours. After reaction was completed, the reaction container was cooled and then condensed under reduced pressure. Toluene was added to the residue and it was purified by silica gel column chromatography. The recovered product was further recrystallized with toluene/hexane to obtain 2.08 g (yield: 36.1% by mass) of monoimide B.

<Second Step>

2.0 g (6.47 mmol) of monoimide B, 0.162 g (3.23 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to synthesize 0.810 g (yield: 37.4% by mass) of the charge transporting material expressed by the above Structural Formula (5).

Moreover, the charge transporting material expressed by the above Structural Formula (6) can be manufactured by the following method.

<First Step>

5.0 g (9.39 mmol) of the above-mentioned dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography to obtain 1.66 g (yield: 28.1% by mass) of monoimide D.

<Second Step>

1.5 g (2.38 mmol) of monoimide D and 50 ml of N,N-dimethylformamide (DMF) were put in a 4-necked flask of 100 ml and heated to reflux. A mixture containing 0.308 g (2.38 mmol) of 2-aminooctane and 10 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to synthesize 0.328 g (yield: 18.6% by mass) of the charge transporting material expressed by the above Structural Formula (6).

The charge transporting material expressed by the above Structural Formula (7) can be manufactured by the following method.

<First Step>

5.0 g (9.39 mmol) of the above-mentioned dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography to obtain 1.66 g (yield: 28.1% by mass) of monoimide D.

<Second Step>

1.5 g (2.38 mmol) of monoimide D and 50 ml of N,N-dimethylformamide (DMF) were put in a 4-necked flask of 100 ml and heated to reflux. A mixture containing 0.408 g (2.38 mmol) of 6-aminoundecane and 10 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to synthesize 0.276 g (yield: 14.8% by mass) of the charge transporting material expressed by the above Structural Formula (7).

The charge transporting material expressed by the above Structural Formula (8) can be manufactured by the following method.

<First Step>

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.62 g (18.6 mmol) of 2-aminopentane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 3.49 g (yield: 45.8%) of monoimide E.

<Second Step>

3.0 g (7.33 mmol) of monoimide E, 0.983 g (3.66 mmol) of 1,4,5,8-naphthalenetetracarboxylic acid dianhydride, 0.368 g (7.33 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified twice by silica gel column chromatography. The recovered product was further recrystallized with toluene/ethyl acetate to obtain 0.939 g (yield: 13.7%) of the compound expressed by the above Structural Formula (8).

A peak at M/z=934 was observed in mass analysis (FD-MS) and it was identified as the target. The calculated values of element analysis were carbon 66.81%, hydrogen 3.67% and nitrogen 8.99% whereas the observed values were carbon 66.92%, hydrogen 3.74% and nitrogen 9.05%.

By further adding the charge transporting material expressed by the following Structural Formula (2) in addition to the charge transporting materials expressed by the above Structural Formulas (1), (1-1) and (1-2), contraction during film forming can be reduced without lowering charge transporting function and when a flexible sheet such as PET sheet or nickel sheet on which aluminum is vapor-deposited is used as a support, warp, which is generally called curl can also be reduced. Furthermore, it is less likely to be affected by acidic gas, in other words, gas resistance is improved because the film is densified by additional charge transporting material.

Structural Formula (2)

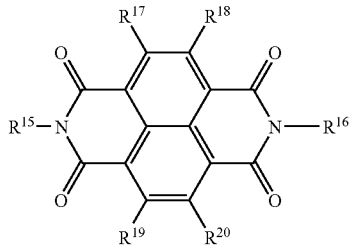

In the Structural Formula (2), "$R^{15}$" and "$R^{16}$" may be identical to each other or different, and represent any one of hydrogen atom, alkyl group which may be substituted, cycloalkyl group which may be substituted and aralkyl group which may be substituted. "$R^{17}$", "$R^{18}$", "$R^{19}$" and "$R^{20}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted.

Examples of the charge transporting material expressed by the above Structural Formula (2) include the following compound.

Structural Formula (11)

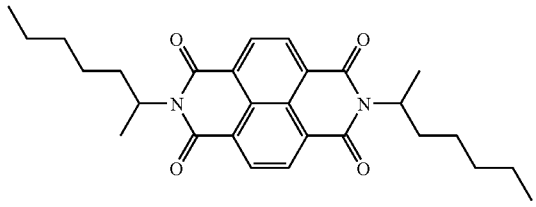

In the above Structural Formula (11), end groups of both ends represent Me (methyl group).

Structural Formula (12)

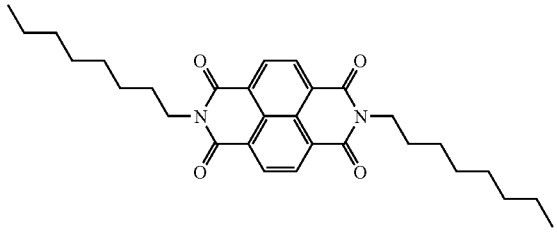

In the above Structural Formula (12), end groups of both ends represent Me (methyl group).

The additive amount of the charge transporting material expressed by the above Structural Formula (2) is not particularly limited and may be selected accordingly and it is preferably 1% by mass to 50% by mass and more preferably 5% by mass to 30% by mass relative to the whole amount of the charge transporting material. When the additive amount is less than 1% by mass, film property is not improved significantly and no well-marked effect is observed and when it is more than 50% by mass, charge transporting function tends to be lowered to an extent.

—Charge Generating Material—

The charge generating material is not particularly limited and may be selected from known charge generating materials accordingly. It is preferably a compound having a phthalocyanine structure in terms of the combination with the charge transporting material of the present invention.

Of these, titanyl phthalocyanine expressed by the following Structural Formula (i) containing titanium as a center metal is particularly preferable because it enables to have high sensitivity photosensitive layer and to further achieve downsizing and higher speed of the image forming apparatus.

Structural Formula (i)

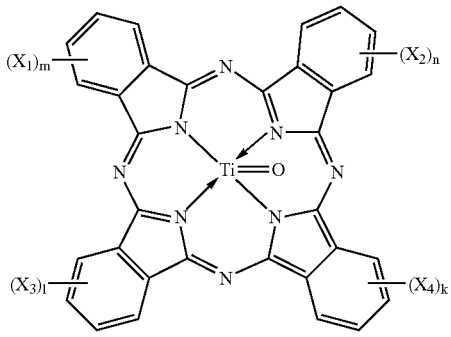

In the above Structural Formula (i), $X_1$, $X_2$, $X_3$ and $X_4$ may be identical to each other or different, and represent various halogen atoms. "n", "m", "l" and "k" may be identical or different and represent an integer of 0 to 4.

Examples of the literatures relating to methods for synthesizing the titanyl phthalocyanine or electrophotographic properties include JP-A Nos. 57-148745, 59-36254, 59-44054, 59-31965, 61-239248 and 62-67094.

Various crystallized titanyl phthalocyanine are known and examples of titanyl phothalocyanine with different crystal forms are disclosed in JP-A Nos. 59-49544, 59-416169, 59-166959, 61-239248, 62-67094, 63-366, 63-116158, 63-196067, 64-17066 and 2001-19871, etc.

Of these crystal forms, a titanyl phthalocyanine having a maximum diffraction peak at 27.2°, a Bragg angle 2θ is preferably used for exhibiting particularly excellent sensitivity. In particular, it is possible to obtain a stable electrophotographic photoconductor which suppresses degradation of charging ability even when used repeatedly without lowering the high sensitivity by using the titanyl phthalocyanine which has a maximum diffraction peak at 27.2°, main peaks at 9.4°, 9.6° and 24.0°, a peak at 7.3° as a diffraction peak at the lowest angle and has no peaks between the peak at 7.4° and the peak at 9.4° as disclosed in JP-A No. 2001-19871.

Furthermore, it is possible to obtain a stable electrophotographic photoconductor which suppresses degradation of charging ability even when used repeatedly without lowering the high sensitivity and thereby significantly improving background smear property by using the titanyl phthalocyanine crystals of which volume average particle diameter of the primary particle is 0.60 μm or less. This is because when the volume average particle diameter of the primary particle is more than 0.60 μm, contact area is lowered, thereby lowering the charge generating efficiency.

<Multilayer Photosensitive Layer>

The multilayer photosensitive layer contains a charge generating layer and a charge transporting layer at least in this order and further contains other layers as necessary.

—Charge Generating Layer—

The charge generating layer contains at least a charge generating material, and a binder resin and further contains other components as necessary.

The charge generating material is not particularly limited and may be selected accordingly and it is preferably phthalocyanine and more preferably titanyl phthalocyanine as described above. The titanyl phthalocyanine having a maximum diffraction peak at least at 27.2° as a diffraction peak (±0.2°) at Bragg angle 2θ relative to a Cu—Kα ray (1.542 Å wavelength), main peaks at 9.4°, 9.6° and 24.0°, a peak at 7.3° as a diffraction peak at the lowest angle and has no peaks between the peak at 7.3° and the peak at 9.4° is preferable.

The content of the charge generating material in the charge generating layer is preferably 10% by mass to 100% by mass and more preferably 20% by mass to 80% by mass.

The binder resin is not particularly limited and may be selected accordingly. Examples include polyamide resin, polyurethane resin, epoxy resin, polyketone resin, polycarbonate resin, silicone resin, acrylic resin, polyvinyl butyral resin, polyvinyl formal resin, polyvinyl ketone resin, polystyrene resin, poly-N-vinylcarbazole resin and polyacrylamide resin. These may be used alone or in combination.

The charge transporting material other than the above may be added accordingly. Moreover, high molecular charge transporting material may be added as a binder resin of the charge generating layer besides the above binder resins.

The methods for forming the charge generating layer include a vacuum thin-film forming method and a casting method from solution dispersal system.

Examples of the vacuum thin-film forming method include glow discharge polymerization, vacuum deposition, CVD, sputtering, reactive sputtering, ion plating and accelerated ion injection. The above-mentioned inorganic material or organic material can be formed appropriately by the vacuum thin-film forming.

When the charge generating layer is disposed by the casting method, known methods such as dip-coating, spray coating and bead coating can be used by using a coating liquid for charge generating layer may be used.

Examples of the organic solvents used for the coating liquid for charge generating layer include acetone, methyl ethyl ketone, methyl isopropyl ketone, cyclohexanone, benzene, toluene, xylene, chloroform, dichloromethane, dichloroethane, dichloropropane, trichloroethane, trichloroethylene, tetrachloroethane, tetrahydrofran, dioxolan, dioxane, methanol, ethanol, isopropyl alcohol, butanol, ethyl acetate, butyl acetate, dimethylsulfoxide, methyl cellosolve, ethyl cellosolve and propyl cellosolve. These may be used alone or in combination.

Of these organic solvents, tetrahydrofran, methyl ethyl ketone, dichloromethane, methanol and ethanol having a boiling point of 40° C. to 80° C. are particularly preferable because drying after coating is easy.

The coating liquid for charge generating layer is prepared by dispersing and/or dissolving the charge generating material and binder resin in the above organic solvent. Examples of the method for dispersing organic pigments in the organic solvents include dispersing methods using dispersal media such as ball mill, bead mill, sand mill, vibration mill, and the like or high-speed fluid collision dispersing method.

The thickness of the charge generating layer is not particularly limited and may be adjusted accordingly and it is preferably 0.01 μm to 5 μm and more preferably 0.1 μm to 2 μm.

—Charge Transporting Layer—

The charge transporting layer is a layer which is disposed for the purpose of maintaining a charge and uniting it with the transferred charge generated and separated from the charge generating layer by exposure. In order to maintain a charge, the charge transporting layer is needed to have high electrical resistance. Moreover, in order to obtain high surface potential with the maintained charge, the charge transporting layer is needed to have low dielectric constant and appropriate charge transferring ability.

The charge transporting layer contains at least a charge transporting material and a binder resin and further contains other components as necessary.

The charge transporting material expressed by the above Structural Formula (1) is used as the charge transporting material as described above.

In addition, known charge transporting material, that is, charge transporting material (acceptor) and the hole transporting material (donor) may be used simultaneously accordingly.

Examples of the charge transporting material include chloranil, bromanil, tetracyanoethylene, tetracyanoquinodimethane, 2,4,7-trinitro-9-fluolein, 2,4,5,7-tetranitro-9-fluolein, 2,4,5,7-tetranitroxanthone, 2,4,8-trinitrothioxanthone, 2,6,8-trinitro-4H-indino[1,2-b]thiophene-4-on and 1,3,7-trinitrodibenzothiophene-5,5-dioxide. These charge transporting materials may be used alone or in combination.

Examples of the hole transporting material include oxazole derivative, oxadiazole derivative, imidazole derivative, triphenylamine derivative, 9-(p-diethylaminostyryl anthracene), 1,1-bis-(4-dibenzylaminophenyl)propane, styryl anthracene, styrylpyrazoline, phenylhydrazones, α-phenylstilbene derivative, thiazole derivative, triazole derivative, phenazine derivative, acridine derivative, benzofuran derivative, benzimidazole derivative and thiophene derivative. These hole transporting materials may be used alone or in combination.

The additive amount of the charge transporting material is preferably 40 parts by mass to 200 parts by mass and more preferably 70 parts by mass to 150 parts by mass relative to 100 parts by mass of the resin component.

Examples of the binder resin include polycarbonate resin, polyester resin, methacrylic resin, acrylic resin, polyethylene resin, polyvinyl chloride resin, polyvinyl acetate resin, polystyrene resin, phenol resin, epoxy resin, polyurethane resin, polyvinylidene chloride resin, alkyd resin, silicon resin, polyvinyl carbazole resin, polyvinyl butyral resin, polyvinyl formal resin, polyacrylate resin, polyacrylamide resin and phenoxy resin. These may be used alone or in combination.

When a high molecular compound which is electrically inactive is used for the purpose of ensuring stability of the charge transporting layer relative to environmental change, preferred example include polyester, polycarbonate, acrylic resin, polystyrene, polyvinyl chloride, polyvinylidene chloride, polyethylene, polypropylene, fluorine resin, polyacrylonitrile, acrylonitrile/styrene/butadiene copolymer, styrene/acrylonitrile copolymer and ethylene/vinyl acetate copolymer. The electrically inactive high molecular compound is defined as a high molecular compound which does not contain a chemical structure which exhibits optical conductivity such as triarylamine structure.

When these resins are used in combination with the binder resin as additives, the additive amount is preferably 50% by mass or less for restriction on optical attenuation sensitivity.

The charge transporting layer can be formed by dissolving and/or dispersing the charge transporting material and the binder resin in an appropriate solvent and by applying and drying the mixture. Additive agents such as plasticizer, antioxidant and leveling agent other than the charge transporting material and the binder resin may be added to the charge transporting layer in an appropriate amount accordingly. These compounds may be used alone or in combination.

The thickness of the charge transporting layer is preferably 15 μm to 40 μm, more preferably 15 μm to 30 μm and most preferably 15 μm to 25 μm.

<Single-Layer Photosensitive Layer>

The single-layer photosensitive layer contains a charge generating material, a charge transporting material and a binder resin and further contains other components as necessary.

The same material as for the multilayer photosensitive layer may be used for the charge generating material, the charge transporting material and the binder resin.

The additive amount of the charge generating material is preferably 0.1 parts by mass to 20 parts by mass and more preferably 0.5 parts by mass to 10 parts by mass relative to 100 parts by mass of resin component. The additive amount of the charge transporting material is preferably 40 parts by mass to 200 parts by mass and more preferably 70 parts by mass to 150 parts by mass relative to 100 parts by mass of resin component.

When a single-layer photosensitive layer is disposed by casting method, it can be formed by dissolving and/or dispersing the charge generating material and low-molecular and high molecular charge transporting materials in an appropriate solvent and by applying and drying the mixture. Moreover, plasticizer and binder resin may be further contained in the single-layer photosensitive layer as necessary. The same binder resin as for the charge transporting layer may be used as the binder resin.

The thickness of the single-layer photosensitive layer is preferably 10 μm to 45 μm, more preferably 15 μm to 32 μm and most preferably 15 μm to 25 μm. When the thickness is less than 10 μm, charging ability may be degraded and when it is more than 45 μm, sensitivity may be degraded.

<Support>

The support is not particularly limited and may be selected accordingly. It is preferably a support which exhibits conductivity of a volume resistance of $10^{10}$ Ω·cm or less.

The material, shape and size of the support is not particularly limited and plate-like, drum-shaped or belt-shaped support may be used. Examples include film-shaped or cylindrical plastic or paper which is coated with metals such as aluminum, nickel, chrome, nichrome, copper, gold, silver and platinum or metal oxides such as tin oxide and indium oxide by vapor deposition or sputtering, and plate-like aluminum, aluminum alloy, nickel or stainless steel or tube which is surface-processed by cutting, superfinishing or polishing, etc. after plate-like aluminum, aluminum alloy or stainless steel is formed into a tube by methods such as extrusion or drawing. Also, the endless nickel belt and endless stainless-steel belt disclosed in JP-A No. 52-36016 may be used as a support.

Other than the above, the support on which a conductive layer is formed by dispersing a conductive fine particle to an appropriate binding resin and applying it on the support can be used.

Examples of the material for the conductive fine particle include carbon black, acetylene black, metal powder of aluminum, nickel, iron, nichrome, copper, zinc and silver, etc., or metal oxide fine particle such as conductive tin oxide and ITO. Examples of the binding resin include polystyrene resin, styrene-acrylonitrile copolymer, styrene-butadiene copolymer, styrene-maleic anhydride copolymer, polyester resin, polyvinyl chloride resin, vinyl chloride-vinyl acetate copolymer, polyvinyl acetate resin, polyvinylidene chloride resin, polyacrylate resin, phenoxy resin, polycarbonate, acetylcellulose resin, ethylcellulose resin, polyvinyl butyral resin, polyvinyl formal resin, polyvinyl toluene resin, poly-N-vinylcarbazole resin, acyclic resin, silicon resin, epoxy resin, melamine resin, urethane resin, phenol resin and alkyd resin.

The conductive layer can be formed by applying a coating liquid in which the conductive fine particle and the binding resin are dissolved and/or dispersed in a solvent on the support. Examples of the solvent include tetrahydrofran, dichloromethane, methyl ethyl ketone and toluene.

Meanwhile, a cylindrical base substance on which a conductive layer is disposed by heat contraction tube in which the conductive fine particle is contained in polyvinyl chloride resin, polypropylene resin, polyester resin, polystyrene resin, polyvinylidene chloride resin, polyethylene resin, chlorinated rubber and polytetrafloroethylene-based fluorine resin is also preferable to be used as a support.

It has been found and lead to the present invention that the above objects can be achieved by an image forming apparatus in which the photoconductor support is drum-shaped, and flanges having a pair of roller bearing holes fitted to openings of both ends of the support and to the drum-shaped support respectively and a shaft which is fixed to the center of each flange and run through the support as a central rotating axis are contained. It becomes possible to pursue high quality images and high durability simultaneously with the image forming apparatus of the above composition.

Because the image forming apparatus of the present invention is equipped with flanges having a pair of roller bearing holes fitted to openings of both ends of the support and to the drum-shaped support respectively and a shaft which is fixed to the center of each flange and run through the support as a central rotating axis, the driving stress put on only one side of the support drum is reduced, warp and strain in the flange joint of the photoconductor and the support are suppressed even during repetitive use for prolonged periods, thereby enabling to obtain stable and high accuracy rotational movement and high quality and high durability image forming apparatus as a whole.

And as a secondary effect, undesirable resonance is also inhibited because fitting rigidity is increased by letting the shaft, which penetrates the flange, run through the flange in the opening of both ends and sympathetic resonance of frequency overtone is suppressed even when a charging mechanism which provides superimposed alternating voltage is employed.

And because the image forming apparatus of the above structure has high durability and high rigidity, the electrophotographic photoconductor, particularly the photosensitive layer used for the image forming apparatus also desirably have high durability, rigidity and toughness, enabling to form images without color deviation for prolonged periods. However, the method in which a direct voltage superimposed with alternating voltage is applied to the charging unit is hard on the photosensitive layer and the photosensitive layer is likely to be degraded. Moreover, it is generally difficult for the photosensitive layer to exhibit rigidity and toughness for prolonged periods for forming images without color deviation in the image forming process.

The photoconductor is drum-shaped and is equipped with a pair of flanges (not shown) fitted to both ends and a shaft (penetrating axis) which penetrates the flanges.

The flange is a member which is fitted to one end or both ends of the photoconductor drum to support or to rotary-drive the drum and examples include a flange made of resins such as plastic or a flange partially made of metal. A gear is generally disposed on the flange and the flange obtains driving power for rotation through the gear. Diameter of the shaft in a longitudinal direction is preferably 3 mm to 20 mm at least in part for ensuring rigidity. It is because when the diameter is less than 3 mm, it may not be sufficient in terms of strength. When it is more than 20 mm, a problem of mass increase arises or inertial force during rotary-driving is increased and problems such as difficulty in accurately controlling the positions of the start and finish of the rotation tend to occur. The material of the shaft is not particularly limited and it is preferably made of metal. Furthermore, it is more preferable to use rust-free stainless steel for stability over time.

—Surface Protective Layer—

Figure 12:
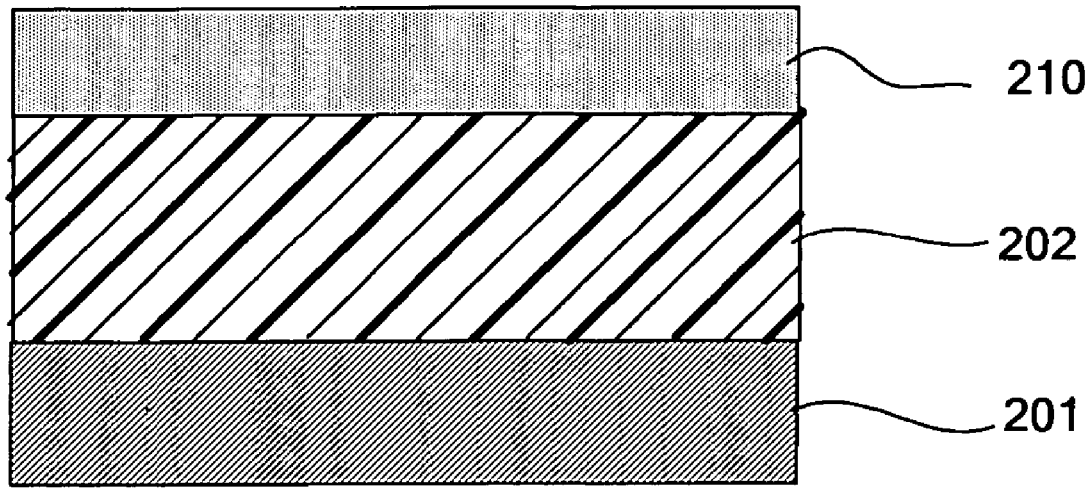
FIG. 12 is a schematic diagram showing an example of the single-layer electrophotographic photoconductor of the present invention.
Figure 13:
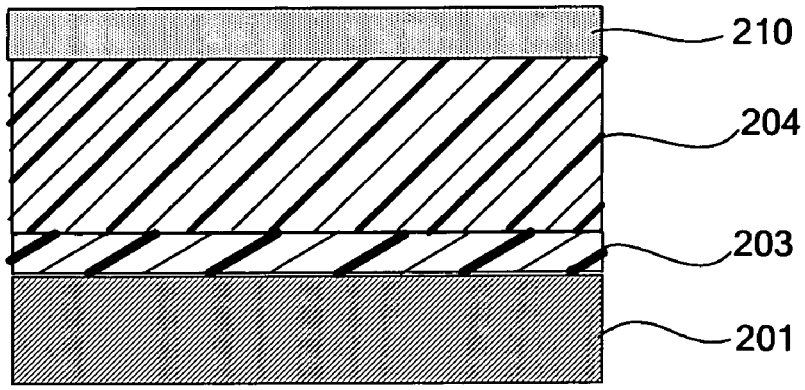
FIG. 13 is a schematic diagram showing an example of the multilayer electrophotographic photoconductor of the present invention.
Figure 14:
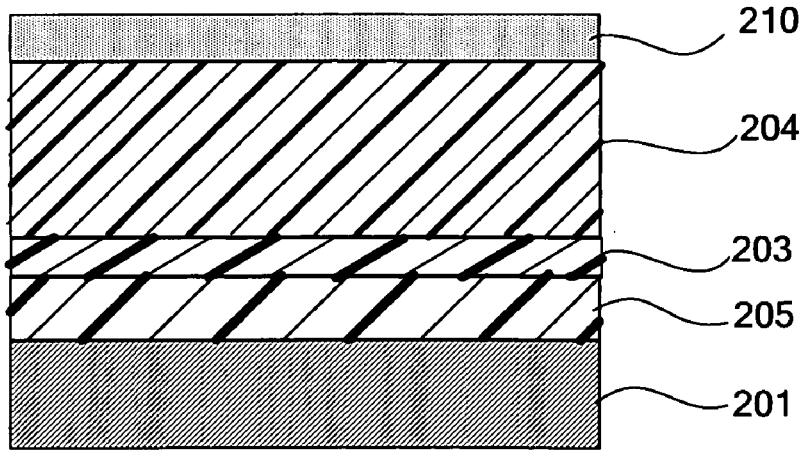
FIG. 14 is a schematic diagram showing another example of the multilayer electrophotographic photoconductor of the present invention.

FIGS. 12 to 14 are cross-sectional pattern diagrams showing exemplary photoconductors for electrophotography of the present invention and FIG. 12 shows a composition in which a photosensitive layer 202 and a surface protective layer 210 are disposed on a support 210. FIGS. 13 and 14 show exemplary compositions of other photoconductors for electrophotography of the present invention. FIG. 13 shows a photoconductor of functional separation type in which the photosensitive layer consist of a charge generating layer (CGL) 203 and a charge transporting layer (CTL) 204 and FIG. 14 shows a support and a photoconductor of functional separation type in which an undercoat layer 205 is disposed between a charge generating layer (CGL) 203 and a support 201. Meanwhile, other layers as described above and types of the photosensitive layer may be combined randomly as long as at least a photosensitive layer and a surface protective layer are disposed on the support.

The surface protective layer consist of conductive metal oxides such as tin oxide, titanium oxide, TiO, zinc oxide, indium oxide, antimony oxide and titanium oxide of which the surface is made electrically conductive, thermoplastic resins such as polycarbonate, polyester, methacrylic resin, acrylic resin, polyethylene, vinyl chloride, vinyl acetate, polystyrene and polyacrylamide or heat-curable resins such as phenol resin, epoxy resin, polyurethane, alkyd resin, silicon resin, polyvinyl butyral, polyvinyl formal, polyacrylate and phenoxy resin and naphthalenecarboxylic acid derivative of Structural Formula (1-1). The particle diameter of the conductive metal oxide is preferably 0.3 μm to 1 μm. It is preferably 0.3 μm or less in terms of translucency, however, toner filming and image deletion tend to occur. When the particle diameter is more than 1 μm, uniformity in charge injection cannot be obtained and results in rough images. Examples of titanium oxide of which the surface is made electrically conductive include white conductive titanium oxide which is a processed tin oxide conductive layer (ET-500W by Ishihara Sangyo Kaisha, Ltd.) or tin oxide which is made electrically conductive with tin oxide or antimony oxide (SN-100 by Ishihara Sangyo Kaisha, Ltd.)

Structural Formula (1-1)

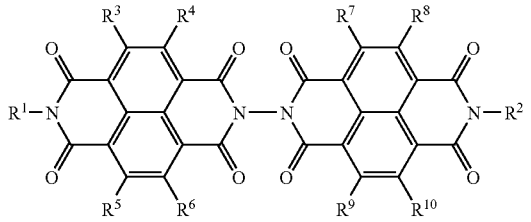

The volume resistance of the surface protective layer of the present invention is preferably $10^9$ Ω·cm to $10^{12}$ Ω·cm. When it is less than $10^9$ Ω·cm, image blur occurs and when it is more than $10^{12}$ Ω·cm, white void images due to charging injection defects occur. The content of the conductive fine particle is preferably in the range of 10% by mass to 80% by mass. Various additive agents may be added to the charge injection layer for the purpose of improving dispersability of conductive fine particle or improving adhesiveness or flatness. In particular, conducting surface treatment to the conductive fine particle by adding coupling agents or leveling agents is highly effective for improving dispersability. Similarly, properties are further improved by using curable resins as binder resin for improving dispersability. When a curable resin is used for the charge injection layer, a coating liquid in which conductive fine particle is dispersed in curable monomer of oligomer solution is applied on the photosensitive layer to form a film and the charge injection layer is formed by curing the coated film by heat or light irradiation. The thickness of the surface protective layer is preferably 0.5 μm to 10 μm.

In the photoconductor of the present invention, a protective layer 26 may be formed as an outermost layer as shown in FIGS. 12 to 14 for the purpose of protecting photosensitive layer and maintaining low friction coefficient.

Examples of the binding resin used for the protective layer 26 include ABS resin, ACS resin, olefin-vinyl monomer copolymer, chlorinated polyether, aryl resin, phenol resin, polyacetal, polyamide, polyamide-imide, polyacrylate, polyaryl sulfonate, polybutylene, polybutylene terephthalate, polycarbonate, polyether sulfonate, polyethylene, polyethylene terephthalate, polyimide, acrylic resin, polymethylpentene, polypropylene, polyphenylene oxide, polysulfonate, polystyrene, polyacrylate, polyarylate, AS resin, butadiene-styrene copolymer, polyurethane, polyvinyl chloride, polyvinylidene chloride and epoxy resin. In particular, polycarbonate and polyacrylate are effective and useful in terms of dispersability, residual potential and film-coating defects of fluorine resin particle.

Filler material may be added to the protective layer of the photoconductor for the purpose of improving wear resistance.

The filler materials include organic filler and inorganic filler and inorganic filler is advantageous for improving wear resistance because of filler hardness.

Examples of the inorganic filler material include metallic powder such as copper, tin, aluminum and indium, metal oxides such as silica, tin oxide, zinc oxide, titanium oxide, alumina, zirconium oxide, indium oxide, antimony oxide, bismuth oxide, calcium oxide, tin oxide doped with antimony and indium oxide doped with tin, metal fluorides such as tin fluoride, calcium fluoride and aluminum fluoride and inorganic material such as potassium titanate and boron nitride.

It is possible to conduct surface processing of these fillers by using at least one type of surface processing agent and it is preferable in terms of dispersability of the filler.

Because degradation of dispersability of the filler induces degradation of transparency in coated film and coated film defects and further induces degradation of wear resistance as well as increase in residual potential, it may develop to a major problem which interferes with the development for achieving higher durability and higher image quality.

All conventionally used surface processing agents can be used as the surface processing agent and it is preferably a surface processing agent which can maintain insulation properties of the filler. For example, titanate coupling agent, aluminum coupling agent, zircoaluminate coupling agent, higher fatty acid, or mixtures of these above with silane coupling agent, $Al_2O_3$, $TiO_2$, $ZrO_2$, silicon, aluminum stearate, or mixtures of these above are preferable in terms of dispersability of the filler and image blur.

Even though the effect of image blur is increased by processing with a silane coupling agent, the effect may be suppressed by mixing the above surface processing agent and silane coupling agent.

The amount of surface processing depends on the average primary particle diameter of the used filler and it is preferably 3% by mass to 30% by mass and more preferably 5% by mass to 20% by mass.

When the amount of surface processing is less than 3% by mass, dispersion effect of the filler cannot be obtained and when it is more than 30% by mass, it induces significant increase in residual potential.

—Undercoat Layer—

An undercoat layer may be further disposed between the support and the photosensitive layer as necessary. The undercoat layer generally contains a resin as a main component. These resins are preferably having high solvent resistance relative to general organic solvents because photosensitive layers are coated on these resins by using a solvent.

Examples of the resin include water-soluble resins such as polyvinyl alcohol, casein and sodium polyacrylate, alcohol-soluble resins such as copolymerized nylon and methoxymethylated nylon, curable resins forming a three dimensional network such as polyurethane resin, melamine resin, phenol resin, alkyd-melamine resin and epoxy resin.

Fine powdered pigment of metallic oxides exemplified by titanium oxide, silica, alumina, zirconium oxide, tin oxide and indium oxide may be added to the undercoat layer for preventing moire and reducing residual potential.

The undercoat layer can be formed by using the same solvent and coating method as for the photosensitive layer. Furthermore, silane coupling agent, titanium coupling agent and chrome coupling agent can be used as the undercoat layer of the present invention. For the undercoat layer, anodized $Al_2O_3$, or organic substances such as polyparaxylylene (parylene) or inorganic substances such as $SiO_2$, $SnO_2$, $TiO_2$, ITO and $CeO_2$ disposed by vacuum film-forming method may suitably be used. In addition, other known materials may be used.

The thickness of the undercoat layer is not particularly limited and may be adjusted accordingly and it is preferably 0.1 μm to 10 μm and more preferably 1 μm to 5 μm.

Moreover, antioxidant may be added to each layer of photosensitive layer, charge generating layer, charge transporting layer and undercoat layer in the electrophotographic photoconductor of the present invention for the purpose of improving environmental resistance, particularly preventing lowering of sensitivity and increase in residual potential.

Examples of the antioxidant include phenol compound, paraphenylenediamines, organic sulfur compounds and organic phosphorus compounds.

Examples of the phenol compound include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester and tocopherols.

Examples of the paraphenylenediamines include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of organic sulfur compounds include dilauryl-3,3'-thiodipropionate, distearyl-3,3'-thiodipropionate, and ditetradecyl-3,3'-thiodipropionate.

Examples of organic phosphorus compounds include triphenylphosphine, tri(nonylphenyl)phosphine, tri(dinonylphenyl)phosphine, tricresyl phosphate and tri(2,4-dibutylphenoxy)phosphine.

These compounds are known as antioxidants for rubbers, plastics and fats and oils and commercialized products are easily available.

The additive amount of the antioxidant is preferably 0.01% by mass to 10% by mass relative to the whole amount of the layer to which the antioxidant is added.

(Image Forming Apparatus and Image Forming Method)

In the third embodiment, the image forming apparatus of the present invention contains at least an electrophotographic photoconductor, a charging unit configured to charge the photoconductor, an exposing unit configured to expose the charged photoconductor to form a latent electrostatic image, a developing unit configured to develop the latent electrostatic image by using a toner, a transfer unit configured to transfer the visible image developed by the toner to a recording medium and a cleaning unit configured to remove the residual toner on the photoconductor, wherein the electrophotographic photoconductor contains a support and at least a photosensitive layer disposed on the support, wherein the photosensitive layer contains a charge generating material and a compound expressed by the following Structural Formula (1).

Structural Formula (1)

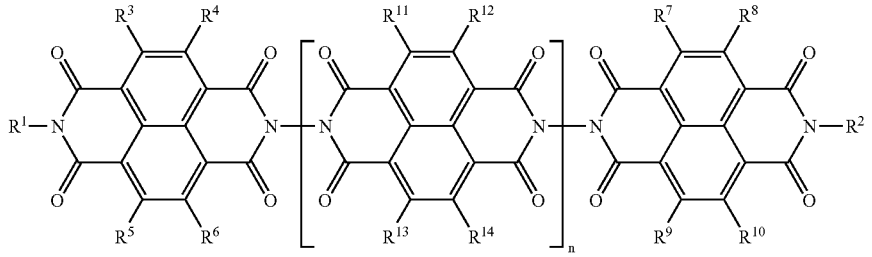

Where, in the Structural Formula (1), "$R^1$" and "$R^2$" may be identical to each other or different, and represent any one of hydrogen atom, alkyl group which may be substituted, cycloalkyl group which may be substituted and aralkyl group which may be substituted. "$R^3$", "$R^4$", "$R^5$", "$R^6$", "$R^7$", "$R^8$", "$R^9$", "$R^{10}$", "$R^{11}$", "$R^{12}$", "$R^{13}$" and "$R^{14}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted. "n" is a number of replication and represents an integer of 0 to 100.

In this case, an embodiment wherein an average degree of circularity of the toner is 0.93 to 0.99, an embodiment wherein the cleaning unit contains a brush with a loop-shaped leading end which rotates while in contact with the photoconductor and the loop-shaped leading end side of the brush is turned to upstream side of the rotation direction of the brush from the base side, an embodiment wherein the support is drum-shaped, and the image forming apparatus contains flanges having a pair of roller bearing holes fitted to openings of both ends of the support and to the drum-shaped support respectively and a shaft which is fixed to the center of each flange and run through the support as a central rotating axis, and an embodiment wherein the image forming element containing at least an electrophotographic photoconductor, a latent electrostatic image forming unit configured to form a latent electrostatic image on the electrophotographic photoconductor, a developing unit configured to develop the latent electrostatic image by using a toner to form a visible image and a transfer unit configured to transfer the visible image to a recording medium, is arranged in plural numbers are preferable.

The image forming method of the present invention contains at least charging an electrophotographic photoconductor, exposing the charged photoconductor to form a latent electrostatic image, developing the latent electrostatic image by using a toner, transferring the visible image developed by the toner to a recording medium and cleaning the residual toner on the photoconductor, wherein the electrophotographic photoconductor contains a compound expressed by the above Structural Formula (1).

In the fourth embodiment, the image forming apparatus of the present invention contains an electrophotographic photoconductor and a charging unit which is arranged so as to be in contact with the electrophotographic photoconductor, wherein a charge is injected to the electrophotographic photoconductor by applying a voltage to the charging unit, the electrophotographic photoconductor contains at least a photosensitive layer and a surface protective layer on a support in this order, and the surface protective layer contains a conductive metal oxide, and any one of the photosensitive layer and the surface protective layer contains a compound expressed by the above Structural Formula (1).

The image forming method of the present invention may be favorably implemented by means of the image forming apparatus of the invention. The latent electrostatic image forming may be performed by the latent electrostatic image forming unit, the developing may be performed by the developing unit, the transferring may be performed by the transferring unit and other steps may be performed by other units respectively.

—Latent Electrostatic Image Forming and Latent Electrostatic Image Forming Unit—

The latent electrostatic image forming is a step to form a latent electrostatic image on a photoconductor.

The latent electrostatic image may be formed, for example, by uniformly charging the surface of the photoconductor and irradiating it imagewise and this may be performed by the latent electrostatic image forming unit.

The latent electrostatic image forming unit, for example, contains a charging device which uniformly charges the surface of the photoconductor, and an exposing device which exposes the surface of the photocondutor imagewise.

Charging may be performed, for example, by applying a voltage to the surface of the photoconductor using the charging device.

The charging device is not particularly limited and may be selected accordingly. Examples of charging device include known contact charging devices equipped with conductive or semi-conductive roller, brush, film or rubber blade and non-contact charging devices using corona discharge such as corotron and scorotron, etc.

The charging method of the present invention will be explained below. The charging method of the present invention is a contact charging method without discharging phenomenon. In other words, it is a charge injection charging method by which the photoconductor is charged with electric potential corresponding to the voltage applied to the contact charging device. Since this method is not associated with discharge, generation of ozone or nitrogen oxide is low and the voltage applied for charging the photoconductor is additionally lower than that of the process which employs the conventional contact charging method, thus it is energy saving.

A surface protective layer which functions as a charge injection layer is disposed on the above outermost layer of the used photoconductor. The charge injection layer works as an electrode of the condenser. Charge can be injected by bringing a conductive contact charging member with the electrode and applying a voltage. Without the charge injection layer such as above, there is no electrode on the surface of photoconductor and charge injection would not be satisfactory.

A uniform charge sheet can be formed on the surface of the photoconductor below the charge injection layer by disposing the charge injection layer on the surface of the photoconductor. The charge injection layer is required to have properties which transfer the charge applied from the contact charging device quickly to the outer layer of the photosensitive layer to form a uniform charge sheet.

In order to form a uniform charge sheet, it is necessary for both of the charge injection layer and the contact charging device to have properties such as uniform contact ability, nip, contact resistance and volume resistivity value of members and these properties have to be set in the preferred range.

Examples of the contact charging method are shown in FIGS. 11A to 11E.

Figure 11A:
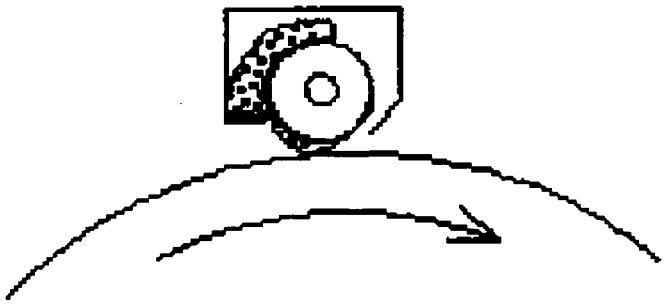
FIG. 11A is a diagram showing a method for charging magnetic brush.
Figure 11B:
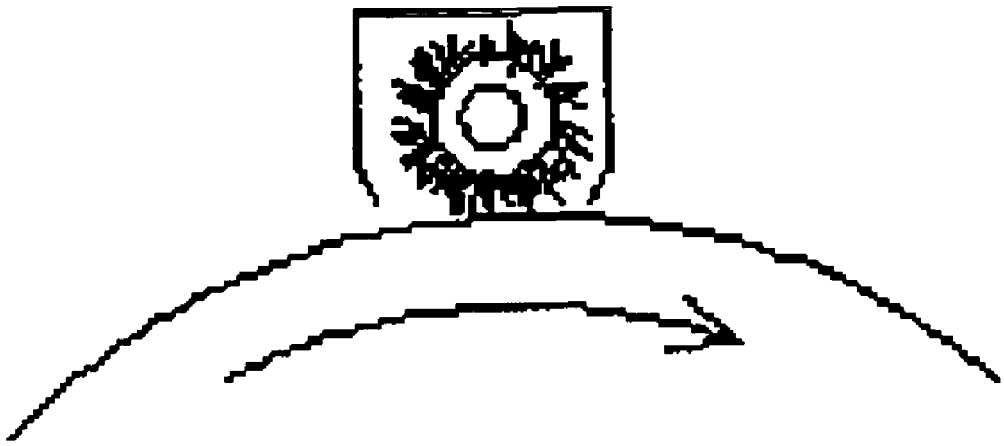
FIG. 11B is a diagram showing a method for charging conductive brush.
Figure 11C:
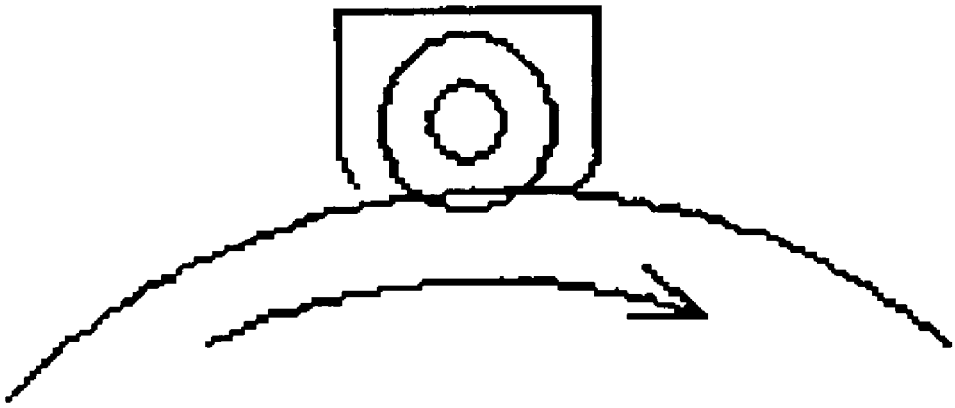
FIG. 11C is a diagram showing a method for charging roller using a conductive soft roller.
Figure 11D:
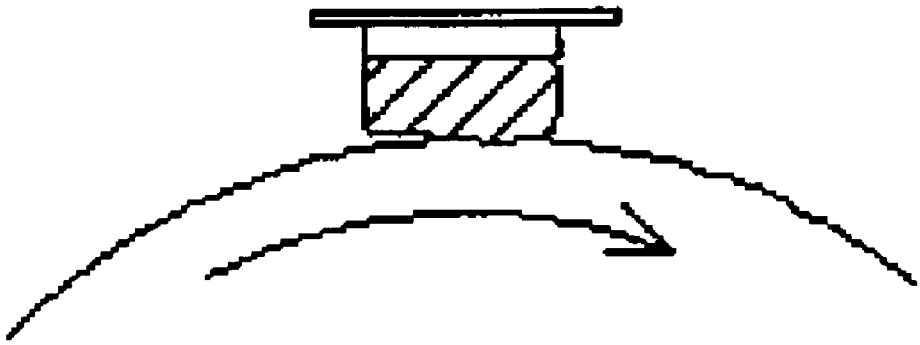
FIG. 11D is a diagram showing a fixed (blade) method for charging.
Figure 11E:
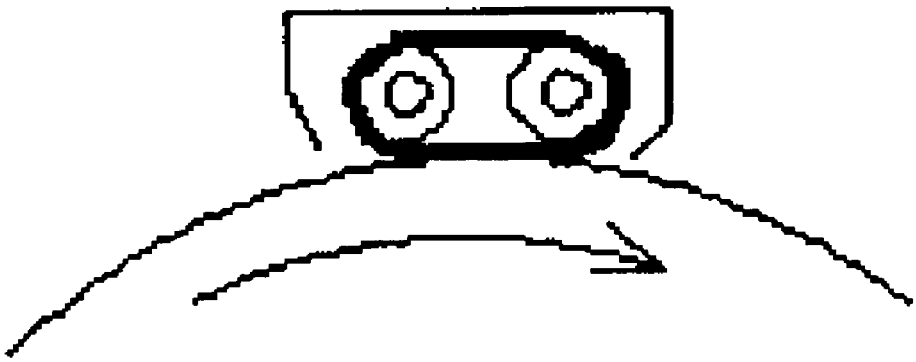
FIG. 11E is a diagram showing a belt method for charging.

FIG. 11A shows a magnetic brush charging method, FIG. 11B shows a (conductive) brush charging method, FIG. 11C shows a roller charging method using a conductive soft roller, FIG. 11D shows a fixed (blade type) charging method and FIG. 11E shows a belt charging method using two rollers and conductive belt.

It is necessary to ensure required nip with the photoconductor by application of appropriate voltage, reduce airspace between the photoconductor and the charging device as much as possible and attach the photoconductor and the charging device firmly as much as possible for charging the photoconductor uniformly without electric discharge.

In the magnetic brush charging method as shown in FIG. 11A, magnetic fine particle such as spherical or almost-spherical ferrite, manganese oxide and γ-ferric oxide of approximately 20 μm to 150 μm or the above magnetic fine particle coated with polyester resin or fluorine resin for the purpose of improving flowability and serving as a protective layer, is suctioned in a thickness of approximately 1 mm to 5 mm into a magnetic roller, which is a magnetic roller with alternative magnets of negative pole and positive pole, coated with non-magnetic sleeve made of aluminum or bakelite, etc. to form a layer.

The resistance value of the magnetic fine particle is generally in the range of $10^5$ Ω·cm to $10^{10}$ Ω·cm and charge injection property improves with lower resistance. It is particularly preferable to be in the range of $10^6$ Ω·cm to $10^9$ Ω·cm. By using the magnetic brush, it is possible to have a process without cleaning. When the resistance value of the magnetic fine particle is less than $10^5$ Ω·cm, image deletion in high temperature and high humidity environment tends to occur and when it is more than $10^{10}$ Ω·cm, white void in high temperature and high humidity environment tends to occur.

In the conductive brush charging method as shown in FIG. 11B, a member made of a fiber such as rayon, acryl, polypropylene, polyester and polyacrylonitrile which is made electrically conductive with carbon or copper sulfide, a member made by spinning with a fiber into which conductive filler such as zinc oxide, tin oxide and titanium oxide is kneaded or a member into which metallic thread is weaved is used and formed into a brush.

Furthermore, fibers baked in an inactive gas atmosphere such as carbon fiber or activated carbon fiber may also be used.

The resistance value of the member in the contact charging device is preferably in the range of $10^2$ Ω·cm to $10^{10}$ Ω·cm.

The volume resistivity of the carbon fiber or activated carbon fiber can be changed freely with baking temperatures. When the carbon component is 90% or more, the resistance value is significantly lowered as much as $10^2$ Ω·cm. Therefore, there is a risk of discharge breakdown when there is a pinhole in the photoconductor, however, it does not matter when the conductive brush is used with a low power voltage. In general, protective resistances of approximately 100 kΩ to 5MΩ are inserted serially between voltage supply source and the conductive brush.

The (soft) roller charging method as shown in FIG. 11C is preferable for obtaining appropriate nip and adhesiveness with the photoconductor. A soft rubber or foam (urethane sponge or foam) is used for the material of soft roller and its outer layer or the whole layer is made electrically conductive. Examples of the material used for making conductive state include $SnO_2$, $TiO_2$, $ZnO_2$, conductive fillers such as carbon black and conductive fibers such as carbon fiber and activated carbon fiber.

The fixed (blade type) charging method as shown in FIG. 11D charges the photoconductor by rubbing and most members as described above are usable.

For example, charging is performed by bringing an elastic member such as sponge or foam covered with a carbon fiber or activated carbon fiber with a fine texture (manufactured by Unitika, Ltd. and Toho Tenax Co., Ltd., FW210 or FW310 by Toho Tenax Co., Ltd., for example) in contact with the photoconductor as a charging member.

The belt charging device as shown in FIG. 11E is an appropriate unit for obtaining nip with the photoconductor. The members as described in the conductive brush charging method and roller charging method are usable for this method.

The nip required for the contact with the photoconductor is preferably wide and it is approximately 3 mm to 10 mm in general and an even and uniform contact with the photoconductor is desirable.

The volume resistivity is preferably $10^2$ Ω·cm to $10^{10}$ Ω·cm and more preferably $10^8$ Ω·cm or less when various members as described above are used as charging members. As resistance increases, charge injection property is degraded. When the volume resistivity is too low, charge injection property is not affected, however, when there is a pinhole in the photoconductor, there is a risk of power source break or occurrence of horizontal black lines on the image. Since the electric potential for charging the photoconductor is approximately 500V to 900V in general, the risk of discharge breakdown is small and ozone generation would be very low if any, producing no significant impact from a practical standpoint.

Exposures may be performed by exposing the surface of the photoconductor imagewise using exposure devices, for example.

The exposure device is not particularly limited as long as it is capable of exposing the surface of photoconductor that has been charged by a charging device to form an image as expected, and may be selected accordingly. Examples thereof include various exposure devices such as copy optical system, rod lens array system, laser optical system, and liquid crystal shutter optical system, etc.

A backlight system may be employed in the present invention by which the photoconductor is exposed imagewise from the rear surface.

—Developing Step and Developing Unit—

The developing step is a step in which the latent electrostatic image is developed by using a toner and/or developer to form a visible image.

<Toner>

Manufacturing method or material of the toner is not particularly limited and may be selected from known methods and materials and examples of the method for manufacturing toner include pulverization classification, suspension polymerization, emulsification polymerization and polymer suspension, etc. in which oil phase is emulsified, suspended or aggregated in an aqueous medium to form toner-base particles such as the ones described in Journal of the Imaging Society of Japan Vol. 43, No. 1 (2004).

The pulverization is a process in which toner-base particles are produced by melt-blending, pulverizing and classifying toner materials. In the pulverization, the form of toner-base particles can be controlled by giving mechanical impact to make the toner spherical. The force of mechanical impact may be given to the toner-base particles for example, by means of apparatuses such as Hybritizer or Mechanofusion, etc.

In suspension polymerization process, colorant and releasing agent, etc. are dispersed in the oil-soluable polymerization initiator and polymerizable monomer and emulsified and dispersed in an aqueous medium containing surfactant and other solid dispersants by the emulsion process described later. After making into particles by polymerization reaction, wet treatment is performed by which inorganic particles are attached to the surface of toner particles. The wet treatment is preferably performed on the toner particles of which excess surfactant has been cleaned and eliminated.

Examples of polymerizable monomer include acids such as acrylic acid, methacrylic acid, α-cyanoacrylic acid, α-cyanomethacrylic acid, itaconic acid, crotonic acid, fumaric acid, maleic acid, maleic anhydride, or the like; acrylamide, methacrylamide, diacetone acrylamide, methyloyl compounds thereof, or the like; acrylate or methacrylate having amine group such as vinyl pyridine, vinyl pyrrolidine, vinyl imidazole, ethyleneimine, dimethylaminoethyl methacrylate, or the like. By using part of above monomers, functional groups may be introduced into the surface of toner particles.

Furthermore, by selecting dispersant having acid group or salt base group, the dispersant may be survived by absorbtion on the particle surface and the functional group may be introduced.

In emulsion polymerization, water-soluable polymerization initiator and polymerizable monomer are emulsified in water by using surfactant and latex is synthesized by normal emulsion polymerization process. Other dispersing element in which colorant and releasing agent, etc. are dispersed in an aqueous medium is prepared and the toner is produced by aggregating into a size of toner followed by heat-fusion after mixing. And then the wet treatment of inorganic particles described later is performed. The functional group may be introduced into the surface of toner particles by using same monomers that may be used as latex for suspension polymerization process.

Because of high selectivity of resin, high fixability at low temperatures, excellent property for granulation and easiness of controlling particle diameter, particle size distribution and form, the toner produced by emulsifying and/or dispersing solution and/or dispersion liquid of toner material in an aqueous medium is preferable.

The solution of toner material contains the toner material dissolved in a solvent and the dispersion liquid of toner material contains the toner material dispersed in a solvent.

The toner material contains at least an adhesive base material produced by reaction between an active hydrogen group-containing compound, a polymer reactive with the active hydrogen group-containing compound, binding resin, releasing agent and colorant, and further contains other components such as resin fine particles and charge controlling agent as necessary.

The adhesive base material may exhibit adhesiveness to a recording medium such as paper and contains at least an adhesive polymer produced by reaction of an active hydrogen group-containing compound with reactive polymer thereof in an aqueous medium and may also further contain binding resin selected from known binding resins.

The toner used for the present invention is provided with any one of positive charge or negative charge corresponding to positive or negative polarity of the photoconductor surface.

First, the toner of negative polarity will be described. The so-called polymerization toner produced by various polymerization methods such as suspension polymerization, emulsification polymerization and polymer suspension is suitably used. In particular, constituent material and manufacturing method of a toner produced by cross-linking and/or elongating toner composition containing polymer with a site reactive with at least an active hydrogen group-containing compound, polyester, colorant and releasing agent in an aqueous medium in the presence of resin fine particle will be explained in detail. However, the toner used for the present invention includes but not limited to the constituent material and the manufacturing method described below.

Polyester is obtained by polycondensation reaction between polyhydric alcohol compounds and polycarboxylic acid compounds.

The polyhydric alcohol compounds (PO) include dihydric alcohol (DIO) and trihydric alcohol (TO) having a valency of 3 or more and dihydric alcohol (DIO) alone or a mixture of dihydric alcohol (DIO) and a small amount of trihydric alcohol (TO) is preferable. Examples of dihydric alcohol (DIO) include alkylene glycol (ethylene glycol, 1,2-propylene glycol, 1,3-propylene glycol, 1,4-butanediol and 1,6-hexanediol, etc.); alkylene ether glycol (diethylene glycol, triethylene glycol, dipropylene glycol, polyethylene glycol, polypropylene glycol, polytetramethylene ether glycol, etc.); alicyclic diol(cyclohexane-1,4-dimethanol and hydrogenated bisphenol A, etc.); bisphenols (bisphenol A, bisphenol F and bisphenol S, etc.); alkylene oxide adduct of the above alicyclic diol (ethylene oxide, propylene oxide and butylene oxide, etc.) and alkylene oxide adduct of the above bisphenols (ethylene oxide, propylene oxide and butylene oxide, etc.) Of these examples, alkylene glycol having 2 to 12 carbon atoms and alkylene oxide adduct of bisphenols are preferable, and parallel use of alkylene oxide adduct of bisphenols and alkylene glycol having 2 to 12 carbon atoms is particularly preferable. Examples of trivalent or more polyhydric alcohol (TO) include trivalent or more polyhydric aliphatic alcohol having a valency of 3 to 8 or more (glycerin, trimethylol ethane, trimethylol propane, pentaerythritol, and sorbitol, etc.); trivalent or more phenols (trisphenol PA, phenol novolac and cresol novolac, etc.); and alkylene oxide adduct of the above trivalent or more polyphenols.

The polycarboxylic acid (PC) includes dicarboxylic acid (DIC) and trivalent or more polycarboxylic acid (TC), and dicarboxylic acid (DIC) alone and a mixture of dicarboxylic acid (DIC) and a small amount of trivalent or more polycarboxylic acid (TC) are preferable. Examples of dicarboxylic acid (DIC) include alkylene dicarboxylic acid (succinic acid, adipic acid and sebacic acid, etc.); alkenylene dicarboxylic acid (maleic acid and fumaric acid, etc.) and aromatic dicarboxylic acid (phthalic acid, isophthalic acid, terephthalic acid and naphthalene dicarboxylic acid, etc.) Among these examples, alkenylene dicarboxylic acid having 4 to 20 carbon atoms and aromatic dicarboxylic acid having 8 to 20 carbon atoms are preferable. Examples of trivalent or more polycarboxylic acid (TC) include aromatic polycarboxylic acid having 9 to 20 carbon atoms (trimellitic acid and pyromellitic acid, etc.). Meanwhile, the polycarboxylic acid (PC) may be reacted with polyhydric alcohol (PO) by using acid anhydride or lower alkylester (methylester, ethylester and isopropylester, etc.) of the above.

A ratio of polyhydric alcohol (PO) to polyhydric carboxylic acid (PC), defined as an equivalent ratio of hydroxyl group [OH] to carboxyl group [COOH], [OH]/[COOH] is 2/1 to 1/1 in general, and it is preferably 1.5/1 to 1/1 and more preferably 1.3/1 to 1.02/1.

A polyester having hydroxyl group is obtained by polymerization condensation of polyhydric alcohol (PO) and polyhydric carboxylic acid (PC) in which polyhydric alcohol (PO) and polyhydric carboxylic acid (PC) are heated to 150° C. to 280° C. in the presence of known esterification catalyst such as tetrabutoxytitanate and dibutyltinoxide, etc. and produced water is distilled away under reduced pressure accordingly. The hydroxyl value of the polyester is preferably 5 mgKOH/g or more and acid value of the polyester is generally 1 mgKOH/g to 30 mgKOH/g and preferably 5 mgKOH/g to 20 mgKOH/g. By having acid value, the polyester tends to be negatively charged and in addition, affinity between recording paper and toner is appropriate during fixing on the recording paper thereby improving fixing property at low temperatures. However, when the acid value is more than 30 mgKOH/g, charge stability, particularly against environmental change, is likely to be degraded.

Moreover, mass average molecular weight is 10,000 to 400,000 and preferably 20,000 to 200,000. When the mass average molecular weight is less than 10,000, offset resistance may be lowered and therefore, it is not appropriate. When it is more than 400,000, fixing property at low temperatures may be degraded and therefore, it is also not favorable.

The polyester preferably contains urea-modified polyester other than the unmodified polyester obtained by the above polymerization condensation reaction. The urea-modified polyester is obtained by producing a polyester prepolymer (A) having isocyanate group by reaction of carboxyl group or hydroxyl group of polyester ends obtained by the above polymerization condensation reaction with polyhydric isocyanate compound (PIC) and by cross-linking and/or elongating molecular chain by reaction with amines.

Examples of polyhydric isocyanate compound (PIC) include aliphatic polyhydric isocyanate (tetramethylene diisocyanate, hexamethylene diisocyanate and 2,6-diisocyanatemethyl caproate, etc.); alicyclic polyisocyanate (isophorone diisocyanate and cyclohexylmethane diisocyanate, etc.); aromatic diisocyanate (tolylene diisocyanate and diphenylmethane diisocyanate, etc.); aromatic aliphatic diisocyanate ($\alpha,\alpha,\alpha',\alpha'$-tetramethylxylylene diisocyanate, etc.); isocyanates; the above polyisocyanate blocked with phenol derivative, oxime and caprolactam, etc. and parallel use thereof.

A ratio of polyhydric isocyanate compound (PIC), which is defined as an equivalent ratio [NCO]/[OH] of isocyanate group [NCO] to hydroxyl group [OH] of the hydroxyl group-containing polyester, is generally 5/1 to 1/1 and it is preferably 4/1 to 1.2/1 and more preferably 2.5/1 to 1.5/1. When the ratio [NCO]/[OH] is more than 5, it is liable to degrade fixing property at low-temperatures. When the molar ratio of [NCO] is less than 1, it is liable to degrade offset resistance when urea-modified polyester is used because urea content in the ester is decreased.

The content of polyhydric isocyanate compound (PIC) in the polyester prepolymer (A) having an isocyanate group is generally 0.5% by mass to 40% by mass, preferably 1% by mass to 30% by mass and most preferably 2% mass to 20% by mass. When the content is less than 0.5% by mass, it is disadvantageous in terms of simultaneous pursuit of heat-resistant storage property and fixing property at low temperatures as well as degrading hot offset resistance. When the content is more than 40% by mass, it is liable to degrade fixing property at low temperatures.

The number of isocyanate groups contained in the polyester prepolymer (A) containing an isocyanate group is generally 1 or more per molecule, preferably 1.5 to 3 per molecule and more preferably 1.8 to 2.5 per molecule. When the number of isocyanate groups is less than 1 per molecule, the molecular mass of the urea-modified polyester becomes low which makes hot-offset resistance poor.

The amines (B) which react with polyester prepolymer (A) include divalent amine compound (B1), trivalent or more polyvalent amine compound (B2), aminoalcohol (B3), amino mercaptan (B4), amino acid (B5) and compounds in which the amino group of B1 to B5 are blocked (B6).

Examples of the divalent amine compound (B1) include aromatic diamine such as phenylene diamine, diethyl toluene diamine, 4,4'-diamino diphenyl methane; alicyclic diamine such as 4,4'-diamino-3,3'-dimethyl dicyclohexyl methane, diamine cyclohexane and isophorone diamine; and aliphatic diamine such as ethylene diamine, tetramethylene diamine and hexamethylene diamine.

Examples of the trivalent or more polyvalent amine compound (B2) include diethylene triamine, triethylene tetramine, and the like. Examples of the aminoalcohol (B3) include ethanol amine, hydroxyethylaniline, and the like. Examples of the amino mercaptan (B4) are aminoethyl mercaptan, aminopropyl mercaptan, and the like.

Examples of the amino acid (B5) include aminopropionic acid, aminocaproic acid, and the like. Examples of the compound in which the amino group of B1 to B5 is blocked (B6) include a ketimine compound obtained from the above-noted amines of B1 to B5 and ketones such as acetone, methyl ethyl ketone, and methyl isobutyl ketone and oxazolidine compound, etc. Of these amines (B), B1 and a mixture of B1 and a small amount of B2 are preferable.

A ratio of amines (B), which is defined as an equivalent ratio [NCO]/[NHx] of isocyanate group [NCO] in a polyester prepolymer (A) having isocyanate group to amine group [NHx] in amines (B), is generally 1/2 to 2/1, preferably 1.5/1 to 1/1.5 and more preferably 1.2/1 to 1/1.2. When [NCO]/[NHx] is more than 2 and less than 1/2, the molecular weight of the urea-modified polyester becomes low, thereby degrading hot-offset resistance.

In addition, the urea-modified polyester may include a urethane bond as well as a urea bond. A molar ratio of the urea bond content to the urethane bond content is generally 100/0 to 10/90, preferably 80/20 to 20/80 and more preferably 60/40 to 30/70. When a molar ratio of the urea bond is less than 10%, it is liable to degrade hot-offset resistance.

The urea-modified polyester is manufactured by one-shot method. A polyester having hydroxyl group is obtained by heating polyhydric alcohol (PO) and polyhydric carboxylic acid (PC) to 150° C. to 280° C. in the presence of known esterification catalyst such as tetrabutoxytitanate and dibutyltinoxide, etc. and distilling away the produced water under reduced pressure accordingly. Next, the polyester is reacted with polyhydric isocyanate (PIC) at 40° C. to 140° C. to obtain polyester prepolymer (A) having isocyanate group. Furthermore, the polyester prepolymer (A) is reacted with amines (B) at 0° C. to 140° C. to obtain urea-modified polyester.

Solvents may be used for reaction of polyhydric isocyanate (PIC) or reaction of polyester prepolymer (A) and amines (B) accordingly. Examples of usable solvents are the ones which are chemically stable with isocyanate (PIC) including aromatic solvents such as toluene and xylene, etc.; ketones such as acetone, methyl ethyl ketone and methyl isobutyl ketone, etc.; esters such as ethyl acetate; amides such as dimethylformamide and dimethylacetoamide, etc.; and ethers such as tetrahydrofran, etc.

A reaction stopper may be used for cross-linking and/or elongation reactions of the polyester prepolymer (A) and amines (B) as required for controlling the molecular weight of the urea-modified polyester to be obtained. Examples of the reaction stopper are a monoamine such as diethyl amine, dibutyl amine, buthyl amine and lauryl amine and a compound in which the above-noted elements are blocked such as ketimine compound, and the like.

The mass average molecular weight of urea-modified polyester is generally 10,000 or more, preferably 20,000 to 10,000,000 and more preferably 30,000 to 1,000,000. When it is less than 10,000, hot offset resistance may be degraded. When unmodified polyester is used, the number average molecular weight of urea-modified polyester, etc. is not particularly limited and may be the number average molecular weight with which the mass average molecular weight of the above range can be obtained. The number average molecular weight of the urea-modified polyester when it is used alone is generally 2,000 to 15,000, preferably 2,000 to 10,000 and more preferably 2,000 to 8,000. When it is more than 15,000, fixing property at low temperatures and glossiness may be degraded.

It is preferable to use unmodified polyester and urea-modified polyester simultaneously because fixing property at low temperatures and glossiness when used for full-color apparatus are improved more than when the urea-modified polyester is used alone. Meanwhile, unmodified polyester may contain polyesters modified by chemical bonds other than urea bonds.

It is preferable for the unmodified polyester and urea-modified polyester to be dissolved at least partially in terms of fixing property at low temperatures and hot offset resistance. Therefore, it is preferable that the composition of unmodified polyester and the composition of urea-modified polyester are closely similar to each other.

Furthermore, a mass ratio of unmodified polyester to urea-modified polyester is generally 20/80 to 95/5, preferably 70/30 to 95/5, more preferably 75/25 to 95/5 and most preferably 80/20 to 93/7. When the mass ratio of the urea-modified polyester is less than 5%, it may be disadvantageous for simultaneous pursuit of heat-resistant storage property and fixing property at low temperatures as well as degradation of hot offset resistance.

The glass transition temperature (Tg) of the binder resin containing unmodified polyester and urea-modified polyester is generally 45° C. to 65° C. and preferably 45° C. to 60° C. When it is less than 45° C., heat resistance of the toner may be degraded and when it is more than 65° C., fixing property at low temperatures may be deficient.

Moreover, since urea-modified polyester tends to exist on the surface of obtained toner base particles, heat-resistant storage property is likely to be appropriate as compared with known polyester-based toners even when the glass transition temperature is low.

All known dyes and colorants may be used as colorants and examples include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G and R), tartrazinelake, quinoline yellow lake, anthrasane yellow BGL, isoindolinon yellow, colcothar, red lead, lead vermilion, cadmium red, cadmium mercury red, antimony vermilion, permanent red 4R, para red, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone and mixtures thereof The content of the colorant is generally 1% by mass to 15% by mass and preferably 3% by mass to 10% by mass.

The colorant may be used as a master batch compounded with a resin. The binder resin used for manufacture of master batch (or the binder resin kneaded with master batch) include styrene or substituted polymer thereof such as polystyrene, poly (p-chlorostyrene) and polyvinyl toluene, copolymer thereof with vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylate resin, rosin, modified rosin, terpene resin, aliphatic hydrocarbon resin, alicyclic hydrocarbon resin, aromatic petroleum resin, chlorinated paraffin, paraffin wax, and the like. These can be used alone or in combination.

Known charge controlling agents may be used as a charge controlling agent and examples include nigrosine dye, triphenylmethane dye, chromium-containing metal complex dye, molybdic acid chelate pigment, rhodamine dye, alkoxy amine, quaternary ammonium salt such as fluoride-modified quaternary ammonium salt, alkylamide, phosphoric simple substance or compound thereof, tungsten simple substance or compound thereof, fluoride activator, salicylic acid metallic salt, salicylic acid derivative metallic salt, and the like. Specific examples thereof are Bontron 03 of nigrosine dye, Bontron P-51 of a quaternary ammonium salt, Bontron S-34 of metal-containing azo dye, Bontron E-82 of an oxynaphthoic acid metal complex, Bontron E-84 of a salicylic acid metal complex and Bontron E-89 of a phenol condensate (by Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative, and Copy Charge NEG VP2036 and Copy Charge NX VP434 of a quaternary ammonium salt (by Hoechst Ltd.); LRA-901, and LR-147 of a boron complex (by Japan Carlit Co., Ltd.), copper phthalocyanine, perylene, quinacridone, azo pigment and other high-molecular mass compounds having a functional group such as sulfonic acid group, carboxyl group and quaternary ammonium salt. Of these compounds, substances which control toner to have negative polarity is preferably used.

The used amount of the charge controlling agent is determined depending on the type of the binder resin, presence or absence of additive agents used accordingly and method for manufacturing toner including dispersing method and is not defined unambiguously and it is preferable to be used in the range of 0.1 parts by mass to 10 parts by mass relative to 100 parts by mass of binder resin. It is more preferably in the range of 0.2 parts by mass to 5 parts by mass. When it is more than 10 parts by mass, effect of charge controlling agent is weakened and electrostatic suction force to the developing roller is increased due to too much charging ability of the toner and may lead to degradation of flowability of developer or image density.

Waxes having low melting points of 50° C. to 120° C. work effectively between fixing roller and toner interface as releasing agents dispersed in the binder resin and exhibit effect on high-temperature offset without applying releasing agents such as oils to the fixing rollers. Such wax components include the following. Examples of waxes include vegetable wax such as carnauba wax, cotton wax, japan wax and rice wax, animal wax such as yellow beeswax and lanolin, mineral wax such as ozokerite and ceresin and petroleum wax such as paraffin, microcrystalline and petrolatum. And also included other than the above natural waxes are synthesized hydrocarbon wax such as Fischer-Tropsch wax and polyethylene wax and synthesized wax such as ester, keton and ether. In addition, aliphatic acid amide such as 12-hydroxy stearic acid amide, stearic acid amide, phthalic anhydride imide and chlorinated hydrocarbon, and crystalline polymers having alkyl group with long side chain such as polymer or copolymer (n-stearylacrylate-ethylmethacrylate copolymer, for example) of polyacrylate which is a low-molecular crystalline polymer resin such as poly (n-stearylmethacrylate) and poly (n-laurylmethacrylate) may also be used.

The charge controlling agent and releasing agent may be melt kneaded with master batch and binder resin or may be added when master batch and binder resin are dissolved and dispersed in organic solvents.

70% by number or more of the wax with low melting point contained in the toner is preferably in particle form having a dispersion diameter of 0.1 μm to 1 μm. When it is less than 70% by number and the particles having a dispersion diameter of less than 0.1 μm exceeds in number, it is difficult for the wax to be soaked out sufficiently at the time of fixing and offset occurs due to insufficient releasing ability during fixing. When it is less than 70% by number and the particles having a dispersion diameter of more than 1 μm exceeds in number, wax exists on the surface of the toner in large amount and photoconductor defects such as toner filming may occur.

In the present invention, appropriate airspaces are formed between toner particles and target object because of the fine particles with appropriate properties which exist on the surface of the toner. Moreover, fine particles are effective for improving developing and transferring efficiencies because contact area with toner particle, photoconductor and charge providing member is very small and uniform, thereby producing a large decreasing effect of adherence. In addition, wear and damage of photoconductors are prevented because fine particles also serve as rollers and they are unlikely to be buried in toner particles and separation and restoration are possible even when they are some what buried during cleaning in a high stress environment with cleaning blade and photoconductor (high load, high speed, etc.), thereby enabling to obtain stable properties for prolonged periods. Furthermore, fine particles are separated from the toner surface appropriately and accumulated on leading end of the cleaning blade and produce an effect of preventing phenomenon in which toner passes through the blade by so-called damming effect. Since these properties have an effect of decreasing shear received by toner particles, an effect of decreasing filming of the toner itself caused by high-speed fixing (low-energy fixing) is produced due to low rheologic components contained in the toner. In addition, particle flowability of the toner is not degraded when fine particles having an average primary particle diameter of 50 μm to 500 μm are used because they are of extremely small particle diameter and excellent cleaning ability can be exhibited sufficiently. Furthermore, even though the detail is not clear, even when surface-processed fine particles are externally added to the toner and if the carrier is contaminated, degree of degradation of the developer is small.

The average primary particle diameter (hereinafter, may be referred to as "average particle diameter") of the fine particle used is generally 50 nm to 500 nm and preferably 100 nm to 400 nm in particular. When it is less than 50 nm, fine particles are buried in concaved areas of the toner surface and roller function may be degraded. When it is more than 500 nm and contact area of the fine particle becomes equivalent to that of the toner particle itself, toner particle which should be cleaned is allowed to pass through, thereby causing cleaning defects when the fine particle exists between the blade and the photoconductor surface.

When bulk density is less than 0.3 mg/cm$^3$, even though flowability is improved, roller function or so-called damming effect by which cleaning defects of toner is prevented by accumulation in cleaning part is degraded due to increased dispersal ability and adhesiveness of the toner and fine particle.

Examples of the fine particle include inorganic compounds such as $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$ and $SrTiO_3$ and preferred examples include $SiO_2$, $TiO_2$ and $Al_2O_3$. These inorganic compounds may be hydrophobized with various coupling agents, hexamethyldisilazane, dimethyldichlorosilane and octyltrimethoxysilane.

Organic fine particle may be thermoplastic resin or heat-curable resin and examples include vinyl resin, polyurethane resin, epoxy resin, polyester resin, polyamide resin, polyimide resin, silicon resin, phenol resin, melamine resin, urea resin, aniline resin, ionomer resin and polycarbonate resin. The above resins may be used in combination as resin fine particles. Of these resins, vinyl resin, polyurethane resin, epoxy resin and polyester resin and parallel use thereof are preferable because aqueous dispersion element of microscopic spherical resin particles is easily obtained.

Specific examples of vinyl resin include homopolymer or copolymer of vinyl monomers such as styrene-(meth)acrylic acid ester copolymer, styrene-butadiane copolymer, (meth) acrylic acid-acrylic acid ester copolymer, styrene-acrylonitrile copolymer, styrene-maleic anhydride copolymer and styrene-(meth)acrylaic acid copolymer.

The method for externally adding and attaching fine particles on toner surfaces include a method in which toner base particle and fine particle are mechanically mixed and attached by using various known mixing equipments and a method in which toner base particle and fine particle are uniformly dispersed in a liquid phase with surfactants, etc. and dried after attachment.

The average degree of circularity of the toner of the present invention is preferably 0.93 to 0.99. The degree of circularity in the present invention is defined as the value obtained by Equation (3). The degree of circularity is an indicator of irregurity level of toner particles and when the toner is in complete spherical form, the value is 1.00 and the degree of circularity becomes smaller as the surface profile becomes rough.

$$\text{Degree of Circularity } a = L_0/L \qquad \text{Equation (3)}$$

In Equation (3), "$L_0$" represents a peripheral length of the circle which has the same projected area as the particle image and "L" represents a peripheral length of the projected image of the particle.

When the degree of circularity is within the range of 0.93 to 0.99, transfer property is appropriate because surface of the toner particle is smooth and contact area between toner particles and between toner particles and photoconductor are small. Since the toner particle is not angulated, stirring torque of the developer in the developing device is small and stirring drive is stabilized, abnormal images do not occur.

Since there is no angular toner particle in the toner which forms dots and the pressure applied to the transfer medium during transferring is uniformly applied to the entire toner which forms dots, voids during transferring hardly occur and high-resolution images can be obtained.

Since the toner particles are not angular, grinding force of the toner particle itself is small and surfaces of the photoconductor and charging member, etc. are not damaged or worn away.

The measurement method of the degree of circularity will be explained below.

The degree of circularity can be measured by means of a flow type particle image analyzer, FPIA-1000 by Sysmex Corporation.

Specifically, the measurement is performed by adding 0.1 ml to 0.5 ml of a surfactant, preferably alkylbenzene sulfonate as a dispersing agent to 100 ml to 150 ml of water in a container from which solid impurities has been removed in advance, and 0.1 g to 0.5 g of measurement sample is then added. The suspension liquid in which the sample is dispersed is subject to dispersion treatment for approximately 1 minute to 3 minutes using an ultrasonic disperser until dispersion concentration becomes 3,000/μl to 10,000/μl and the toner shapes are measured by using the above apparatus.

Next, manufacturing method of the toner will be explained. The preferred manufacturing method will be described, however, the method is not limited to the ones below.

(1) A toner material liquid is produced by dispersing colorant, unmodified polyester, polyester prepolymer having isocyanate group and releasing agent in an organic solvent.

Volatile organic solvents having boiling points of less than 100° C. are preferable because removal after forming toner base particle is easy. Specific examples include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. Among these solvents, aromatic solvents such as toluene and xylene, halogenated hydrocarbons such as methylene chloride, 1,2-dichloroethane, chloroform and carbon tetrachloride are preferable. The used amount of the organic solvents is generally 0 parts by mass to 300 parts by mass, preferably 0 parts by mass to 100 parts by mass and more preferably 25 parts by mass to 70 parts by mass relative to 100 parts by mass of polyester prepolymer.

(2) The toner material liquid is emulsified in an aqueous medium in the presence of surfactant and resin fine particle.

The aqueous medium may be water alone, or may contain organic solvents such as alcohol (methanol, isopropyl alcohol and ethylene glycol, etc.), dimethylformamide, tetrahydrofuran, cellsolves (methylcellsolve, etc.) and lower ketones (acetone and methyl ethyl ketone, etc.).

The used amount of the aqueous medium is generally 50 parts by mass to 2,000 parts by mass and preferably 100 parts by mass to 1,000 parts by mass relative to 100 parts by mass of toner material liquid. When it is less than 50 parts by mass, dispersion state of the toner material liquid is not appropriate and toner particles of predetermined particle diameter may not be obtained. When it is more than 2,000 parts by mass, it is not economical.

The dispersing agents such as surfactants and resin fine particles are appropriately added in order to improve dispersion in the aqueous medium.

Examples of surfactant include anionic surfactants such as alkylbenzene sulfonic acid salts, α-olefin sulfonic acid salts and phosphoric acid ester, cationic surfactants of amine salt type such as alkyl amine salt, aminoalcohol fatty acid derivative, polyamine fatty acid derivative and imidazoline or cationic surfactants of quaternary ammonium salt type such as alkyltrimethyl ammonium salt, dialkyldimethyl ammonium salt, alkyldimethyl benzyl ammonium salt, pyridinium salt, alkyl isoquinolinium salt and benzethonium chloride, nonionic surfactant such as fatty acid amide derivative and polyhydric alcohol derivative and ampholytic surfactant such as alanine, dodecyldi(aminoethyl)glycin, di(octylaminoethyl) glycin, N-alkyl-N and N-dimethylammonium betaine.

Moreover, the effect can be improved by using surfactants having fluoroalkyl group in very small amount. Examples of anionic surfactant having fluoroalkyl group include fluoroalkyl carboxylic acid having 2 to 10 carbon atoms or metal salt thereof, disodium perfluorooctanesulfonylglutamate, sodium-3-[ω-fluoroalkyl(Carbon number 6 to 11)oxy]-1-alkyl(Carbon number 3 to 4)sulfonate, sodium-3-[ω-fluoroalkanoyl(Carbon number 6 to 8)-N-ethylamino]-1-propanesulfonate, fluoroalkyl(Carbon number 11 to 20)carboxylic acid or metal salt thereof, perfluoroalkyl carboxylic acid (Carbon number 7 to 13) or metal salt thereof, perfluoroalkyl (Carbon number 4 to 12)sulfonic acid or metal salt thereof, perfluorooctanesulfonic acid diethanol amide, N-propyl-N-(2-hydroxyethyl)perfluorooctane sulfone amide, perfluoroalkyl(Carbon number 6 to 10)sulfoneamidepropyltrimethylammonium salt, perfluoroalkyl(Carbon number 6 to 10)-N-ethylsulfonyl glycin salt and monoperfluoroalkyl(Carbon number 6 to 16)ethylphosphate ester.

Examples of commercially available surfactant containing fluoroalkyl group are: Surflon S-111, S-112 and S-113 by Asahi Glass Co.; Frorard FC-93, FC-95, FC-98 and FC-129 by Sumitomo 3M Ltd.; Unidyne DS-101 and DS-102 by Daikin Industries, Ltd.; Megafack F-110, F-120, F-113, F-191, F-812 and F-833 by Dainippon Ink and Chemicals, Inc.; ECTOP EF-102, 103, 104, 105, 112, 123A, 123B, 306A, 501, 201 and 204 by Tohchem Products Co.; and Futargent F-100 and F150 by Neos Co.

Examples of cationic surfactant include primary, secondary or tertiary aliphatic amine acid having a fluoroalkyl group, aliphatic quaternary ammonium salt such as perfluoroalkyl ($C_6$ to $C_{10}$)sulfoneamidepropyltrimethylammonium salt, benzalkonium salt, benzetonium chloride, pyridinium salt and imidazolinium salt. Specific examples of the commercially available product thereof are Surflon S-121 (by Asahi Glass Co.), Frorard FC-135 (by Sumitomo 3M Ltd.), Unidyne DS-202 (by Daikin Industries, Ltd.), Megafack F-150 and F-824 (by Dainippon Ink and Chemicals, Inc.), Ectop EF-132 (by Tohchem Products Co.) and Futargent F-300 (by Neos Co.).

Resin particles are added to stabilize the toner base particle formed in an aqueous medium. The resin particles are preferably added so that the coverage on the surface of the toner base particle is in the range of 10% to 90%. Examples include polymethylmethacrylate particle of 1 μm and 3 μm, polystyrene particle of 0.5 μm and 2 μm and styrene-acrylonitrile copolymer particle of 1 μm, and examples of commercialized product include PB-200H by Kao Corp., SGP by Soken Chemical & Engineering Co., Ltd., Technopolymer SB by Sekisui Plastics Co., Ltd., SGP-3G by Soken Chemical & Engineering Co., Ltd. and Micropearl by Sekisui Chemical Co., Ltd.

Furthermore, inorganic dispersing agents such as tricalcium phosphate, calcium carbonate, titanium oxide, colloidal silica and hydroxyl apatite may be used.

A polymer protective colloid may be used to stabilize dispersion droplet as a dispersing agent which can be used with the above resin particles and inorganic dispersing agent. Examples include acids such as acrylic acid, methacrylic acid, α-cyanoacrylic acid, α-cyanomethacrylic acid, itaconic acid, crotonic acid, fumaric acid, maleic acid or maleic anhydride or (meth)acrylic monomer containing hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylate, glycerin monoacrylate, glycerin monomethacrylate, N-methylol acrylamide and N-methylol methacrylamide, vinyl alcohol or ethers of vinyl alcohols such as vinylmethylether, vinylethylether and vinylpropylether, esters of compounds containing vinyl alcohol and carboxyl group such as vinyl acetate, vinyl propionate, vinyl butyrate, acrylamide, methacrylamide, diacetoneacrylamide or methylol compound thereof, acid chlorides such as acrylic acid chloride and methacrylic acid chloride, homopolymer or copolymer of nitrogen-containing compounds such as vinyl pyridine, vinyl pyrolidone, vinyl imidazole and ethyleneimine or heterocyclic nitrogen-containing compounds, polyoxyethylenes such as polyoxyethylene, polyoxypropylene, polyoxyethylenealkylamine, polyoxypropylenealkylamine, polyoxyethylenealkylamide, polyoxypropylenealkylamide, polyoxyethylene nonylphenylether, polyoxyethylene laurylphenylether, polyoxyethylene stearylphenylester and polyoxyethylenenonyl phenyl ester, celluloses such as methylcellulose, hydroxyethylcellulose and hydroxypropylcellulose.

The dispersing method is not particularly limited and known dispersers such as low-speed-shear disperser, high-speed-shear disperser, friction disperser, high-pressure-jet disperser and supersonic disperser may be used. Of these, high-speed-shear disperser is preferable because it is capable of controlling particle diameter of the dispersing element to be within the range of 2 μm to 20 μm. When a high-speed-shear disperser is used, the rotating frequency is not particularly limited and it is generally 1,000 rpm to 30,000 rpm and preferably 5,000 rpm to 20,000 rpm. The dispersing time is not particularly limited and it is generally 0.1 minute to 5 minutes for batch method. The dispersion temperature is generally 0° C. to 150° C. with applied pressure and preferably 40° C. to 98° C.

(3) Amines (B) are added simultaneously with preparation of emulsified liquid to react with isocyanate group-containing polyester prepolymer (A).

The reaction is associated with cross-linking and/or elongating molecular chain. The reaction time is selected depending on reactivity of the isocyanate group structure contained in the polyester prepolymer (A) with amines (B) and it is generally 10 minutes to 40 hours and preferably 2 hours to 24 hours. The reaction temperature is generally 0° C. to 150° C. and preferably 40° C. to 98° C. In addition, known catalyst may be used as necessary. Specific examples include dibutyltin laurate and dioctyltin laurate.

(4) After reaction is completed, organic solvent is removed from emulsified dispersion element (reaction product), washed and dried to obtain toner base particle.

Spindle-shaped toner base particle can be produced by gradually raising the temperature of the whole system by stirring in a condition of laminar flow and removing solvent after stirring intensely at a predetermined temperature region. Moreover, when dispersion stabilizers which can be dissolved in acids or alkalies such as calcium salt of phosphoric acid are used, calcium salt of phosphoric acid is removed from the toner base particle by methods such as water washing after calcium salt of phosphoric acid is dissolved in acids such as hydrochloric acid. Or calcium salt of phosphoric acid can be removed by methods such as decomposition by oxygen.

(5) The charge controlling agent is added to the obtained toner base particle and inorganic particles such as silica particle and titanium oxide particle are externally added to obtain a toner.

Addition of charge controlling agent and external addition of inorganic particles are performed by known methods by using mixers, etc.

Through the procedures above, toners having small particle diameter and sharp particle diameter distribution can be obtained easily. Furthermore, shape of the toners can be controlled from spherical shape to rugby ball shape by stirring intensely in removal step of organic solvent and morphology of the surface can be further controlled from being smooth to wrinkled surface.

The toner of positive polarity will be described. The same manufacturing method for the toner of negative polarity as described above may be used for manufacturing of the toner of positive polarity. The above known constituent material such as binding resin, colorant, releasing agent and charge controlling agent capable of providing positive polarity to the toner are used. Moreover, even when known constituent materials which tend to be negatively charged are used, the polarity can be controlled by the charge controlling agent which is capable of providing positive polarity to the toner.

The mass average particle diameter of the toner is preferably 3 μm to 8 μm and more preferably 3 μm to 6 μm. When the mass average particle diameter is less than 3 μm, the ratio of the fine powder toner having a particle diameter of 1 μm or less which tends to cause image defects may be increased and when it is more than 8 μm, it may be difficult to respond to demand for higher quality of the electrophotographic image.

The ratio of the mass average particle diameter of the toner to the number average particle diameter of the toner is preferably 1.00 to 1.40.

The mass average particle diameter may be measured by using a particle size measurer, "Coulter Counter TAII" by Beckman Coulter K. K.

(Developer)

The developer contains at least a toner and contains other elements such as carriers selected accordingly. The developer may be single component developer or two-component developer and it is preferably the two-component developer in terms of improving duration of life when the developer is used for high-speed printers which correspond to recent improvement of information processing speed.

In the case of single component developer using the toner, even if addition and reduction of the toner take place, it has less fluctuation in particle diameter of the toner, has no toner filming on the development roller and fusion of the toner to the members such as blade for thinning of the toner and development property and images which are appropriate and stable even for long-term use (stirring) of the developing device can be obtained. Moreover, in the case of the two-component developer using the toner, even if addition and reduction of the toner take place, it has less fluctuation in particle diameter of the toner in the developer, and development property which is appropriate and stable even for long-term stirring in the developing device can be obtained.

The carrier is not particularly limited and may be selected accordingly and it is preferably the carrier having core material and resin layer applied to the core material.

The material of the core material is not particularly limited and may be selected from known core materials. For example, it is preferably manganese-strontium (Mn—Sr) material of 50 emu/g to 90 emu/g and manganese-magnesium (Mn—Mg) material and preferably high magnetization material such as iron powder (100 emu/g or more) and magnetite (75 emu/g to 120 emu/g) in terms of ensuring image density. Moreover, it is preferably a low magnetization material such as copper-zinc (Cu—Zn) of 30 emu/g to 80 emu/g because the impact toward the image bearing member, in which the toner is being a magnetic brush can be softened and it is advantageous for higher image quality. These may be used alone or in combination.

The volume average particle diameter ($D_{50}$) of the core material is preferably 10 μm to 200 μm and more preferably 40 μm to 100 μm.

The material of the resin layer is not particularly limited and may be selected from known resins accordingly. Examples include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoroterpolymer such as terpolymer of tetrafluoroethylene, vinylidene fluoride and non-fluoro monomer and silicone resin. These may be used alone or in combination.

The resin layer may contain conductive powder as necessary and examples of the conductive powder include metal powder, carbon black, titanium oxide, tin oxide, zinc oxide, and the like. The average particle diameter of these conductive powders is preferably 1 μm or less. If the average particle diameter is more than 1 μm, it may be difficult to control electrical resistance.

The resin layer may be formed by uniformly coating the surface of the core material with a coating solution, which is prepared by dissolving silicone resins, etc. in a solvent, by known coating method, and baking after drying. The examples of the coating method include dipping, spraying and brushing.

The solvent is not particularly limited and may be selected accordingly and examples include toluene, xylene, methyl ethyl ketone, methyl isobutyl ketone, cellosolve and butyl acetate.

The baking is not particularly limited and may be external heating or internal heating and examples include methods using fixed electric furnace, fluid electric furnace, rotary electric furnace, burner furnace and methods using microwaves.

The amount of the resin layers in the carrier is preferably 0.01% by mass to 5.0% by mass.

When the amount is less than 0.01% by mass, the resin layer may not be formed uniformly on the surface of the core material and when the amount is more than 5.0% by mass, the resin layer becomes too thick and granulation between carriers occur and uniform carrier particles may not be obtained.

If the developer is a two-component developer, the carrier content in the two-component developer is not particularly limited and may be selected accordingly and it is preferably 90% by mass to 98% by mass and more preferably 93% by mass to 97% by mass, for example.

With regard to the mixing ratio of toner and carrier of the two-component developer, the toner is 1 part by mass to 10.0 parts by mass relative to 100 parts by mass of the carrier in general.

The visible image can be formed by developing the latent electrostatic image using the toner and/or developer by means of the developing unit.

The developing unit is not particularly limited and may be selected from known developing unit accordingly as long as it is capable of developing using the toner and/or the developer. Preferred examples include a developing unit containing the toner and/or the developer and having at least developing equipment which can provide the toner and/or the developer to the latent electrostatic image by contact or without contact. The developing device which is equipped with the toner container of the present invention is preferable.

The developing device may be of dry development type or wet development type and may be developing device for single color or multicolor and preferred examples include developing device which has a stirrer which charges the toner and/or developer by friction stirring, and rotatable magnet roller.

In the developing device, the toner and the carrier are stir mixed to charge the toner with the friction and retain the toner in a condition of magnetic brush on the surface of rotating magnet roller. Since the magnet roller is positioned near the image bearing member, part of the toner constructing the magnetic brush formed on the surface of the magnet roller moves to the surface of the image bearing member by electric attraction. As a result, the latent electrostatic image is developed by the toner to form a visible image by the toner on the surface of the image bearing member.

The developer contained in the developing device is the developer containing the toner and may be single component developer or two-component developer.

—Transferring and Transfer Unit—

The transferring is a step to transfer the visible image to a recording medium and it is preferably an embodiment using intermediate transfer member in which a visible image is transferred primarily on the intermediate transfer member and then the visible image is transferred secondarily to the recording medium. And it is more preferably an embodiment using the toner of two or more colors or preferably full-color toner and containing a primary transferring step in which a visible image is transferred to the intermediate transfer member to form a compound transfer image and a secondary transferring step in which the compound transfer image is transferred to a recording medium.

The transferring of the visible image may be performed by charging the image bearing member by means of the transfer charging device and the transfer unit. The preferred embodiment of the transfer unit contains primary transfer unit in which a visible image is transferred to the intermediate transfer member to form a compound transfer image and secondary transfer unit in which the compound transfer image is transferred to a recording medium.

The intermediate transfer member is not particularly limited and may be selected from known transfer member accordingly and examples include transfer belt, etc.

The transfer unit (the primary transfer unit and the secondary transfer unit) preferably contains a transfer equipment which is configured to charge so as to separate and transfer the visible image formed on the image bearing member to a recording medium. There may be only one transfer unit or may be two or more transfer units are used. Examples of the transfer equipment are corona transfer equipment utilizing corona discharge, transfer belt, transfer roller, pressure-transfer roller, adhesion-transfer equipment, and the like.

The typical recording medium is a regular paper, and it is not particularly limited and may be selected accordingly as long as it is capable of receiving transferred, unfixed image after developing and PET bases for OHP may also be used.

The fixing is a step of fixing the visible image transferred to a recording medium using a fixing apparatus. The fixing step can be performed for toner of each color transferred to the recording medium, or in one operation when the toners of each color have been layered.

The fixing apparatus is not particularly limited and may be appropriately selected in accordance with a purpose. However, conventional heating and pressurizing units are preferable, for example. The heating and pressurizing units include a combination of a heating roller and a pressurizing roller and a combination of a heating roller, a pressurizing roller, and an endless belt, and the like.

In general, the heating and pressurizing units preferably provide heating to 80° C. to 200° C.

In the present invention, for example, a conventional photo-fixing device can be used along with or in place of the fixing step and fixing unit.

The charge removing is a step of applying a discharging bias to the charged image bearing member so as to remove the charge. This is suitably performed by the charge removing unit.

The charge removing unit is not particularly limited, provided that discharging bias is applied to the charged image bearing member to thereby remove the charge, and can be appropriately selected from the conventional charge removing units in accordance with a purpose. A suitable example thereof is a charge removing lamp.

The cleaning is a step to remove the residual electrophotographic toner on the image bearing member. This is suitably performed by means of a cleaning unit which will be described later.

The cleaning unit is not particularly limited provided that the residual toner on the image bearing member is removed and at least cleaning blade is used in the image forming apparatus of the present invention.

Because the cleaning apparatus contains a brush with a loop-shaped leading end which is in contact with the photoconductor, the leading end of the brush which is in contact with the photoconductor is in point contact, and even when a thick and firm brush material is used, it is possible to effectively remove the foreign material such as residual toner after transferring or paper dust without giving damage to the photoconductor surface.

Moreover, even when a brush is made firm by turning the loop-shaped leading end side of the brush to upstream side of the rotation direction of the brush from base side, the contact of the brush with the photoconductor is soft, rotary torque is reduced to thereby conserving driving force.

Furthermore, because removal capability of foreign material is improved by using the loop-shaped brush, even when the rotating direction of the brush is in the same direction of the rotating direction of the photoconductor in contact area, the brush exhibits sufficient cleaning ability. And even when a foreign material of high hardness which would give damage to the photoconductor is mixed inside of the brush, the possibility of the damage on the photoconductor is reduced because the foreign material does not have much contact with the photoconductor and in addition, even when a brush is firm, the contact of the brush with the photoconductor is soft, rotary torque is reduced to thereby conserving driving force.

Moreover, more effective cleaning is possible because the brush contains an elastic rubber blade which is in contact with the photoconductor on downstream side of the rotating direction of the photoconductor and more suitable cleaning is possible because the direction of the contact is in the counter direction of the rotating direction of the photoconductor. In addition, sufficient cleaning is possible while suppressing abnormal wear of the photoconductor in the image forming apparatus by setting the contact pressure of the elastic rubber blade with the photoconductor to 10 g/cm to 30 g/cm.

When the contact pressure is in the above range, the most excellent removal capability of the residual toner after transferring is exhibited without giving damages to the photoconductor when a foreign material is attached and it was determined from the results of a lot of examination.

When the contact pressure is too small, the next image forming step starts before the residual toner after transferring is completely removed and this may lead to abnormal images. When the contact pressure is too large, wear of the photoconductor due to repetitive use may be accelerated.

Figure 15:
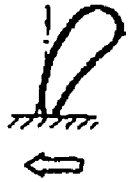
FIG. 15 is an enlarged diagram showing a configuration of the brush end.
Figure 16:
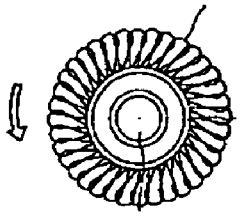
FIG. 16 is a schematic cross-sectional diagram of a rotational brush.

The cleaning device used for the present invention has a brush with a loop-shaped leading end which is in contact with the photoconductor as shown in FIG. 15 and it is characterized by the loop-shaped leading end side of the brush which is turned to upstream side of the rotation direction of the brush from base side. FIG. 15 is an enlarged view showing the shape of the brush end and FIG. 16 is a cross-section diagram of the rotating brush and the arrow in FIG. 16 represents a rotating direction.

The material of brush is not particularly limited and general material may be used. Examples include nylon, polyester, rayon, polycarbonate, methacrylic resin and acrylic resin and these resins may be used alone or in combination. The brush fiber may be made conductive.

The method for making brush fiber conductive includes a general method in which fiber surface is coated with metal by plating, vacuum deposition or sputtering, a method in which conductive particle dispersion polymer such as carbon and metal is dispersed on the fiber surface to form an organic layer and a method in which the conductive particle dispersion polymer is blended or spinned into a multicore composition.

The width of brush fiber is generally 5 to 30 (denier/filament). The loop density of the loop-shaped brush is preferably 50 loops to 100 loops per 1 $cm^2$ for appropriate cleaning ability and durability.

Figure 17:
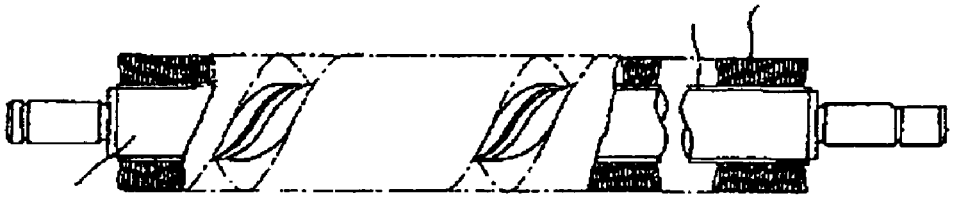
FIG. 17 is a schematic diagram showing an exemplary cleaning brush.

The appropriate loop length of the brush is 2 mm to 10 mm. An exemplary cleaning brush as shown in FIG. 17 is formed by winding and attaching a loop pile brush, which is made of loop-shaped brush woven into a foundation cloth, to the metal cored bar.

The material of elastic rubber blade of the brush, which is disposed so as to be in contact with the photoconductor on downstream side in a rotating direction of the photoconductor, may be elastic bodies of wide range including commonly used silicon rubber and urethane rubber. The thickness of the blade is not particularly limited and it is preferably approximately 1 mm to 7 mm. The contact pressure with the photoconductor is preferably in the range of 10 g/m to 30 g/m for the reason as described above. Furthermore, the contact direction of the elastic rubber blade with the photoconductor is preferably in the counter direction of the rotating direction of the photoconductor.

The recycling is a step of recycling the toner for electrophotography collected in the cleaning step to the developing unit. This is suitably performed by means of a recycling unit.

The recycling unit is not particularly limited, and may be appropriately selected from the conventional conveyance units.

The controlling is a step of controlling each of the aforementioned steps. This is suitably performed by means of a control unit.

The control unit is not particularly limited, provided that each of the aforementioned units or members is controlled, and can be appropriately selected in accordance with a purpose. Examples thereof are devices such a sequencer, a computer, and the like.

The image forming apparatus used in the present invention will be explained referring to figures. The latent electrostatic image bearing member is the latent electrostatic image bearing member which satisfies the requirement of the present invention.

Figure 3:
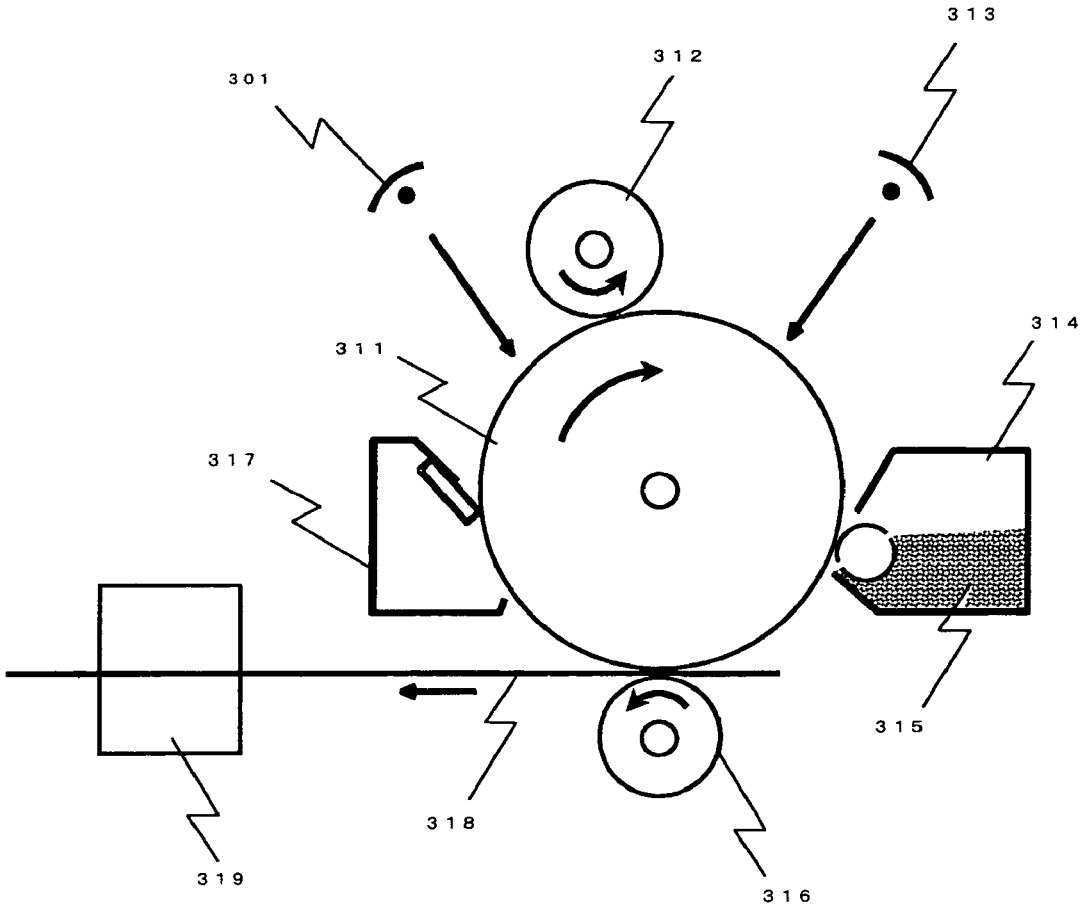
FIG. 3 is a schematic diagram showing an exemplary image forming apparatus of the present invention.

FIG. 3 is a schematic diagram for explaining an exemplary image forming apparatus of the present invention and a deformed example which will be described later also belongs to the category of the present invention.

A latent electrostatic image bearing member (photoconductor) 311 as shown in FIG. 3 is a latent electrostatic image bearing member which satisfies the requirement of the present invention.

Although the photoconductor 311 is drum-shaped, the photoconductor may be in sheet form or endless belt form.

The known charging unit such as corotron, scorotron, solid state charger and charging roller may be employed as a charging unit 312.

The above charging device may be used in general as a transfer unit 316 and parallel use of transfer charger and separation charger is effective.

No. 313 indicates an exposing unit and laser diode (LD) or light-emitting diode (LED) may be used. Depending on circumstances, various filters such as sharp cut filter, band pass filter, near-infrared ray cut filter, dichroic filter, interference filter and color conversion filter may also be used in order to irradiate light of predetermined wavelength.

No. 301 indicates a charge removing unit and it is used according to necessity. Examples of light source include light-emitting materials in general such as fluorescent lamp, tangsten lamp, halogen lamp, mercury lamp, sodium lamp, light-emitting diode (LED), laser diode (LD) and electroluminescence (EL).

The toner 315 developed on the photoconductor by means of the developing unit 314 is transferred to a recording medium 318, however, not all the toner is transferred and there are remains of the toner on the photoconductor. Such toner is removed from the photoconductor by means of a cleaning unit 317. The brushes such as cleaning blade made of rubber, fir brush and magnetic fir brush may be used as the cleaning unit.

When an image is exposed on a positively (negatively) charged electrophotographic photoconductor, a positive (negative) latent electrostatic image is formed on the photoconductor surface. If the image is developed by using a negatively (positively) charged toner (detecting particle), a positive image can be obtained and if it is developed with positively (negatively) charged toner, a negative image can be obtained. The known methods are used for the developing unit and charge removing unit.

Figure 4:
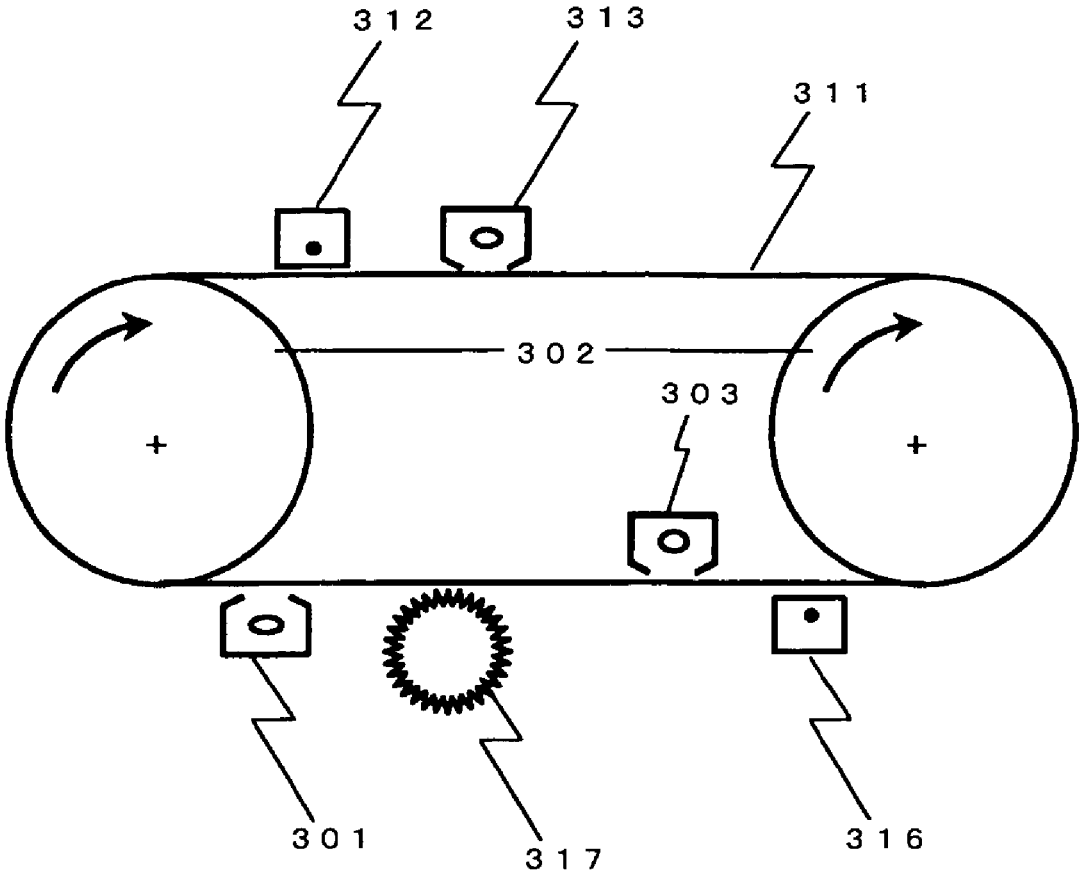
FIG. 4 is a schematic diagram showing another exemplary image forming apparatus of the present invention.
Figure 5:
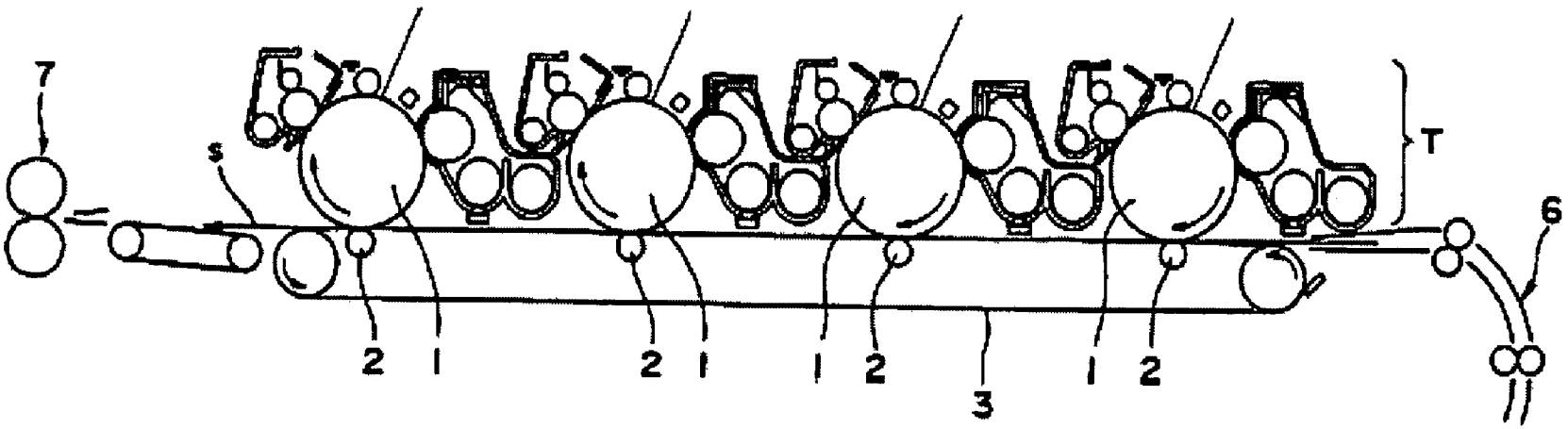
FIG. 5 is a diagram partially showing an example of the tandem-type image forming apparatus of the present invention.

FIG. 4 shows another exemplary image forming apparatus of the present invention. In FIG. 4, a photoconductor 311 is an electrophotographic photoconductor in endless belt form which satisfies the requirement of the present invention.

The image forming apparatus is activated by a driving unit 302 and charging by means of a charging unit 312, image exposure by means of an exposing unit 313, developing (not shown), transfer by means of a transfer unit 316, exposing before cleaning by means of an exposure before cleaning unit 303, cleaning by means of a cleaning unit 317 and charge removing by means of a charge removing unit 301 are performed repeatedly. In FIG. 4, light irradiation for exposing before cleaning is performed from the support side of the photoconductor (the support in this case has translucency).

In the exposing unit 313 as shown in FIG. 4, laser diode (LD) or light-emitting diode (LED) may be used as a light source. Depending on circumstances, various filters such as sharp cut filter, band pass filter, near-infrared ray cut filter, dichroic filter, interference filter and color conversion filter may also be used in order to irradiate light of predetermined wavelength.

The image forming apparatus as described above exemplifies the embodiment of the present invention and other embodiment is also possible. For example, exposure before cleaning is performed from the support side in FIG. 4, however, this can be performed from the photosensitive layer side and also, irradiation for image exposure and charge removal can be performed from the support side. The light irradiation steps such as image exposure, exposure before cleaning and charge removing exposure are shown in figures, however, other known light irradiation steps such as exposure before transfer, pre-exposure of image exposure may be performed to the photoconductor.

Figure 18:
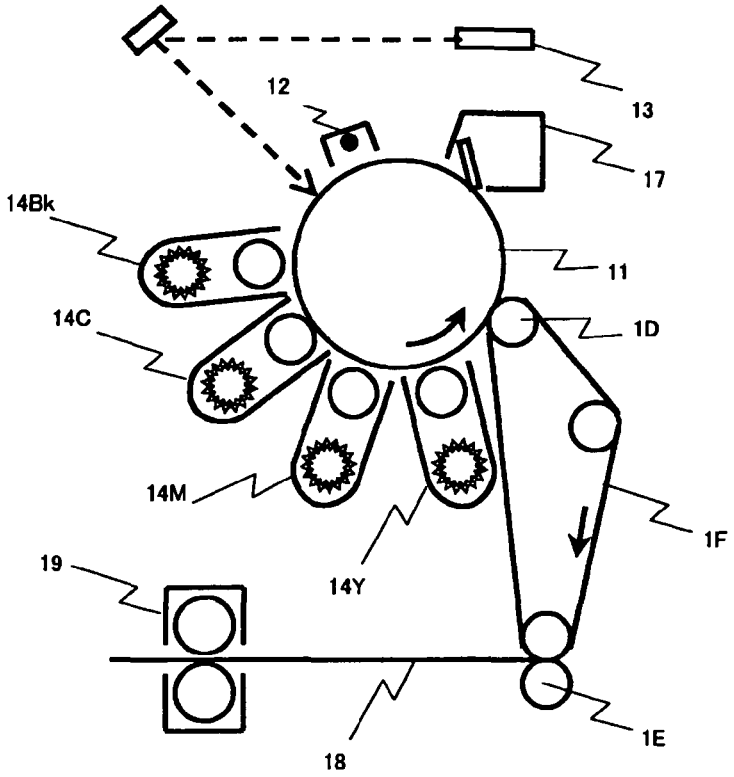
FIG. 18 is a schematic diagram showing another example of the image forming apparatus of the present invention.

Another exemplary electrophotographic image forming apparatus of the present invention is shown in FIG. 18.

In the image forming apparatus, a charging unit 12, an exposing unit 13, developing units 14Bk, 14C, 14M and 14Y of each toner of black (Bk), cyan (C), magenta (M) and yellow (Y), an intermediate transfer belt 1F as an intermediate transfer member and a cleaning unit 17 are arranged sequentially around the photoconductor 11. The characters Bk, C, M and Y in FIG. 18 correspond to the color of the toner and characters are added or omitted accordingly.

The photoconductor 11 is an electrophotographic photoconductor which satisfies the requirement of the present invention.

The developing units of each color, 14Bk, 14C, 14M and 14Y can be controlled independently and developing unit of the color used for image forming is only activated. The toner image formed on the photoconductor 11 is transferred to the intermediate transfer belt 1F by means of the first transfer unit 1D located inside of the intermediate transfer belt 1F.

The first transfer unit 1D is disposed so as to be in contact with or away from the photoconductor 11 and the intermediate transfer belt 1F comes in contact with the photoconductor 11 only at the time of transferring.

The image of each color is formed sequentially and the toner images overlapped on the intermediate transfer belt 1F are transferred to an image receiving medium 18 at once by means of the second transfer unit 1E and then fixed by means of a fixing unit 19 to form an image.

The second transfer unit 1E is also disposed so as to be in contact with or away from the intermediate transfer belt 1F and it comes in contact with the intermediate transfer belt 1F only at the time of transferring.

Figure 8:
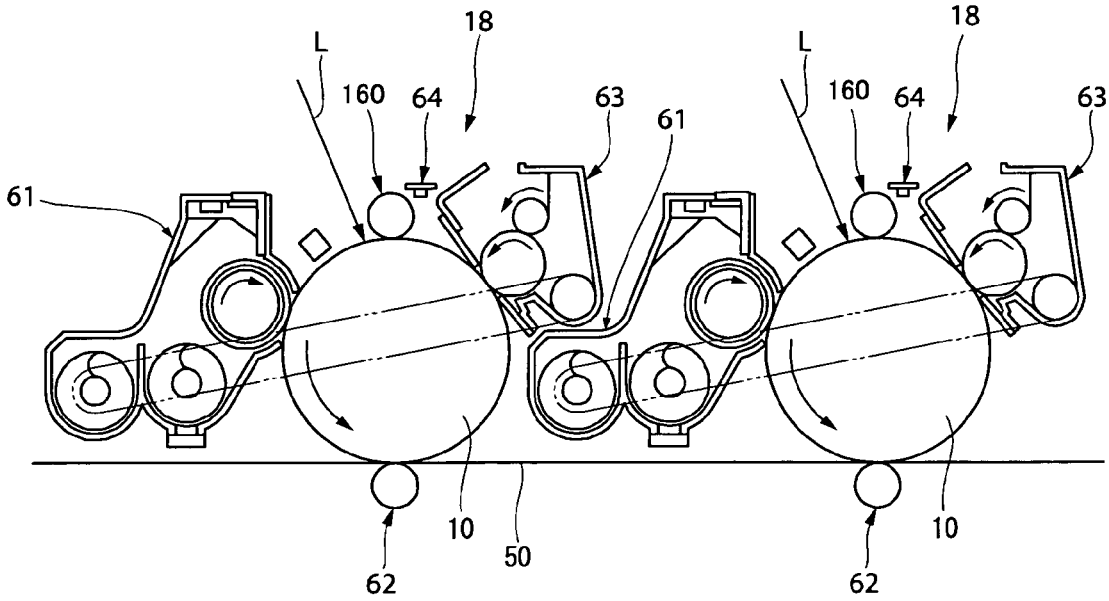
FIG. 8 is a partially enlarged diagram of FIG. 7.

Printing on heavy paper is not possible for the transfer drum type electrophotographic apparatus because toner images of each color are transferred sequentially to a recording medium which is absorbed electrostatically to a transfer drum. In contrast, since toner images of each color are overlapped with each other on the intermediate transfer member 1F in the intermediate transfer type electrophotographic apparatus as shown in FIG. 8, any recording medium can be used.

Moreover, the image forming apparatus as described above may be fixed and incorporated inside of copiers, facsimiles and printers and it may be incorporated as a process cartridge. A process cartridge is a device (part) which has a built-in photoconductor and additionally contains charging unit, exposing unit, developing unit, transfer unit, cleaning unit and charge removing unit. The process cartridge has a variety of shapes. These process cartridges are removable and easily maintenance d.

Figure 9:
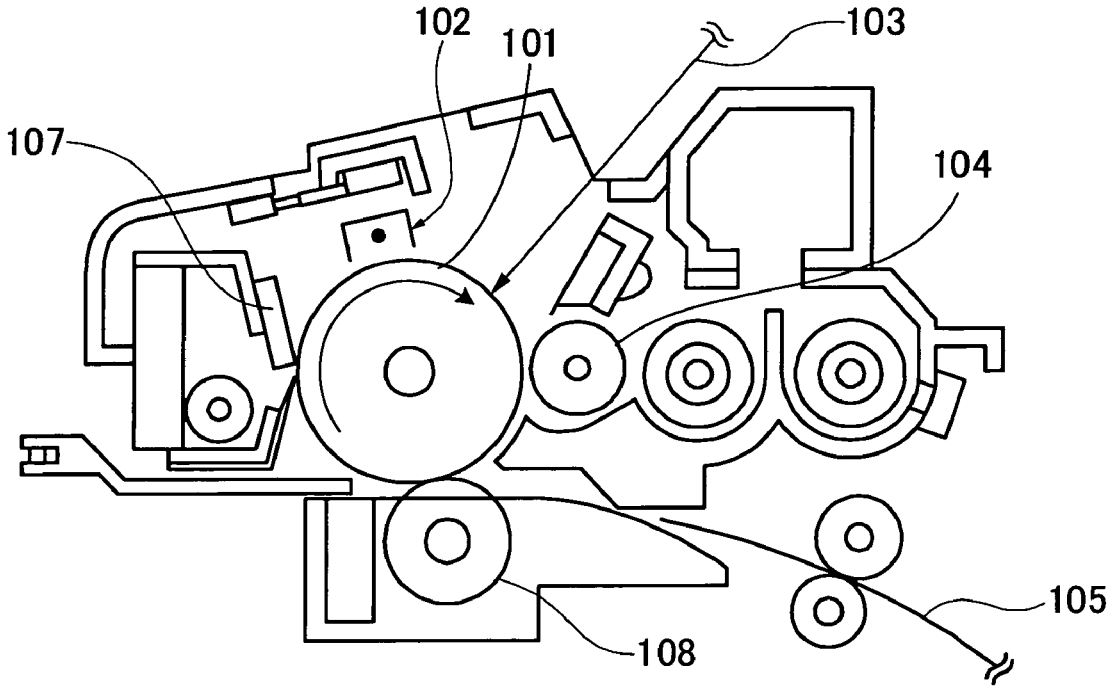
FIG. 9 is a schematic diagram showing an exemplary process cartridge mounted in the image forming apparatus of the present invention.

The process cartridge has for example, a built-in photoconductor 101, and contains a charging unit 102, a developing unit 104, a transfer unit 108 and a cleaning unit 107 as shown in FIG. 9 and further contains other units as necessary. In FIG. 9, No. 103 indicates an exposure by means of an exposing unit and No. 105 indicates a recording medium.

The same photoconductor as described above may be used as the photoconductor 101. Any charging member may be used as the charging unit 102.

In the image forming process by means of the process cartridge as shown in FIG. 9, a latent electrostatic image which corresponds to the exposed image is formed on a surface of the photoconductor 101 by charging by means of the charging unit 102 and exposing by means of an exposing unit 103 (not shown) while the photoconductor 101 is rotated in the direction of arrow. The latent electrostatic image is then developed by means of the developing unit 104 by using a toner and the toner image is transferred to the recording medium 105 by means of the transfer unit 108 and printed out. The surface of the photoconductor after image transfer is cleaned by means of the cleaning unit 107 and the charge is removed by a charge removing unit (not shown) to repeat the above operation again.

Figure 6:
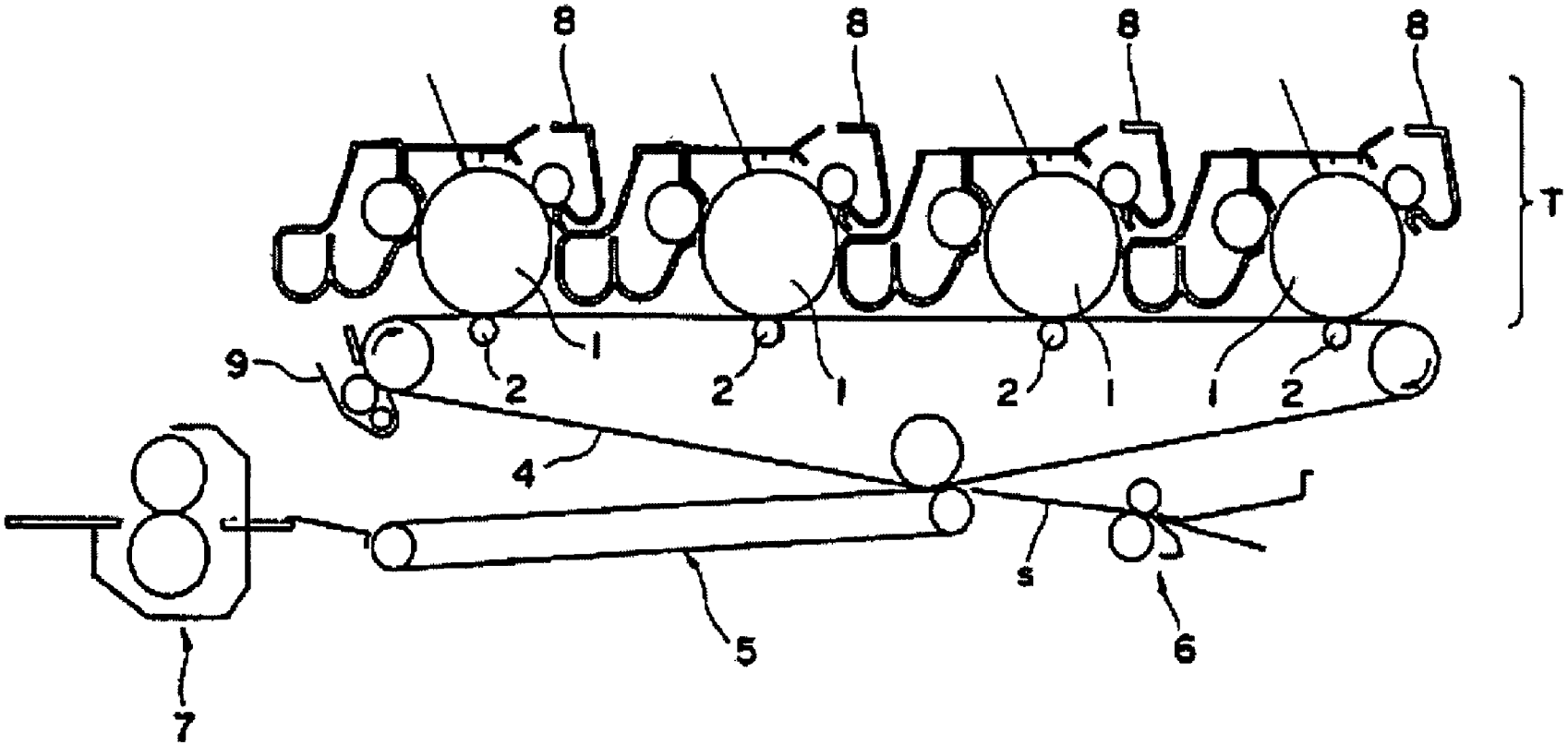
FIG. 6 is a partial diagram showing another example of the tandem-type image forming apparatus of the present invention.

There are two types of tandem electrophotographic apparatus which performs the image forming method of the present invention by means of the image forming apparatus of the present invention: direct transfer type and indirect transfer type. In direct transfer type, images formed on each photoconductor 1 are transferred sequentially by means of the transfer unit 2 to a sheet "s" which is transported by means of a sheet conveying belt 3. In indirect transfer type, images on each photoconductor 1 are temporarily transferred sequentially by means of the primary transfer unit 2 to the intermediate transfer member 4 and then all the images on the intermediate transfer member 4 are transferred together to the sheet "s" by means of the secondary transfer unit 5 as shown in FIG. 6. The transfer unit 5 is generally a transfer/conveying belt; however, roller types may be used.

The direct transfer type as compared to the indirect transfer type, has a drawback of glowing in size in a sheet conveying direction because the paper feeding unit 6 must be placed on upper side of the tandem image forming apparatus T where the photoconductor 1 is aligned, whereas the fixing unit 7 must be placed on lower side of the apparatus. In contrast, in the indirect transfer type, the secondary transfer site may be installed relatively freely, and the paper feeding unit 6 and the fixing unit 7 may be placed together with the tandem image forming apparatus T making it possible to be downsized.

To avoid size-glowing in the sheet conveying direction, the fixing unit 7 must be placed close to the tandem image forming apparatus T. However, it is impossible to place the fixing unit 7 in a way that gives enough space for sheet "s" to bend, and the fixing unit 7 may affect the image forming on upper side through the impact generated from the leading end of the sheet "s" as it approaches the fixing unit 7 (this becomes distinguishable with a thick sheet), or by the difference between the sheet conveying speed when it passes through the fixing unit 7 and the sheet conveying speed when it is transported by the transfer/conveying belt. The indirect transfer type, on the other hand, allows the fixing unit 7 to be placed in a way that gives sheet "s" an enough space to bend and the fixing unit 7 has almost no effect on the image forming.

For above reasons, the indirect transfer type of the tandem electrophotographic apparatus is particularly being emphasized recently.

And this type of color electrophotographic apparatus as shown in FIG. 6, prepares for the next image forming by removing the residual toner on the photoconductor 1 by means of the photoconductor cleaning unit 8 to clean the surface of the photoconductor 1 after the primary transfer. It also prepares for the next image forming by removing the residual toner on the intermediate transfer member 4 by means of the intermediate transfer member cleaning unit 9 to clean the surface of the intermediate transfer member 4 after the secondary transfer.

Figure 7:
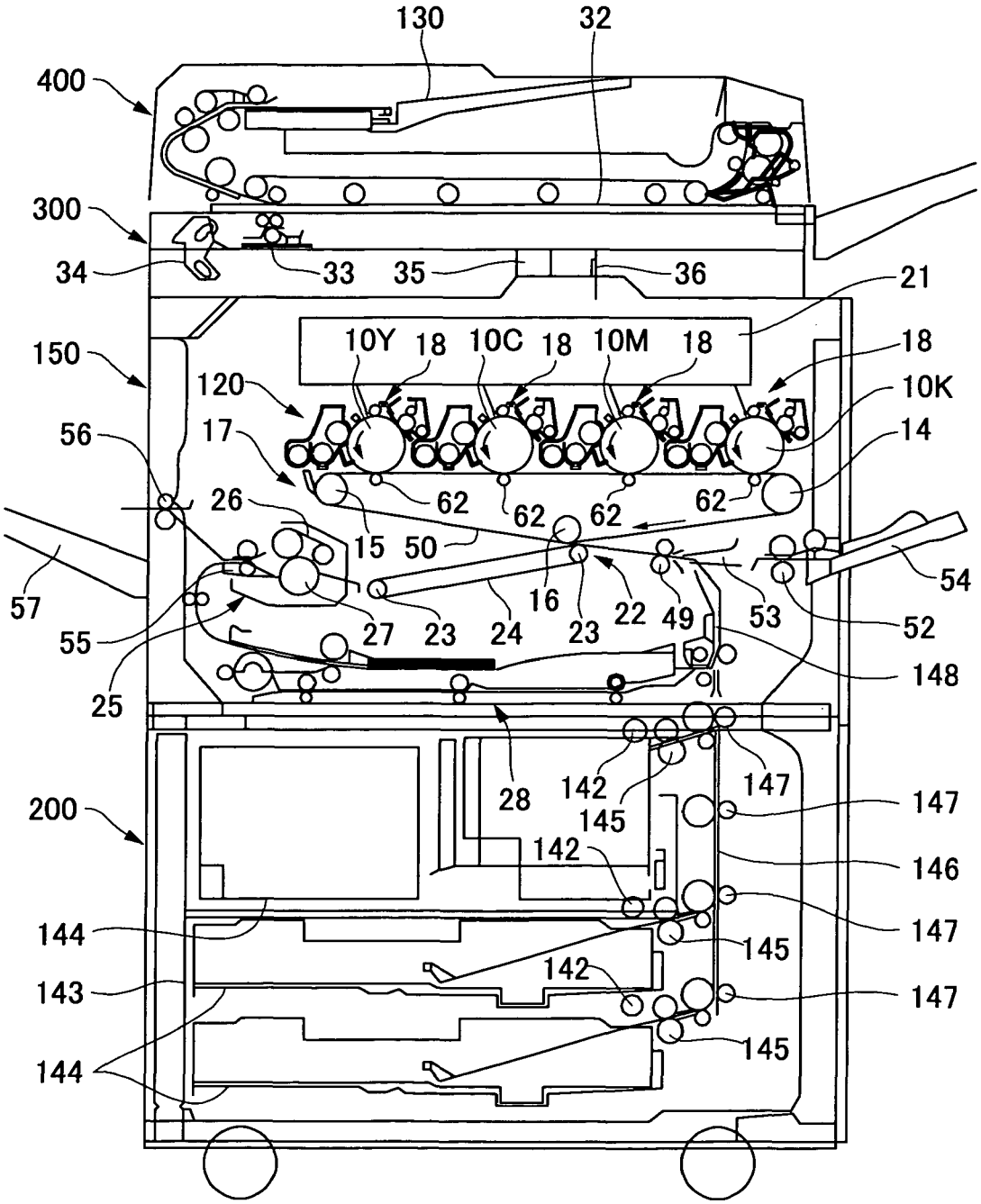
FIG. 7 is an overall diagram further showing another example of the tandem-type image forming apparatus of the present invention.

The tandem image forming apparatus as shown in FIG. 7 is a tandem color-image forming apparatus. The tandem image forming apparatus 120 contains a copying machine main body 150, a feeder table 200, a scanner 300, and an automatic document feeder (ADF) 400.

The copying machine main body 150 contains the endless-belt intermediate transfer member 50 in the center. The intermediate transfer member 50 as shown in FIG. 7 is looped around support rollers 14, 15 and 16 and is configured to rotate in a clockwise direction in FIG. 7. There is disposed a cleaning device 17 for the intermediate transfer member adjacent to the support roller 15. The cleaning device 17 for the intermediate transfer member is capable of removing a residual toner on the intermediate transfer member 50 after transferring a toner image.

Above the intermediate transfer member 50 looped around the support rollers 14 and 15, four image-forming units 18 of yellow, cyan, magenta and black are arrayed in parallel in a conveyance direction of the intermediate transfer member 50 to thereby constitute the tandem developing device 120. There is also disposed an exposure unit 21 adjacent to the tandem developing device 120. A secondary transfer unit 22 is disposed on the opposite side of the intermediate transfer member 50 to where the tandem developing device 120 is disposed. The secondary transfer device 22 contains the secondary transfer belt 24 of an endless belt, which is looped around a pair of rollers 23. The secondary transfer device 22 is configured so that the transfer sheet conveyed on the secondary transfer belt 24 comes in contact with the intermediate transfer member 50. Adjacent to the secondary transfer device 22, there is disposed the image-fixing device 25.

In the tandem image-forming apparatus, a sheet reverser 28 is disposed adjacent to the secondary transfer device 22 and the image-fixing device 25. The sheet reverser 28 is configured to reverse a transfer sheet in order to form images on both sides of the transfer sheet.

Next, full-color image formation (color copy) is formed by means of the tandem developing device 120 in the following manner. Initially, a document is placed on the document platen 130 of the automatic document feeder (ADF) 400. Alternatively, the automatic document feeder 400 is opened, the document is placed on the contact glass 32 of the scanner 300, and the automatic document feeder 400 is closed to press the document.

As a start switch (not shown) is pushed, the document placed on the automatic document feeder 400 is transported onto the contact glass 32. In the case that the document is initially placed on the contact glass 32, the scanner 300 is immediately driven to operate the first carriage 33 and the second carriage 34. Light is irradiated from a light source to the document, and reflected light from the document is further reflected toward the second carriage 34 at the first carriage 33. The reflected light is further reflected by a mirror of the second carriage 34 and passes through the image-forming lens 35 into the read sensor 36 to thereby read the color document (color image). The read color image is interpreted as image information of black, yellow, magenta and cyan.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 8, there are disposed a photoconductor 10 (a photoconductor for black 10K, a photoconductor for yellow 10Y, a photoconductor for magenta 10M, or a photoconductor for cyan 10C), a charging device 160 which uniformly charges the photoconductor, an exposing device (L in FIG. 8) which forms a latent electrostatic image corresponding to each color image on the photoconductor based on each color image information, an developing device 61 which develops the latent electrostatic image with the corresponding color toner (a black toner, a yellow toner, a magenta toner, or a cyan toner) to form a toner image of each color, a transfer charger 62 for transferring the toner image to the intermediate transfer member 50, the photoconductor cleaning device 63 and the charge removing device 64. Accordingly, each mono-color image (a black image, a yellow image, a magenta image, and a cyan image) is formed based on the corresponding color-image information. The thus obtained black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred (primary transfer) onto the intermediate transfer member 50 which rotates by means of the support rollers 14, 15 and 16. These toner images are superimposed on the intermediate transfer member 50 to form a composite color image (color transferred image).

One of feeder rollers 142 of the feeder table 200 is selectively rotated, sheets (recording paper) are ejected from one of multiple feeder cassettes 144 in the paper bank 143 and are separated in the separation roller 145 one by one into the feeder path 146, are transported by the conveying roller 147 into the feeder path 148 in the copying machine main body 150 and are bumped against the resist roller 49. Note that, the resist roller 49 is generally earthed, but it may be biased for removing paper dust of the sheets.

The resist roller 49 is rotated synchronously with the movement of the composite color image (transferred color image) on the intermediate transfer member 50 to transport the sheet (recording medium) into between the intermediate transfer member 50 and the secondary transfer device 22, and the composite color image (transferred color image) is transferred (secondary transfer) onto the sheet (recording paper) by action of the secondary transfer device 22. After transferring the toner image, the residual toner on the intermediate transfer member 50 is cleaned by means of the intermediate transfer member cleaning device 17.

The sheet (recording paper) to which the color image is transferred and formed is transported by means of the secondary transfer device 22 into the image-fixing device 25, is applied with heat and pressure in the image-fixing device 25 to fix the composite color image (transferred color image) to the sheet (recording paper). Thereafter, the sheet (recording paper) changes its direction by action of the switch blade 55, is ejected by the ejecting roller 56 and is stacked on the output tray 57. Alternatively, the sheet changes its direction by action of the switch blade 55 into the sheet reverser 28, turns the direction, is transported again to the transfer section, subjected to an image formation on the back surface thereof. The sheet bearing images on both sides thereof is then ejected with assistance of the ejecting roller 56, and is stacked on the output tray 57.

Because the image forming method and image forming apparatus of the present invention use a tandem image forming apparatus which is equipped with an electrophotographic photoconductor and multiple image forming elements containing latent electrostatic image forming unit, developing unit and transfer unit, and a latent electrostatic image bearing member having a photosensitive layer containing charge transporting, material expressed by the above Structural Formula (1), it is possible to exhibit high durability and form full color images at high speed and low cost stably even when used repeatedly.

EXAMPLES

Herein below, the invention will be explained in detail referring to Examples. In the following Examples, "parts" represents "parts by mass", "%" represents "% by mass" unless indicated otherwise.

Synthetic Example 1-1

Synthesis of Charge Transporting Material of Structural Formula (3)

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 2.14 g (18.6 mmol) of 2-aminoheptane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 2.14 g (yield: 31.5%) of monoimide A.

—Second Step—

2.0 g (5.47 mmol) of monoimide A, 0.137 g (2.73 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.668 g (yield: 33.7%) of the compound expressed by the following Structural Formula (3). A peak at M/z=726 was observed in mass analysis (FD-MS) and it was identified as the target. The calculated values of element analysis were carbon 69.41%, hydrogen 5.27% and nitrogen 7.71% whereas the observed values were carbon 69.52%, hydrogen 5.09% and nitrogen 7.93%.

Structural Formula (3)

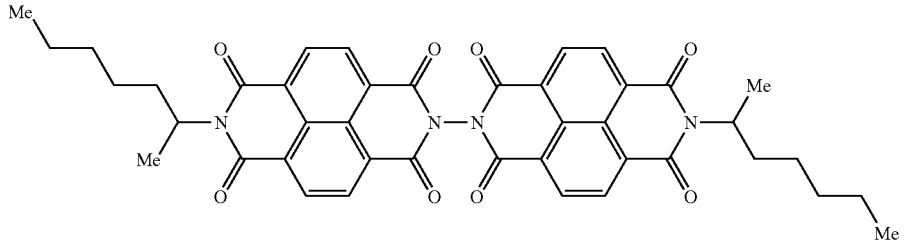

Synthetic Example 1-2

Synthesis of Charge Transporting Material of Structural Formula (4)

—First Step—

First, 10 g (37.3 mmol) of 1,4,5,8-naphthalenetetracarboxylic acid dianhydride, 0.931 g (18.6 mmol) of hydrazine monohydrate, 20 mg of p-toluenesulfonic acid and 100 ml of toluene were put in a 4-necked flask of 200 ml and heated to reflux for 5 hours. After reaction was completed, the container was cooled and then condensed under reduced pressure. The residue was purified by silica gel column chromatography. The recovered product was further recrystallized with toluene/ethyl acetate to obtain 2.84 g (yield: 28.7%) of dimer C.

—Second Step—

2.5 g (4.67 mmol) of dimer C and 30 ml of N,N-dimethylformamide (DMF) were put in a 4-necked flask of 100 ml and heated to reflux. A mixture containing 0.278 g (4.67 mmol) of 2-aminopropane and 10 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 0.556 g (yield: 38.5%) of monoimide C.

—Third Step—

0.50 g (1.62 mmol) of monoimide C and 10 ml of N,N-dimethylformamide (DMF) were put in a 4-necked flask of 50 ml and heated to reflux. A mixture containing 0.186 g (1.62 mmol) of 2-aminoheptane and 5 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.243 g (yield: 22.4%) of the compound expressed by the following Structural Formula (4). A peak at M/z=670 was observed in mass analysis (FD-MS) and it was identified as the target. The calculated values of element analysis were carbon 68.05%, hydrogen 4.51% and nitrogen 8.35% whereas the observed values were carbon 68.29%, hydrogen 4.72% and nitrogen 8.33%.

Structural Formula (4)

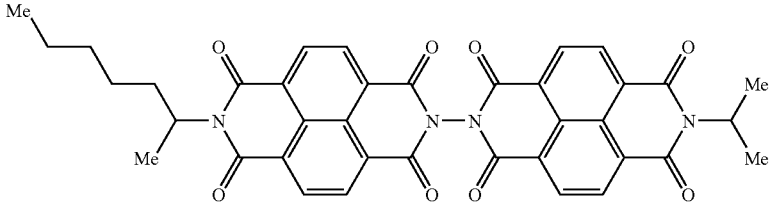

Synthetic Example 1-3

Synthesis of Charge Transporting Material of Structural Formula (5)

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.10 g (18.6 mmol) of 2-aminopropane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 2.08 g (yield: 36.1%) of monoimide B.

—Second Step—

2.0 g (6.47 mmol) of monoimide B, 0.162 g (3.23 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.810 g (yield: 37.4%) of the charge transporting material expressed by the following Structural Formula (5). A peak at M/z=614 was observed in mass analysis (FD-MS) and it was identified as the target. The calculated values of element analysis were carbon 66.45%, hydrogen 3.61% and nitrogen 9.12% whereas the observed values were carbon 66.28%, hydrogen 3.45% and nitrogen 9.33%.

Structural Formula (5)

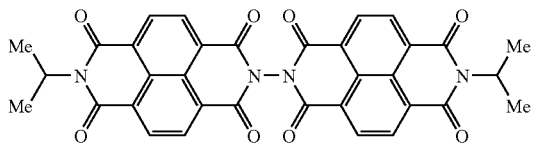

Synthetic Example 1-4

Synthesis of Charge Transporting Material of Structural Formula (6)

—First Step—

5.0 g (9.39 mmol) of the above dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 1.66 g (yield: 28.1%) of monoimide D.

—Second Step—

1.5 g (2.38 mmol) of monoimide D and 50 ml of N,N-dimethylformamide (DMF) were put in a 4-necked flask of 100 ml and heated to reflux. A mixture containing 0.308 g (2.38 mmol) of 2-aminooctane and 10 ml of N,N-dimethylformamide (DMF) were allowed to drip into the flask while stirring. After dripping, the mixture was then heated to reflux for 6 hours. After reaction was completed, the container was cooled and condensed under reduced pressure. Toluene was added to the residue and it was purified by silica gel column chromatography. The recovered product was further recrystallized with toluene/hexane to obtain 0.328 g (yield: 18.6%) of the charge transporting material expressed by the following Structural Formula (6). A peak at M/z=740 was observed in mass analysis (FD-MS) and it was identified as the target. The calculated values of element analysis were carbon 69.72%, hydrogen 5.44% and nitrogen 7.56% whereas the observed values were carbon 69.55%, hydrogen 5.26% and nitrogen 7.33%.

Structural Formula (6)

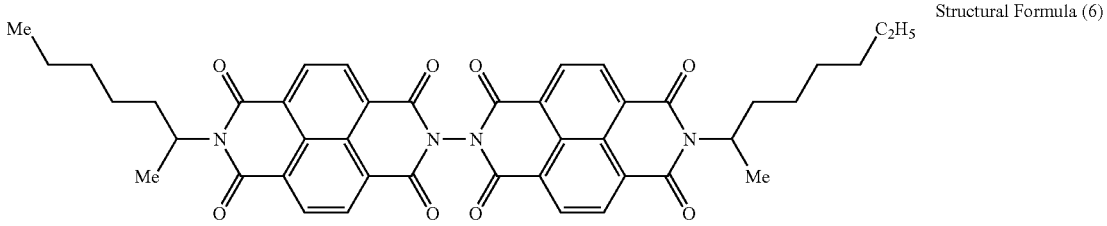

Synthetic Example 1-5

Synthesis of Charge Transporting Material of Structural Formula (7)

—First Step—

5.0 g (9.39 mmol) of the above dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 1.66 g (yield: 28.1%) of monoimide D.

—Second Step—

1.5 g (2.38 mmol) of monoimide D and 50 ml of N,N-dimethylformamide (DMF) were put in a 4-necked flask of 100 ml and heated to reflux. A mixture containing 0.408 g (2.38 mmol) of 6-aminoundecane and 10 ml of N,N-dimethylformamide (DMF) were allowed to drip into the flask while stirring. After dripping, the mixture was then heated to reflux for 6 hours. After reaction was completed, the container was cooled and condensed under reduced pressure. Toluene was added to the residue and it was purified by silica gel column chromatography. The recovered product was further recrystallized with toluene/hexane to obtain 0.276 g (yield: 14.8%) of the charge transporting material expressed by the following Structural Formula (7). A peak at M/z=782 was observed in mass analysis (FD-MS) and it was identified as the target. The calculated values of element analysis were carbon 70.57%, hydrogen 5.92% and nitrogen 7.16% whereas the observed values were carbon 70.77%, hydrogen 6.11% and nitrogen 7.02%.

Structural Formula (7)

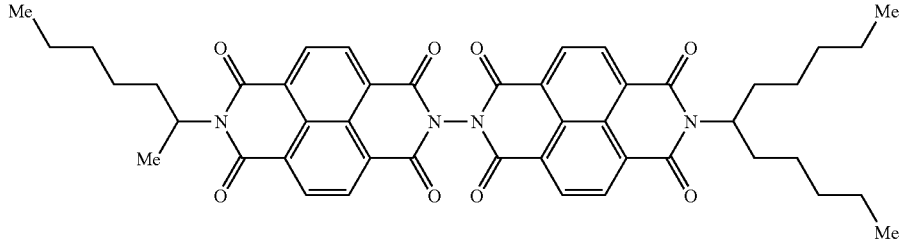

Example 1-1

A mixture of the following composition was poured into a ball mill pot and it was subject to ball milling by using an alumina ball of 10 mm diameter for 120 hours.

—Coating Liquid for Undercoat Layer—

| | |
|---|---|
| Titanium oxide (CR-60 by Ishihara Sangyo Kaisha, Ltd.) | 500 g |
| alkyd resin (Beckolite M6401-50 by Dainippon Ink and Chemicals, Inc., solid content of 50%) | 150 g |
| melamine resin (Super Beckamine L-121-60 by Dainippon Ink and Chemicals, Inc., solid content 60%) | 83 g |
| methyl ethyl ketone (by Kanto Chemical Co., Inc.) | 317 g |

The coating liquid was applied on an aluminum drum of 30 mm diameter and 340 mm length by dipping and dried at 135° C. for 20 minutes to form an undercoat layer of 4.5 μm thickness.

—Coating Liquid for Charge Generating Layer—

| | |
|---|---|
| metal-free phthalocyanine pigment (Fastogen Blue 8120B by Dainippon Ink and Chemicals, Inc.) | 140 g |
| polyvinylbutyral (BX-1 by Sekisui Chemical Co., Ltd.) | 90 g |
| cyclohexanone | 2,700 g |

These materials were dispersed for 40 minutes by means of a bead mill disperser (PSZ ball of 0.5 mm diameter was used as a media) to prepare a coating liquid of charge generating layer. The coating liquid was applied on the undercoat layer by dipping and dried at 130° C. for 20 minutes to form a charge generating layer of 0.15 μm thickness.

Next, a coating liquid for charge transporting layer of the following composition was prepared, applied on the charge generating layer by dipping and dried at 120° C. for 20 minutes to form a charge transporting layer of 22 μm thickness.

—Coating Liquid for Charge Transporting Layer—

| | |
|---|---|
| charge transporting material expressed by the above Structural Formula (6) (by Ricoh Company, Ltd.) | 90 g |
| polycarbonate resin (Z-Polyca by Teijin Chemicals Ltd., viscosity-average molecular weight = 40,000) | 100 g |
| silicone oil (KF-50 by Shin-etsu Chemical Co., Ltd.) | 0.02 g |
| tetrahydrofran (by kanto Chemical Co., Inc.) | 1,200 g |

—Coating Liquid for Surface Protective Layer—

| | |
|---|---|
| white conductive titanium oxide (ET-500W by Ishihara Sangyo Kaisha, Ltd.) | 18.2 g |

-continued

| | |
|---|---|
| charge transporting material expressed by the above Structural Formula (6) (by Ricoh Company, Ltd.) | 3 g |
| polyvinylbutyral resin (XYHL by UCC Inc.) | 7.8 g |
| cyclohexanone (Kanto Chemical Co., Inc.) | 122.2 g |

A mixture of the above composition was put in a ball mill pot and was subject to ball milling for 48 hours by using a SUS ball of 10 mm diameter. The milling liquid was taken out, mix-stirred with additional 10.2 g of 10% cyclohexanone solution of toluene-2,4-diisocyanate, 171.1 g of cyclohexanone (by Kanto Chemical Co., Inc.) and 114.1 g of methyl ethyl ketone (by Kanto Chemical Co., Inc.) to prepare a coating liquid for surface protective layer. The coating liquid was applied on the charge transporting layer by spraying and dried at 130° C. for 15 minutes to form a surface protective layer of 2 μm thickness and to finally obtain an electrophotographic photoconductor.

Example 1-2

An electrophotographic photoconductor was produced as similar to Example 1-1 except for using a titanyl phthalocyanine prepared according to the following Pigment Synthetic Example 1-1 as a charge generating material instead of X-type metal-free phthalocyanine (Fastogen Blue 8120B).

Pigment Synthetic Example 1-1

A pigment was produced according to JP-A No. 2001-19871. First, 29.2 g of 1,3-diiminoisoindoline and 200 ml of sulfolane were mixed and 20.4 g of titanium tetrabutoxide was allowed to drip into the mixture under nitrogen airflow. After dripping, a temperature of the mixture was raised gradually to 180° C. and stirred for 5 hours while maintaining the reaction temperature in the range of 170° C. to 180° C. to perform reaction. After reaction was completed, the deposit was filtered after cooling, washed until the fine particles were blue with chloroform, then washed several times with methanol, dried after further washing with hot water of 80° C. to obtain an unprocessed titanyl phthalocyanine. The unprocessed titanyl phthalocyanine was dissolved in 20 times its volume of a concentrated sulfuric acid, allowed to drip into 100 times its volume of ice water while stirring and the deposited crystals were filtered followed by repetitive washing with water until the wash fluid becomes neutral (pH value of ion exchange water after washing was 6.8) to obtain a wet cake (water paste) of titanyl phthalocyanine pigment. 40 g of the obtained wet cake (water paste) was put in 200 g of tetrahydrofran, the mixture was filtered after 4 hours of stirring and dried to obtain titanyl phthalocyanine powder. This was defined as a pigment 1.

The density of solid content of the above wet cake was 15%. The mass ratio of the crystal conversion solvent to the wet cake was 33:0. Meanwhile, halogen compound was not used for raw material of Synthetic Example 1.

Figure 10:
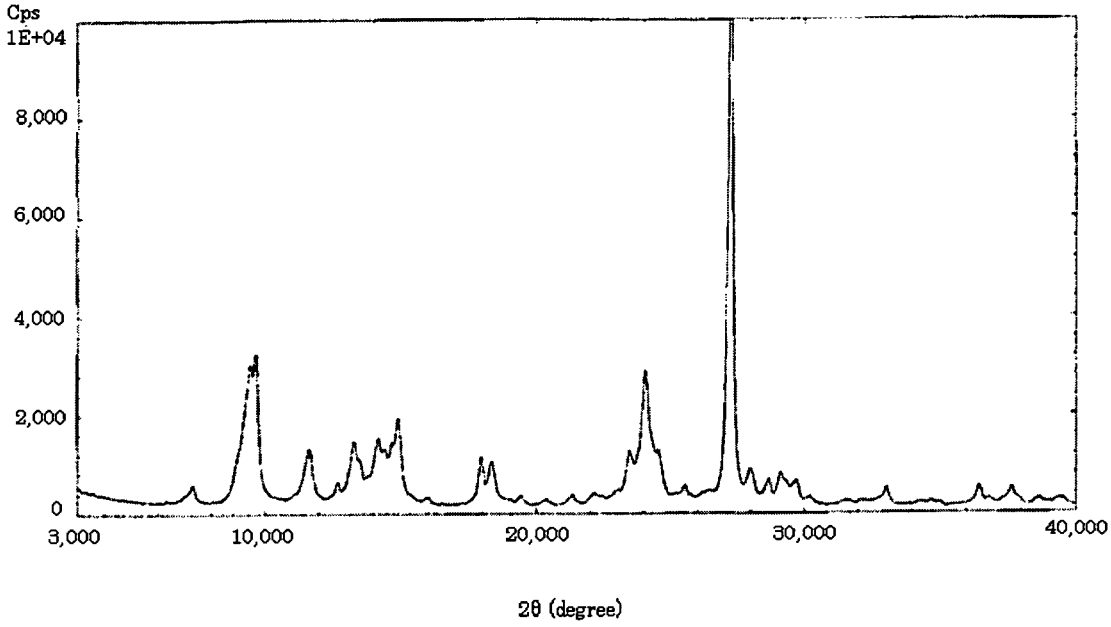
FIG. 10 is a X-ray diffraction spectrum of titanyl phthalocyanine synthesized in pigment synthetic examples of Example 1-2 and Example 7-3.

The X-ray diffraction spectrum of the obtained titanyl phthalocyanine powder was measured by the following condition and it turns out that the titanyl phthalocyanine powder had a maximum diffraction peak at Bragg angle 2θ relative to a Cu—Kα ray (1.542 Å wavelength) of 27.2±0.2°, additionally had a peak at the lowest angle 7.3±0.2° and had no peaks between the peak at 7.3° and the peak at 9.4°, and at 26.3°. The result is shown in FIG. 10.

[Measurement Condition of X-ray Diffraction Spectrum]

| | |
|---|---|
| X-ray tube: | Cu |
| Voltage: | 50 kV |
| Electric Current: | 30 mA |
| Scan Speed: | 2°/min. |
| Scan Range: | 3° to 40° |
| Time Constant: | 2 seconds |

Meanwhile, average particle size in the coating liquid for charge generating layer using the titanyl phthalocyanine was 0.31 μm as measured by means of CAPA-700 by Horiba, Ltd.

Example 1-3

An electrophotographic photoconductor was produced as similar to Example 1-2 except for using the charge transporting material (by Ricoh Company, Ltd.) expressed by Structural Formula (3) instead of the charge transporting material expressed by Structural Formula (6) used for charge transporting layer and surface protective layer in Example 1-2.

Example 1-4

A coating liquid for surface protective layer was prepared as similar to Example 1-2 except for using tin oxide (SN-100 by Ishihara Sangyo Kaisha, Ltd.) instead of titanium oxide used for preparing surface protective layer in Example 1-2. The coating liquid was applied on the charge transporting layer by spraying and dried at 130° C. for 15 minutes to form a surface protective layer of 3.0 μm thickness to produce an electrophotographic photoconductor.

Example 1-5

An electrophotographic photoconductor was produced as similar to Example 1-2 except for omitting the charge transporting material expressed by the Structural Formula (6) which was added to the surface protective layer in Example 1-2.

Comparative Example 1-1

An electrophotographic photoconductor was produced as similar to Example 1-2 except for using the charge transporting material (by Ricoh Company, Ltd.) expressed by the following Structural Formula (13) instead of the charge transporting material expressed by Structural Formula (6) used for charge transporting layer and surface protective layer in Example 1-2.

Structural Formula (13)

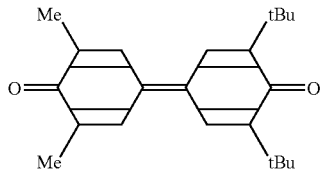

Next, the electrophotographic photoconductor produced in Example 1-1 was mounted in a reversal development-type digital copier of soft roller charging, imagio MF250 (by Ricoh Company, Ltd.; high-voltage power supply was changed for positive charging) and copies of 20,000 sheets (5% image density) were made and image qualities such as image density, image blur and background smear, scratch on photoconductor surface and filming were evaluated with eyes. The applied voltage of the high-voltage power supply was set so that the surface potential becomes +500V and the test was operated thoroughly in this charging condition. The developing bias was set at +350V and the toner was positively charged by using a polarity controlling material.

The copies of 20,000 sheets (5% image density) were made and evaluation of charge injection property to the electrophotographic photoconductors of Examples 1-2 to 1-5 and Comparative Example 1-1 was conducted as similar to Example 1-1 except for changing the charging roller to the magnetic brush charging member as shown in FIG. 11A. The results are shown in Table 1-1.

TABLE 1-1

| | Electric Potential after Exposure (VL) | | | |
|---|---|---|---|---|
| | At Beginning | After Printing of 20,000 sheets | Image Quality | Surface of OPC |
| Example 1-1 | 105 | 145 | No degraded images until 20,000 copies | No degradation until 20,000 copies |
| Example 1-2 | 80 | 115 | No degraded images until 20,000 copies | No degradation until 20,000 copies |
| Example 1-3 | 83 | 109 | No degraded images until 20,000 copies | No degradation until 20,000 copies |
| Example 1-4 | 72 | 120 | Image blur after approximately 17,000 copies | Fine scratch in peripherial direction of the drum after approximately 14,000 copies |
| Example 1-5 | 90 | 135 | Image blur after approximately 12,000 copies | Visible toner filming after approximately 15,000 copies |

TABLE 1-1-continued

| | Electric Potential after Exposure (VL) | | | |
|---|---|---|---|---|
| | At Beginning | After Printing of 20,000 sheets | Image Quality | Surface of OPC |
| Comp. Ex. 1-1 | 125 | 295 | Image density was lower than at the beginning and it was significantly lowerd after approximately 7,000 copies | No degradation until 20,000 copies |

Photoconductor Production Example 2-1

First, coating liquids for undercoat layer, charge generating layer and charge transporting layer of the following compositions were prepared.

[Coating Liquid for Undercoat Layer]

| | |
|---|---|
| alkyd resin (Beckozol M6401-50 by Dainippon Ink and Chemicals, Inc.) | 10 parts |
| melamine resin (Super Beckamine L-121-60 by Dainippon Ink and Chemicals, Inc.) | 7 parts |
| Titanium oxide (CR-EL by Ishihara Sangyo Kaisha, Ltd.) | 48 parts |
| methyl ethyl ketone | 155 parts |

The above materials were subject to ball milling for 5 days by means of a ball mill apparatus (an alumina ball of 10 mm diameter was used as media) to prepare a coating liquid for undercoat layer.

[Coating Liquid for Charge Generating Layer]

| | |
|---|---|
| metal-free phthalocyanine pigment (Fastogen Blue 8120B by Dainippon Ink and Chemicals, Inc.) | 14 parts |
| polyvinylbutyral (BX-1 by Sekisui Chemical Co., Ltd.) | 9 parts |
| cyclohexanone | 270 parts |

These materials were subject to ball milling for 40 minutes by means of a bead mill disperser (PSZ ball of 0.5 mm diameter was used as a media) to prepare a coating liquid for charge generating layer.

[Coating Liquid for Charge Transporting Layer]

| | |
|---|---|
| charge transporting material expressed by the following Structural Formula (3) | 9 parts |
| polycarbonate resin (Z-Polyca by Teijin Chemicals Ltd., viscosity-average molecular weight = 40,000) | 10 parts |
| tetrahydrofran | 120 parts |
| 1% silicone oil tetrahydrofran solution (KF50-100CS by by Shin-etsu Chemical Co., Ltd.) | 1 part |

The above materials were stirred and dissolved to prepare a coating liquid for charge transporting layer.

The charge transporting material expressed by Structural Formula (3) was manufactured by the following method.

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 2.14 g (18.6 mmol) of 2-aminoheptane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with a mixed solvent of toluene/hexane to obtain 2.14 g (yield: 31.5%) of monoimide A.

—Second Step—

2.0 g (5.47 mmol) of monoimide A, 0.137 g (2.73 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with a mixed solvent of toluene/ethyl acetate to obtain 0.668 g (yield: 33.7%) of the charge transporting material expressed by Structural Formula (3). A peak at M/z=726 was observed in mass analysis (FD-MS) and it was identified as the target. The calculated values of element analysis were carbon 69.41%, hydrogen 5.27% and nitrogen 7.71% whereas the observed values were carbon 69.52%, hydrogen 5.09% and nitrogen 7.93%.

Structural Formula (3)

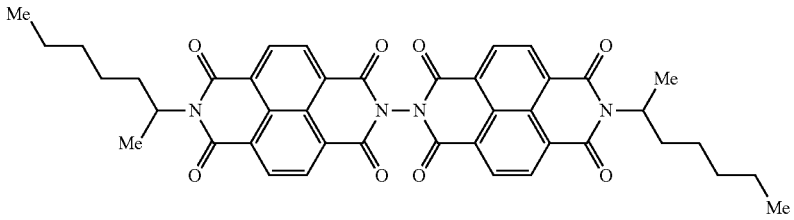

The coating liquids for undercoat layer, charge generating layer and charge transporting layer were applied sequentially on an aluminum drum of 30 mm diameter and 340 mm length by dipping for film-forming and dried at 135° C. for 20 minutes, 80° C. for 15 minutes and 120° C. for 20 minutes respectively. Meanwhile, each elevating speed was set so as to have an undercoat layer of 4.5 μm thickness, a charge generating layer of 0.15 μm thickness and a charge transporting layer of 22.1 μm thickness to produce a photoconductor 1.

Photoconductor Production Example 2-2

30 parts of metal-free phthalocyanine pigment (Fastogen Blue 8120B by Dainippon Ink and Chemicals, Inc) as a charge generating material was dispersed in a ball mill apparatus with 970 parts of cyclohexanone for 2 hours to prepare a coating liquid for charge generating layer. In addition, 49 parts of polycarbonate resin (Z-Polyca by Teijin Chemicals Ltd., viscosity-average molecular weight=40,000), 20 parts of the compound expressed by the above Structural Formula (3), 29.5 parts of the compound expressed by the following Structural Formula (14) and 0.1 parts of silicone oil (KF50-100CS by Shin-etsu Chemical Co., Ltd.) were dissolved in 340 parts of tetrahydrofran and then 66.6 parts of dispersion liquid of charge generating material was added and stirred to prepare a coating liquid for photosensitive layer.

Structural Formula (14)

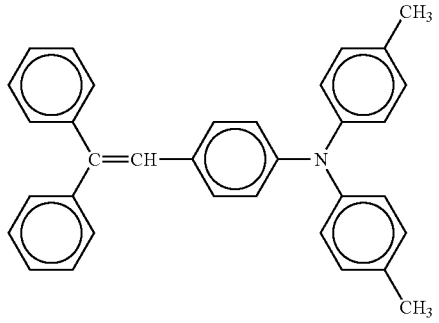

Next, a coating liquid for photosensitive layer was applied on an aluminum drum of 30 mm diameter and 340 mm length by dipping for film forming and dried at 120° C. for 15 minutes. The elevating speed was set so as to have a photosensitive layer of 22.5 μm thickness to produce a photoconductor 2.

Photoconductor Production Example 2-3

A photoconductor 2-3 was produced as similar to Photoconductor Production Example 2-1 except for using the compound expressed by the following Structural Formula (5) as a charge transporting material.

Structural Formula (5)

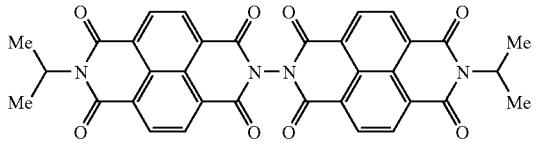

The charge transporting material expressed by Structural Formula (5) was manufactured by the following method.

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.10 g (18.6 mmol) of 2-aminopropane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with a mixed solvent of toluene/hexane to obtain 2.08 g (yield: 36.1%) of monoimide B.

—Second Step—

2.0 g (6.47 mmol) of monoimide B, 0.162 g (3.23 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with a mixed solvent of toluene/ethyl acetate to obtain 0.810 g (yield: 37.4%) of the charge transporting material expressed by Structural Formula (5). A peak at M/z=614 was observed in mass analysis (FD-MS) and it was identified as the target. The calculated values of element analysis were carbon 66.45%, hydrogen 3.61% and nitrogen 9.12% whereas the observed values were carbon 66.28%, hydrogen 3.45% and nitrogen 9.33%.

Photoconductor Production Example 2-4

The photoconductor 4 was produced as similar to Photoconductor Production Example 2-1 except for using the compound expressed by the following Structural Formula (4) as a charge transporting material.

Structural Formula (4)

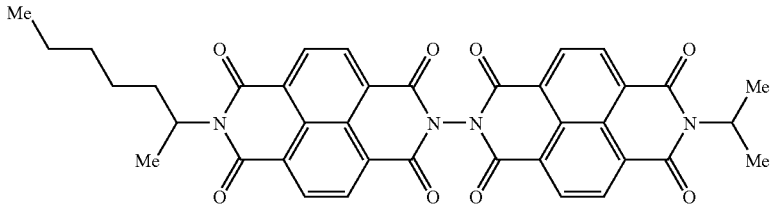

The charge transporting material expressed by Structural Formula (4) was produced by the following method.

—First Step—

First, 10 g (37.3 mmol) of 1,4,5,8-naphthalenetetracarboxylic acid dianhydride, 0.931 g (18.6 mmol) of hydrazine monohydrate, 20 mg of p-toluenesulfonic acid and 100 ml of toluene were put in a 4-necked flask of 200 ml and heated to reflux for 5 hours. After reaction was completed, the container was cooled and then condensed under reduced pressure. The residue was purified by silica gel column chromatography. The recovered product was further recrystallized with a mixed solvent of toluene/ethyl acetate to obtain 2.84 g (yield: 28.7%) of dimer C.

—Second Step—

2.5 g (4.67 mmol) of dimer C and 30 ml of N,N-dimethylformamide (DMF) were put in a 4-necked flask of 100 ml and heated to reflux. A mixture containing 0.278 g (4.67 mmol) of 2-aminopropane and 10 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 0.556 g (yield: 38.5%) of monoimide C.

—Third Step—

0.50 g (1.62 mmol) of monoimide C and 10 ml of N,N-dimethylformamide (DMF) were put in a 4-necked flask of 50 ml and heated to reflux. A mixture containing 0.186 g (1.62 mmol) of 2-aminoheptane and 5 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with a mixed solvent of toluene/hexane to obtain 0.243 g (yield: 22.4%) of the compound expressed by the Structural Formula (4). A peak at M/z=670 was observed in mass analysis (FD-MS) and it was identified as the target. The calculated values of element analysis were carbon 68.05%, hydrogen 4.51% and nitrogen 8.35% whereas the observed values were carbon 68.29%, hydrogen 4.72% and nitrogen 8.33%.

Photoconductor Production Example 2-5

The photoconductor 2-5 was produced as similar to Photoconductor Production Example 2-2 except for using the compound expressed by the above Structural Formula (5) as a charge transporting material.

Photoconductor Production Example 2-6

The photoconductor 2-6 was produced as similar to Photoconductor Production Example 2-2 except for using the compound expressed by the above Structural Formula (4) as a charge transporting material.

Comparative Photoconductor Production Example 2-1

The comparative photoconductor 2-1 was produced as similar to Photoconductor Production Example 2-1 except for using the compound expressed by the following Structural Formula (13) as a charge transporting material.

Structural Formula (13)

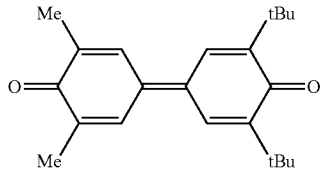

Comparative Photoconductor Production Example 2-2

The comparative photoconductor 2-2 was produced as similar to Photoconductor Production Example 2-1 except for using the compound expressed by the following Structural Formula (15) as a charge transporting material.

Structural Formula (15)

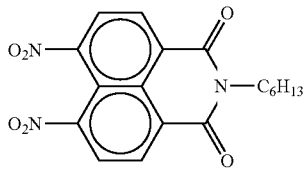

Comparative Photoconductor Production Example 2-3

The comparative photoconductor 2-3 was produced as similar to Photoconductor Production Example 2-2 except for using the compound expressed by the above Structural Formula (13) as a charge transporting material.

Comparative Photoconductor Production Example 2-4

The comparative photoconductor 2-4 was produced as similar to Photoconductor Production Example 2-2 except for using the compound expressed by the above Structural Formula (15) as a charge transporting material.

Toner Production Example 2-1

Synthesis of Organic Fine Particle Emulsion

First, 683 parts of water, 11 parts of sodium salt of sulfuric acid ester of ethylene oxide adduct of methacrylic acid (Eleminol RS-30 by Sanyo Chemical Industries, Ltd.), 138 parts of styrene, 138 parts of methacrylic acid and 1 part of ammonium persulfate were put in a reaction vessel equipped with stirrer and thermometer and stirred at 400 rpm for 15 minutes to obtain a white emulsion. The emulsion was heated to a temperature within the system of 75° C. and reacted for 5 hours. Next, 30 parts of 1% water solution of ammonium persulfate was added and matured at 75° C. for 5 hours to obtain an aqueous dispersion liquid of vinyl resin (copolymer of styrene-methacrylic acid-butyl acrylate-sodium salt of sulfuric acid ester of ethylene oxide adduct of methacrylic acid). This was defined as [fine particle dispersion liquid 1].

—Synthesis of Low-Molecular Polyester—

First, 220 parts of bisphenol A ethylene oxide 2-mol adduct, 561 parts of bisphenol A propylene oxide 3-mol adduct, 218 parts of terephthalic acid, 48 parts of adipic acid and 2 parts of dibutyltin oxide were put in a reaction vessel equipped with cooling tube, stirrer and nitrogen introducing tube and reacted at 230° C. under normal pressure for 8 hours. After being reacted under reduced pressure of 10 mmHg to 15 mmHg for 5 hours, 45 parts of trimellitic anhydride was put in the reaction vessel and reacted at 180° C. under normal pressure for 2 hours to obtain [low-molecular polyester 1].

—Synthesis of Prepolymer—

First, 682 parts of bisphenol A ethylene oxide 2-mol adduct, 81 parts of bisphenol A propylene oxide 2-mol adduct, 283 parts of terephthalic acid, 22 parts of trimellitic anhydride and 2 parts of dibutyltin oxide were put in a reaction vessel equipped with cooling tube, stirrer and nitrogen introducing tube and reacted at 230° C. under normal pressure for 8 hours. It was then reacted under reduced pressure of 10 mmHg to 15 mmHg for 5 hours to obtain [intermediate polyester 1]. The number average molecular weight of the obtained [intermediate polyester 1] was 2,100, the mass average molecular weight was 9,500, glass transition temperature (Tg) was 55° C., acid value was 0.5 mgKOH/g and hydroxyl value was 49 mgKOH/g.

Next, 411 parts of [intermediate polyester 1], 89 parts of isophorone diisocyanate and 500 parts of ethyl acetate were put in a reaction vessel equipped with cooling tube, stirrer and nitrogen introducing tube and reacted at 100° C. for 5 hours to obtain [prepolymer 1].

—Synthesis of Ketimine—

170 parts of isophorone diamine and 75 parts of methyl ethyl ketone were put in a reaction vessel equipped with stirrer and thermometer and reacted at 50° C. for 5 hours to obtain [ketimine compound 1].

—Preparation of Oil Phase—

First, 628 parts of [low-molecular polyester 1], 110 parts of carnauba wax, 22 parts of tetraalkylammonium perchlorate and 947 parts of ethyl acetate were put in a reaction vessel equipped with stirrer and thermometer and heated to 80° C. while stirring, and then cooled to 30° C. for 1 hour after retaining at 80° C. for 5 hours. Next, 250 parts of C. I. Pigment Red 269 and 500 parts of ethyl acetate were put in the reaction vessel and mixed for 1 hour to obtain a dissolved product. This was defined as [raw material liquid solution 1].

Next, 1,324 parts of [raw material liquid solution 1] was transferred to the reaction vessel and dispersion of C. I. Pigment Red 269 and wax was performed by means of a bead mill (Ultra Visco Mill by Aimex Co., Ltd.) in a condition of solution feeding speed of 1 kg/hr, disc rim speed of 6 m/sec., 0.5 mm zirconia bead fill of 80% by volume and 3 passes. Next, 1,324 parts of 65% ethyl acetate solution of [low-molecular polyester 1] was added to obtain a dispersion liquid with one pass using a bead mill of the same condition as above. The dispersion liquid was defined as [pigment and wax dispersion liquid 1].

—Preparation of Oil Phase Compound Liquid—

648 parts of [pigment and wax dispersion liquid 1], 154 parts of [prepolymer 1] and 6.6 parts of [ketimine compound] were put in a container and mixed at 5,000 rpm for 1 minute by using a TK Homomixer (by Primix Corp.) to obtain a [oil phase compound liquid].

—Emulsification and Solvent Removal—

990 parts of water, 80 parts of [fine particle dispersion liquid 1], 40 parts of 48.5% water solution of sodium dodecyl diphenyl ether disulfonate (Eleminol MON-7 by Sanyo Chemical Industries, Ltd.) and 90 parts of ethyl acetate were put in a container and stirred at 3,000 rpm for 1 minute by using a TK homomixer (by Primix Corp.). 809 parts of [oil phase compound liquid 1] was then added to the container and mixed at a rotating speed of 13,000 rpm for 20 minutes to obtain [emulsified slurry 1].

The [emulsified slurry 1] was put in a reaction vessel equipped with stirrer and thermometer and matured at 45° C. for 4 hours after solvents were removed at 30° C. for 8 hours to obtain [dispersed slurry 1]. The obtained [dispersed slurry 1] had a volume average particle diameter of 4.95 μm and a number average particle diameter of 4.45 μm (measured by means of Multisizer II).

—Washing and Drying—

After 100 parts of [emulsified slurry 1] was filtered under reduced pressure, washing and drying were performed as follows.

(1) 300 parts of ion exchange water was added to a filter cake and it was filtered 3 times after mixing at 12,000 rpm for 10 minutes by means of the TK Homomixer to obtain [filter cake 1].

(2) The [filter cake 1] was dried at 45° C. for 48 hours by using an air circulating dryer and screened with a 75 μm-mesh sieve. 100 parts of the obtained powder, 0.7 parts of hydrophobic silica and 0.3 parts of hydrophobic titanium oxide were mixed to obtain a toner base 1. The average degree of circularity of the toner base 1 was 0.96. 100 parts of the obtained toner base 1, 0.7 parts of hydrophobic silica and 0.3 parts of hydrophobic titanium oxide were mixed by means of a Henschel mixer to obtain a toner 1.

Toner Production Example 2-2

A toner base 2 was obtained as similar to Toner Production Example 2-1 except for using salicylic acid metallic complex (E-84 by Orient Chemical Industries, Ltd.) instead of tetraalkylammonium perchlorate used in preparation of oil phase. The average degree of circularity of the toner base 2 was 0.97. 100 parts of the obtained toner base 2, 0.7 parts of hydrophobic silica and 0.3 parts of hydrophobic titanium oxide were mixed by means of a Henschel mixer to obtain a toner 2.

Comparative Toner Production Example 2-1

| | |
|---|---|
| Polyester resin | 83 parts |
| Carnauba wax | 4 parts |
| C.I. Pigment Red 269 | 6 parts |
| tetraalkylammonium perchlorate | 1 part |

The above composition was kneaded, pulverized and classified by using a two-axis extruder to obtain a comparative toner base 1. The average degree of circularity of comparative toner base 1 was 0.89. Next, 100 parts of the comparative toner base 1, 0.5 parts of hydrophobic silica and 0.5 parts of hydrophobic titanium oxide were mixed by means of the Henschel mixer to obtain a comparative toner 1.

The photoconductor and the toner produced as described above were mounted in a magenta unit of a remodeled full-color image forming apparatus (IPSiO CX8200 by Ricoh Company, Ltd.). The power pack of this apparatus was changed for positive charging and negative charging respectively and the light source was changed to laser diode of 780 nm writing wavelength.

10,000 sheets of the image with 5% image density of magenta color were printed out by using the above image forming apparatus as a durability test. A charging roller which is arranged so as to be in contact with the photoconductor was used as a charging unit. Meanwhile, applied voltage was set so that the initial electric potential of the photoconductor was +500V (−500V) at the start of the test and the charging condition remained the same until the end of the test. Moreover, developing bias was set at +350V (−350V). The test was conducted in an environment of 23° C. and 60% RH.

The surface potential of the photoconductor in exposing unit during writing (exposing) of whole area and image quality and thin line reproducibility of output image were evaluated respectively at the start of the test (at beginning) and after completing output of 10,000 images.

<Image Quality>

Image qualities such as change in color tone, background smear, image density and presence or absence of cracks of output images were evaluated. Presence or absence of defects and the rank of image quality were evaluated with eyes and determined by the following evaluation criteria.

5: Image defects are not observed at all and the image is appropriate.

4: Slight change in color tone, image density and background smear are observed as compared with the original image, however, there is no problem for practical use and the image is appropriate.

3: Slight change in color tone, image density and background smear are observed, however, there is no problem for use in general temperature and humidity environment.

2: Change in color tone, image density and background smear are observed to a certain degree.

1: Change in color tone, image density and background smear are notable, posing problems.

<Thin Line Reproducibility>

The evaluation criteria for thin line reproducibility were as follows.

A: Thin lines were appropriately reproduced as compared with thin lines of original image.

B: Reproducibility was not appropriate as compared with thin lines of original image.

The results of evaluation are shown in Table 2-1.

From the result shown in Table 2-1, it turns out that degraded images were not observed, thin line reproducibility were appropriate and obtaining images of extremely high quality was possible in Examples which satisfy the constituent requirement of the present invention. Image defects such as change in color tone, background smear and density degradation occurred in all Comparative Examples which do not satisfy the requirement of the present invention and in addition, thin line reproducibility were not appropriate in some of them.

Examples 3-1 to 3-4

First, the electrophotographic photoconductors used for Examples 3-1 to 3-4 were produced as follow.

Photoconductor for Example 3-1

The following components were mixed and pulverized by means of a ball mill and then applied on an aluminum drum of 100 mm diameter and 360 mm length by dipping, heated and dried to form an intermediate layer of 3.5 μm thickness as a conductive support.

The photoconductor used for Example 3-1 was produced as follow.

First, 30 parts of titanyl phthalocyanine pigment described by the following Pigment Synthetic Example 3-1 as a charge generating material and 970 parts of cyclohexanone were dispersed for 2 hours by means of a ball-mill apparatus to obtain a dispersion liquid of charge generating material.

In addition, 49 parts of polycarbonate resin (Z-Polyca by Teijin Chemicals Ltd., viscosity-average molecular weight=40,000), 20 parts of the charge transporting material expressed by the Structural Formula (3), 29.5 parts of the charge transporting material expressed by the following Structural Formula (14) and 0.1 parts of silicone oil (KF-50-100CS by Shin-etsu Chemical Co., Ltd.) were dissolved in 340 parts of tetrahydrofran and then 66.6 parts of the above

TABLE 2-1

| | | | Electric Potential of Exposing Unit (V) | | Image Quality | | Thin Line Reproducibility | |
|---|---|---|---|---|---|---|---|---|
| | Toner | Photoconductor | At Beginning | After Printing of 10,000 Sheets | At Beginning | After Printing of 10,000 Sheets | At Beginning | After Printing of 10,000 Sheets |
| Example 2-1 | Toner 1 | Photoconductor 1 | +80 | +100 | 5 | 5 | A | A |
| Example 2-2 | Toner 1 | Photoconductor 2 | +70 | +110 | 5 | 5 | A | A |
| Example 2-3 | Toner 2 | Photoconductor 2 | −80 | −100 | 5 | 5 | A | A |
| Example 2-4 | Toner 1 | Photoconductor 3 | +80 | +110 | 5 | 5 | A | A |
| Example 2-5 | Toner 1 | Photoconductor 4 | +70 | +100 | 5 | 5 | A | A |
| Example 2-6 | Toner 1 | Photoconductor 5 | +70 | +110 | 5 | 5 | A | A |
| Example 2-7 | Toner 2 | Photoconductor 5 | −60 | −90 | 5 | 5 | A | A |
| Example 2-8 | Toner 1 | Photoconductor 6 | +90 | +110 | 5 | 5 | A | A |
| Example 2-9 | Toner 2 | Photoconductor 6 | −80 | −110 | 5 | 5 | A | A |
| Comp. Ex. 2-1 | Toner 1 | Comp. Photoconductor 1 | +120 | +160 | 4 | 1 | A | A |
| Comp. Ex. 2-2 | Toner 1 | Comp. Photoconductor 2 | +100 | +150 | 4 | 2 | A | A |
| Comp. Ex. 2-3 | Toner 1 | Comp. Photoconductor 3 | +100 | +160 | 4 | 1 | A | A |
| Comp. Ex. 2-4 | Toner 2 | Comp. Photoconductor 3 | −110 | −160 | 4 | 1 | A | A |
| Comp. Ex. 2-5 | Toner 1 | Comp. Photoconductor 4 | +110 | +160 | 4 | 2 | A | A |
| Comp. Ex. 2-6 | Toner 2 | Comp. Photoconductor 4 | −100 | −150 | 4 | 2 | A | A |
| Comp. Ex. 2-7 | Comp. Toner 1 | Comp. Photoconductor 1 | +110 | +150 | 4 | 1 | B | B |
| Comp. Ex. 2-8 | Comp. Toner 1 | Comp. Photoconductor 2 | +100 | +150 | 4 | 2 | B | B |
| Comp. Ex. 2-9 | Comp. Toner 1 | Comp. Photoconductor 3 | +100 | +160 | 4 | 1 | B | B |

dispersion liquid of charge generating material was added and stirred to prepare a coating liquid for photosensitive layer.

Structural Formula (3)

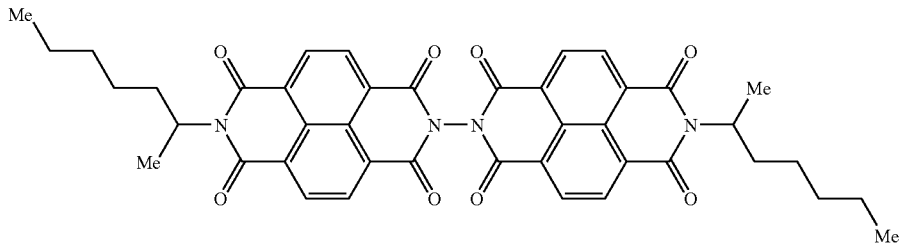

Structural Formula (14)

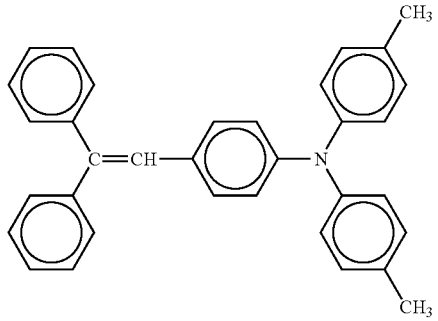

Next, the coating liquid for photosensitive layer was applied on an aluminum drum of 100 mm diameter and 360 mm length by dipping for film forming and dried at 120° C. for 15 minutes.

Meanwhile, the photoconductor was formed at a predetermined elevating speed so as to make the thickness of 24.5 μm and the photoconductor for Example 3-1 was obtained.

Pigment Synthetic Example 3-1

A pigment was produced according to JP-A No. 2001-19871. First, 29.2 g of 1,3-diiminoisoindoline and 200 ml of sulfolane were mixed and 20.4 g of titanium tetrabutoxide was allowed to drip into the mixture under nitrogen airflow. After dripping, a temperature of the mixture was raised gradually to 180° C. and stirred for 5 hours while maintaining the reaction temperature in the range of 170° C. to 180° C. to perform reaction. After reaction was completed, the deposit was filtered after cooling, washed until the fine particles were blue with chloroform, then washed several times with methanol, dried after further washing with hot water of 80° C. to obtain an unprocessed titanyl phthalocyanine. The unprocessed titanyl phthalocyanine was dissolved in 20 times its volume of a concentrated sulfuric acid, allowed to drip into 100 times its volume of ice water while stirring and the deposited crystals were filtered followed by repetitive washing with water until the wash fluid becomes neutral (pH value of ion exchange water after washing was 6.8) to obtain a wet cake (water paste) of titanyl phthalocyanine pigment. 40 g of the obtained wet cake (water paste) was put in 200 g of tetrahydrofran, the mixture was filtered after 4 hours of stirring and dried to obtain titanyl phthalocyanine powder. This was defined as a pigment 1.

The density of solid content of the above wet cake was 15%. The mass ratio of the crystal conversion solvent to the wet cake was 33:0. Meanwhile, halogen compound was not used for raw material of Synthetic Example 1.

The X-ray diffraction spectrum of the obtained titanyl phthalocyanine powder was measured by the following condition and it turns out that the titanyl phthalocyanine powder had a maximum diffraction peak at Bragg angle 2θ relative to a Cu—Kα ray (1.542 Å wavelength) of 27.2±0.2°, additionally had a peak at the lowest angle 7.3±0.2° and had no peaks between the peak at 7.3° and the peak at 9.4°, and at 26.3°.

Measurement Condition of X-ray Diffraction Spectrum

| | |
|---|---|
| X-ray tube: | Cu |
| voltage: | 50 kV |
| Electric Current: | 30 mA |
| Scan Speed: | 2°/min. |
| Scan Range: | 3° to 40° |
| Time Constant: | 2 seconds |

Meanwhile, average particle size in the coating liquid for charge generating layer using the titanyl phthalocyanine was 0.31 μm as measured by means of CAPA-700 by Horiba, Ltd.

Photoconductor for Example 3-2

The photoconductor for Example 3-2 was produced as similar to the photoconductor for Example 3-1 except for using the charge transporting material expressed by the following Structural Formula (4) synthesized by the above procedure instead of the charge transporting material expressed by Structural Formula (3) used for the photoconductor for Example 3-1.

Structural Formula (4)

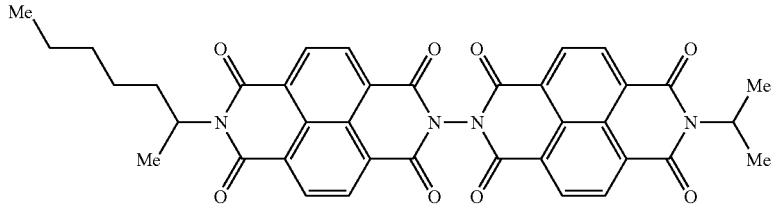

Photoconductor for Example 3-3

The photoconductor for Example 3-3 was produced as similar to the photoconductor for Example 3-1 except for using the charge transporting material expressed by the following Structural Formula (5) synthesized by the above procedure instead of the charge transporting material expressed by Structural Formula (3) used for the photoconductor for Example 3-1.

Structural Formula (5)

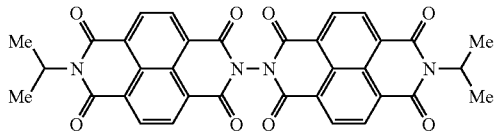

Photoconductor for Example 3-4

The photoconductor for Example 3-4 was produced as similar to the photoconductor for Example 3-1 except for using the charge transporting material expressed by the following Structural Formula (6) synthesized by the above procedure instead of the charge transporting material expressed by Structural Formula (3) used for the photoconductor for Example 3-1.

Structural Formula (6)

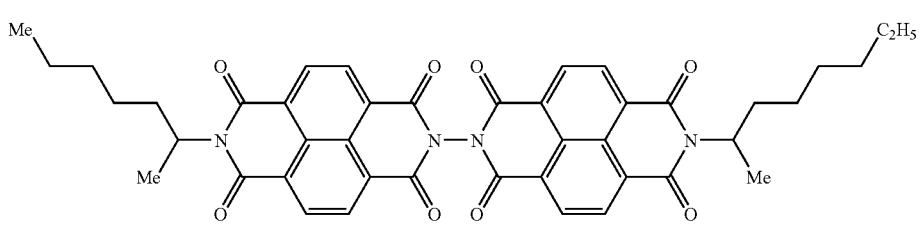

The evaluation of the electrophotographic photoconductors for Examples 3-1 to 3-4 produced as above was conducted by using an image forming apparatus, a digital copier (imagio MF7070 by Ricoh Company, Ltd.) with remodeled drum linear velocity, cleaning unit and power pack.

The brush of cleaning unit had a loop-shaped leading end as shown in FIG. 15 and a brush which was formed by winding and attaching a loop pile brush, which was made of loop-shaped brush woven into a foundation cloth, to the metal cored bar as shown in FIG. 17 was used.

The cross section was set so that the loop-shaped leading end side of the brush was turned to upstream side of the rotation direction of the brush from base side as shown in FIG. 16. And the density of the loop woven into the foundation cloth was 70/cm$^2$.

The rotation direction of the cleaning brush was in the same direction of the photoconductor as it comes in contact with the photoconductor and the linear velocity of the photoconductor was set at 180 mm/sec. and the linear velocity of the fir brush was set at 200 mm/sec. (1.11 times of the photoconductor) and the contact pressure between the cleaning blade and the photoconductor was set at 20 g/cm.

The copying test of 10,000 sheets and 200,000 sheets were conducted by using the above image forming apparatus and evaluation was conducted on the following items.

<Image Quality>

Image degradation including local defects such as solid density, black void, white void, black streak and white streak, and background smear of output images were evaluated comprehensively and the result was classified into three stages: "good", "slightly degraded" and "no good".

<Electric Potential in the Apparatus (Electric Potential of Exposing Unit>

The electric potential of exposing unit when charging potential was −800V was evaluated.

<Cleaning Defects of Photoconductor>

The presence or absence of residual toner on photoconductor surface after transferring was evaluated after copying test.

When cleaning was sufficiently performed and residual toner after transferring was not observed, it was marked as "A" and when cleaning defects occurred and residual toner after transferring was observed, it was marked as "B".

<Scratch on Photoconductor Surface>

The photoconductor surface after copying test was observed for scratch by using a laser microscope (VK-8500 by Keyence Corp.) and when there was no notable scratch, it was marked as "A", when there were scratches observed by the microscope which did not appear on the image, it was marked as "B" and when large and deep scratches which would appear on the image were observed, it was marked as "C".

These evaluation results are shown in the following Table 3-1.

TABLE 3-1

| | After Copying of 10,000 Sheets | | | | After Copying of 200,000 Sheets | | | |
|---|---|---|---|---|---|---|---|---|
| | Image Quality | Electric Potential of Exposing Unit (−V) | Cleaning Defects of Photoconductor | Scratch on Photoconductor Surface | Image Quality | Electric Potential of Exposing Unit (−V) | Cleaning Defects of Photoconductor | Scratch on Photoconductor Surface |
| Example 3-1 | good | 115 | A | A | good | 130 | A | A |
| Example 3-2 | good | 130 | A | A | good | 145 | A | A |
| Example 3-3 | good | 140 | A | A | good | 155 | A | A |
| Example 3-4 | good | 120 | A | A | good | 135 | A | A |

Example 3-5

The evaluation of Example 3-5 was conducted as similar to the evaluation of Example 3-1 except for the rotation direction of the cleaning brush which was set in the counter direction of the photoconductor as it comes in contact with the photoconductor and the linear velocity of the photoconductor was set at 180 mm/sec. whereas the linear velocity of the brush was set as 180 mm/sec. (360 mm/sec. relative linear velocity).

Example 3-6

The evaluation of Example 3-6 was conducted as similar to the evaluation of Example 3-1 except for changing the contact pressure between the cleaning blade of the cleaning unit and the photoconductor to 10 g/cm.

Example 3-7

The evaluation of Example 3-7 was conducted as similar to the evaluation of Example 3-1 except for changing the contact pressure between the cleaning blade of the cleaning unit and the photoconductor to 15 g/cm.

Example 3-8

The evaluation of Example 3-8 was conducted as similar to the evaluation of Example 3-1 except for changing the contact pressure between the cleaning blade of the cleaning unit and the photoconductor to 30 g/cm.

Example 3-9

The evaluation of Example 3-9 was conducted as similar to the evaluation of Example 3-1 except for changing the contact pressure between the cleaning blade of the cleaning unit and the photoconductor to 40 g/cm.

Example 3-10

The evaluation of Example 3-10 was conducted as similar to the evaluation of Example 3-1 except for changing the direction of the cleaning blade in the cleaning, unit in a way so that the cleaning blade comes in contact with the photoconductor in the same direction of the rotation direction (trail direction) of the photoconductor instead of the counter direction as was in Example 3-1.

The evaluation result of Examples 3-5 to 3-10 are shown in Table 3-2 as similar to Table 3-1.

TABLE 3-2

| | After Copying of 10,000 Sheets | | | | After Copying of 200,000 Sheets | | | |
|---|---|---|---|---|---|---|---|---|
| | Image Quality | Electric Potential of Exposing Unit (−V) | Cleaning Defects of Photoconductor | Scratch on Photoconductor Surface | Image Quality | Electric Potential of Exposing Unit (−V) | Cleaning Defects of Photoconductor | Scratch on Photoconductor Surface |
| Example 3-5 | good | 120 | A | A | good | 130 | A | A |
| Example 3-6 | good | 120 | A | A | good | 135 | A | A |
| Example 3-7 | good | 120 | A | A | good | 130 | A | A |
| Example 3-8 | good | 120 | A | A | good | 135 | A | A |
| Example 3-9 | good | 120 | A | A | good | 140 | A | A |
| Example 3-10 | good | 120 | A | A | good | 135 | A | A |

Comparative Examples 3-1 to 3-3

The electrophotographic photoconductors used for Comparative Examples 3-1 to 3-3 were produced as follows.

Photoconductor for Comparative Example 3-1

The photoconductor for Comparative Example 3-1 was produced as similar to the photoconductor for Example 3-1 except for using the charge transporting material expressed by the following Structural Formula (13) instead of the charge transporting material expressed by Structural Formula (3) used for the photoconductor for Example 3-1.

Structural Formula (13)

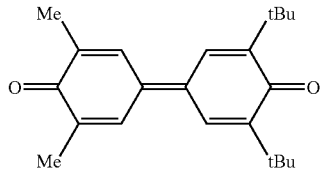

Photoconductor for Comparative Example 3-2

The photoconductor for Comparative Example 3-2 was produced as similar to the photoconductor for Example 3-1 except for using the charge transporting material expressed by the following Structural Formula (15) instead of the charge transporting material expressed by Structural Formula (3) used for the photoconductor for Example 3-1.

Structural Formula (15)

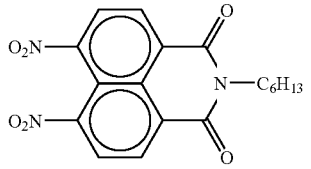

Photoconductor for Comparative Example 3-3

The photoconductor for Comparative Example 3-3 was produced as similar to the photoconductor for Example 3-1 except for using the charge transporting material expressed by the following Structural Formula (16) instead of the charge transporting material expressed by Structural Formula (3) used for the photoconductor for Example 3-1.

Structural Formula (16)

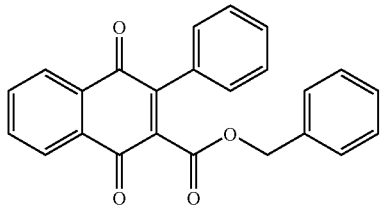

The evaluation of electrophotographic photoconductors for Comparative Examples 3-1 to 3-3 as produced above was conducted as similar to the evaluation of Example 3-1.

The results of the above evaluation are shown in the following Table 3-3.

TABLE 3-3

| | After Copying of 10,000 Sheets | | | | After Copying of 200,000 Sheets | | | |
|---|---|---|---|---|---|---|---|---|
| | Image Quality | Electric Potential of Exposing Unit (−V) | Cleaning Defects of Photoconductor | Scratch on Photoconductor Surface | Image Quality | Electric Potential of Exposing Unit (−V) | Cleaning Defects of Photoconductor | Scratch on Photoconductor Surface |
| Comp. Ex. 3-1 | no good | uncharged | A | A | discontinued after 10,000 sheets | | | |
| Comp. Ex. 3-2 | no good | 300 | A | A | discontinued after 10,000 sheets | | | |
| Comp. Ex. 3-3 | no good | 485 | A | A | discontinued after 10,000 sheets | | | |

Comparative Example 3-4

The evaluation was conducted as similar to Example 3-1 except for not installing a brush in the cleaning unit.

Comparative Example 3-5

The evaluation was conducted as similar to Example 3-1 except for turning the looped leading end of the brush in the cleaning unit toward downstream side of the rotating direction of the brush from the base.

Comparative Example 3-6

The evaluation was conducted as similar to Example 3-1 except for using a leiotrichous brush with a uniform length from the brush base in the cleaning unit instead of the brush with looped leading end as used in Example 3-1.

Comparative Example 3-7

The evaluation was conducted as similar to Example 3-1 except for using a leiotrichous brush with nonuniform length from the brush base in the cleaning unit instead of the brush with looped leading end as used in Example 3-1.

The results of above evaluation are shown in the following Table 3-4.

TABLE 3-4

| | After Copying of 10,000 Sheets | | | | After Copying of 200,000 Sheets | | | |
|---|---|---|---|---|---|---|---|---|
| | Image Quality | Electric Potential of Exposing Unit (−V) | Cleaning Defects of Photoconductor | Scratch on Photoconductor Surface | Image Quality | Electric Potential of Exposing Unit (−V) | Cleaning Defects of Photoconductor | Scratch on Photoconductor Surface |
| Comp. Ex. 3-4 | no good | 125 | C | A | discontinued after 10,000 sheets | | | |
| Comp. Ex. 3-5 | slightly degraded | 120 | C | B | no good | 140 | C | C |
| Comp. Ex. 3-6 | good | 125 | A | A | no good | 150 | C | A |
| Comp. Ex. 3-7 | good | 120 | A | A | no good | 160 | C | B |

From the above results, it turns out that when the image forming apparatus which satisfies the requirement of the present invention was used, resulted images were of high quality and durability whereas when the image forming apparatus which did not satisfy the requirement of the present invention was used as in Comparative Examples, image quality was degraded during repetitive use and sufficient durability cannot be obtained.

Example 4-1

First, coating liquids for undercoat layer, charge generating layer and charge transporting layer of the following compositions were prepared.

Production Example of Coating Liquid for Undercoat Layer 4-1

| | |
|---|---|
| alkyd resin (Beckozol M6401-50 by Dainippon Ink and Chemicals, Inc.) | 60 parts |
| melamine resin (Super Beckamine L-121-60 by Dainippon Ink and Chemicals, Inc.) | 40 parts |
| titanium oxide (CR-EL by Ishihara Sangyo Kaisha, Ltd.) | 400 parts |
| methyl ethyl ketone | 500 parts |

The above materials were subject to ball milling for 5 days by means of a ball mill apparatus (an alumina ball of 10 mm diameter was used as media) to prepare a coating liquid for undercoat layer.

Production Example of Coating Liquid for Charge Generating Layer 4-1

| | |
|---|---|
| metal-free phthalocyanine pigment (Fastogen Blue 8120B by Dainippon Ink and Chemicals, Inc.) | 12 parts |
| polyvinylbutyral resin (S-LEC BX-1 by Sekisui Chemical Co., Ltd.) | 5 parts |
| 2-butanone | 200 parts |
| cyclohexanone | 400 parts |

These materials were dispersed in a glass pot of 9 cm diameter at a rotation frequency of 100 rpm for 5 hours by using PSZ ball of 0.5 mm diameter to prepare a coating liquid for charge generating layer.

Production Example of Coating Liquid for Charge Transporting Layer 4-1

| | |
|---|---|
| charge transporting material expressed by the following Structural Formula (3) | 10 parts |
| Z-type polycarbonate resin (Panlite ® TS-2050 by Teijin Chemicals Ltd.) | 10 parts |
| silicone oil (KF50 by Shin-etsu Chemical Co., Ltd.) | 0.01 part |
| tetrahydrofran | 80 parts |

Structural Formula (3)

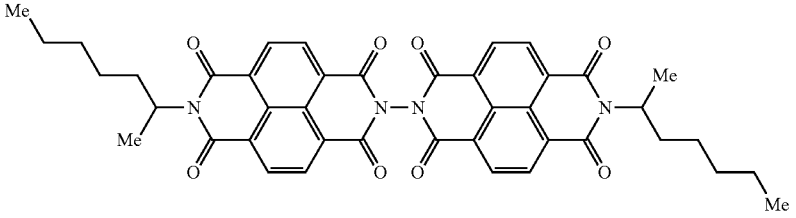

The above materials were stirred and dissolved to prepare a coating liquid for charge transporting layer.

Production Example of Coating Liquid for Protective Layer 4-1

| | |
|---|---|
| perfluoroalkoxy resin particle (PFA) (MPE-056 by Dupont-Mitsui Fluorochemicals Company, Ltd.) | 3.3 parts |
| dispersion auxiliary agent (Modiper ® F210 by NOF Corp.) | 1.0 part |
| antioxidant | 0.2 parts |
| polycarbonate resin (Z-Polyca by Teijin Chemicals Ltd.) | 6.4 parts |
| tetrahydrofran | 200 parts |
| cyclohexanone | 60 parts |

The above materials were circulated in a high-speed fluid collision dispersing apparatus (Ultimaizer HJP-25005 by Sugino Machine Ltd.) under a pressure of 100 MPa for 30 minutes and then irradiated with an ultrasonic wave for 10 minutes for adjustment to prepare a coating liquid for protective layer.

Next, the coating liquids for undercoat layer, charge generating layer and charge transporting layer were applied sequentially on an aluminum drum of 30 mm diameter and 340 mm length by dipping and dried to form an undercoat layer of 4.5 μm thickness, a charge generating layer of 0.15 μm thickness and a charge transporting layer of 20 μm thickness.

The coating liquid for protective layer was then applied on the charge transporting layer by spraying (spray gun: PIECE COM PC308 by OLYMPOS, air pressure: 2 kgf/cm$^2$) to form a protective layer of 5 μm thickness and the photoconductor 4-1 of Example 4-1 was produced. The drying conditions for each layer were 135° C. for 20 minutes, 80° C. for 15 minutes, 120° C. for 20 minutes and 130° C. for 30 minutes respectively.

Example 4-2

Production of Photoconductor 4-2

A pigment dispersion liquid was prepared by dispersing metal-free phthalocyanine with the following composition and condition.

| | |
|---|---|
| metal-free phthalocyanine pigment (Fastogen Blue 8120B by Dainippon Ink and Chemicals, Inc.) | 3 parts |
| cyclohexanone | 97 parts |

The above materials were put in a glass pot of 9 cm diameter and dispersed at a rotation frequency of 100 rpm for 5 hours by using PSZ ball of 0.5 mm diameter.

The coating liquid for photoconductor of the following composition was prepared by using the above dispersion liquid.

| | |
|---|---|
| above dispersion liquid | 60 parts |
| hole transporting material expressed by Structural Formula (14) | 30 parts |
| charge transporting material expressed by Structural Formula (3) | 20 parts |
| z-type polycarbonate resin (Panlite ® TS-2050 by Teijin Chemicals Ltd.) | 50 parts |
| silicone oil (KF50 by Shin-etsu Chemical Co., Ltd.) | 0.01 part |
| tetrahydrofran | 350 parts |

Structural Formula (14)

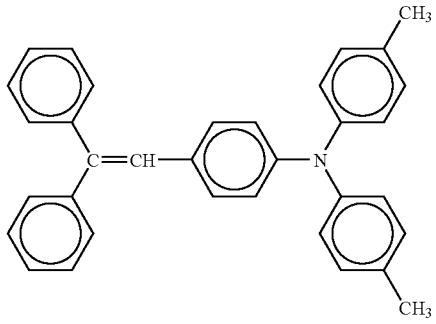

The coating liquid for photosensitive layer obtained as above was applied on an aluminum drum of 30 mm diameter and 340 mm length by dipping and dried at 120° C. for 20 minutes to form a photosensitive layer of 20 μm thickness and a protective layer as similar to the one in Example 4-1 was then formed on the photosensitive layer to produce the photoconductor 4-2 of Example 4-2.

Example 4-3

The photoconductor 4-3 of Example 4-3 was produced as similar to Example 4-1 except for using titanyl phthalocyanine prepared according to the following Pigment Synthetic Example 4-1 as a charge generating material instead of X-type metal-free phthalocyanine (Fastogen Blue 8120B) as used in Example 4-1.

Pigment Synthetic Example 4-1

A pigment was prepared according to the method stated in production examples of JP-A No. 2-8256 (Japanese Patent Application Publication (JP-B) No. 7-91486).

First, 9.8 g of phthalodinitrile and 75 ml of 1-chloronaphthalene were stir-mixed and the mixture was allowed to drip into 2.2 ml of titanium tetracholoride under nitrogen airflow. After dripping, it was then raised gradually to a temperature of 200° C. and stirred for 3 hours for reaction while maintaining the reaction temperature between 200° C. and 220° C.

After reaction was completed, it was cooled to a temperature of 130° C. and filtered in a hot condition, washed until the fine particles were blue with 1-chloronaphthalene, washed several times with methanol and dried after washing with hot water of 80° C. for several times to obtain a pigment.

The X-ray diffraction spectrum of the obtained titanyl phthalocyanine powder was measured by the following condition and it turns out that the spectrum of the obtained titanyl phthalocyanine powder was the same as the one disclosed in JP-A No. 2-8256 (JP-B No. 7-91486).

Measurement Condition of X-ray Diffraction Spectrum

| | |
|---|---|
| X-ray tube: | Cu |
| Voltage: | 50 kV |
| Electric Current: | 30 mA |
| Scan Speed: | 2°/min. |
| Scan Range: | 3° to 40° |
| Time Constant: | 2 seconds |

Example 4-4

The photoconductor 4-4 of Example 4-4 was produced as similar to Example 4-1 except for using titanyl phthalocyanine prepared according to the above Pigment Synthetic Example 4-1 as a charge generating material instead of X-type metal-free phthalocyanine (Fastogen Blue 8120B) as used in Example 4-2.

Example 4-5

The photoconductor 4-5 of Example 4-5 was produced as similar to Example 4-1 except for using titanyl phthalocyanine prepared according to the following Pigment Synthetic Example 4-2 as a charge generating material instead of X-type metal-free phthalocyanine (Fastogen Blue 8120B) as used in Example 4-1.

Pigment Synthetic Example 4-2

A pigment was produced according to JP-A No. 2001-19871. First, 29.2 g of 1,3-diiminoisoindoline and 200 ml of sulfolane were mixed and 20.4 g of titanium tetrabutoxide was allowed to drip into the mixture under nitrogen airflow.

After dripping, a temperature of the mixture was raised gradually to 180° C. and stirred for 5 hours while maintaining the reaction temperature in the range of 170° C. to 180° C. to perform reaction.

After reaction was completed, the deposit was filtered after cooling, washed until the fine particles were blue with chloroform, washed several times with methanol, dried after further washing with hot water of 80° C. to obtain an unprocessed titanyl phthalocyanine. The unprocessed titanyl phthalocyanine was dissolved in 20 times its volume of a concentrated sulfuric acid, allowed to drip into 100 times its volume of ice water while stirring and the deposited crystals were filtered followed by repetitive washing with water until the wash fluid becomes neutral to obtain a wet cake (water paste) of titanyl phthalocyanine pigment.

2 g of the obtained wet cake (water paste) was put in 20 g of tetrahydrofran, the mixture was filtered after 4 hours of stirring and dried to obtain titanyl phthalocyanine powder. (This was defined as a pigment 1.)

The X-ray diffraction spectrum of the obtained titanyl phthalocyanine powder was measured by the condition of Pigment Synthetic Example 1 and it turns out that the titanyl phthalocyanine powder had a maximum diffraction peak at least at 27.2° as a diffraction peak at Bragg angle 2θ (±0.2°) relative to a Cu—Kα ray (1.542 Å wavelength), additionally had main peaks at 9.4°, 9.6° and 24.0°, a peak at 7.3° as a diffraction peak at the lowest angle and had no peaks between the peak at 7.3° and the peak at 9.4°.

Example 4-6

The photoconductor 4-6 of Example 4-6 was produced as similar to Example 4-2 except for using titanyl phthalocyanine prepared according to the above Pigment Synthetic Example 4-2 as a charge generating material instead of X-type metal-free phthalocyanine (Fastogen Blue 8120B) as used in Example 4-2.

The charge transporting material expressed by the above Structural Formula (3) was produced by the following method.

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux.

A mixture containing 2.14 g (18.6 mmol) of 2-aminoheptane and 25 ml of N,N-dimethylformamide (DMF) were allowed to drip into the flask while stirring.

After dripping, it was heated to reflux for 6 hours. After reaction was completed, the container was cooled and then condensed under reduced pressure. Toluene was added to the residue and it was purified by silica gel column chromatography.

The recovered product was further recrystallized with toluene/hexane to obtain 2.14 g (yield: 31.5%) of monoimide A.

—Second Step—

2.0 g (5.47 mmol) of monoimide A, 0.137 g (2.73 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.668 g (yield: 33.7%) of the compound expressed by the above Structural Formula (3).

Example 4-7

The photoconductor 4-7 of Example 4-7 was produced as similar to Example 4-1 except for using the charge transporting material expressed by the following Structural Formula (4) instead of the one used in Example 4-5.

Structural Formula (4)

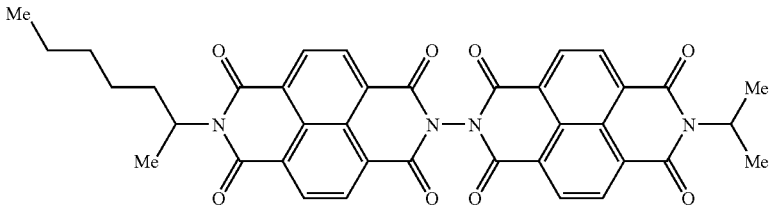

Example 4-8

The photoconductor 4-8 of Example 4-8 was produced as similar to Example 4-1 except for using the charge transporting material expressed by the above Structural Formula (4) instead of the one used in Example 4-6.

The charge transporting material expressed by the above Structural Formula (4) was obtained by the following method.

—First Step—

First, 10 g (37.3 mmol) of 1,4,5,8-naphthalenetetracarboxylic acid dianhydride, 0.931 g (18.6 mmol) of hydrazine monohydrate, 20 mg of p-toluenesulfonic acid and 100 ml of toluene were put in a 4-necked flask of 200 ml and heated to reflux for 5 hours.

After reaction was completed, the container was cooled and then condensed under reduced pressure. The residue was purified by silica gel column chromatography. The recovered product was further recrystallized with toluene/ethyl acetate to obtain 2.84 g (yield: 28.7%) of dimer C.

—Second Step—

2.5 g (4.67 mmol) of dimer C and 30 ml of N,N-dimethylformamide (DMF) were put in a 4-necked flask of 100 ml and heated to reflux. A mixture containing 0.278 g (4.67 mmol) of 2-aminopropane and 10 ml of N,N-dimethylformamide (DMF) were allowed to drip into the flask while stirring.

After dripping, it was then heated to reflux for 6 hours. After reaction was completed, the container was cooled and condensed under reduced pressure. Toluene was added to the residue and it was purified by silica gel column chromatography to obtain 0.556 g (yield: 38.5% by mass) of monoimide C.

—Third Step—

0.50 g (1.62 mmol) of monoimide C and 10 ml of N,N-dimethylformamide (DMF) were put in a 4-necked flask of 50 ml and heated to reflux. A mixture containing 0.186 g (1.62 mmol) of 2-aminoheptane and 5 ml of N,N-dimethylformamide (DMF) were allowed to drip into the flask while stirring.

After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.243 g (yield: 22.4% by mass) of the charge transporting material expressed by the above Structural Formula (4).

Example 4-9

The photoconductor 4-9 of Example 4-9 was produced as similar to Example 4-1 except for using the charge transporting material expressed by the following Structural Formula (5) instead of the one used in Example 4-5.

Structural Formula (5)

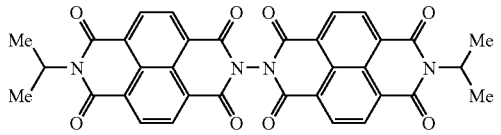

Example 4-10

The photoconductor 4-10 of Example 4-10 was produced as similar to Example 4-1 except for using the charge transporting material expressed by the above Structural Formula (5) instead of the one used in Example 4-6.

The charge transporting material expressed by the above Structural Formula (5) was produced by the following method.

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.10 g (18.6 mmol) of 2-aminopropane and 50 ml of N,N-dimethylformamide (DMF) were allowed to drip into the flask while stirring. After dripping, it was heated to reflux for 6 hours.

After reaction was completed, the container was cooled and then condensed under reduced pressure.

Toluene was added to the residue and it was purified by silica gel column chromatography. The recovered product was further recrystallized with toluene/hexane to obtain 2.08 g (yield: 36.1%) of monoimide B.

—Second Step—

2.0 g (6.47 mmol) of monoimide B, 0.162 g (3.23 mmol) of hydrazine monohydrate, 10 mg of p-toluenesulfonic acid and 50 ml of toluene were put in a 4-necked flask of 100 ml and heated to reflux for 5 hours.

After reaction was completed, the container was cooled and condensed under reduced pressure. The residue was purified by silica gel column chromatography. The recovered product was further recrystallized with toluene/ethyl acetate to obtain 0.810 g (yield: 37.4%) of the charge transporting material expressed by the above Structural Formula (5).

Example 4-11

The photoconductor 4-11 of Example 4-11 was produced as similar to Example 4-1 except for changing the fluorine resin particle used in Example 4-5 to perfluoroalkoxy resin particle as a polytetrafluoroethylene resin particle (PTFE).

Example 4-12

The photoconductor 4-12 of Example 4-12 was produced as similar to Example 4-1 except for changing the fluorine resin particle used in Example 4-6 to perfluoroalkoxy resin particle as a polytetrafluoroethylene resin particle (PTFE).

Comparative Example 4-1

The photoconductor 4-13 of Comparative Example 4-1 was produced as similar to Example 4-1 except for using the charge transporting material expressed by the following Structural Formula (16) instead of the one used in Example 4-5.

Structural Formula (16)

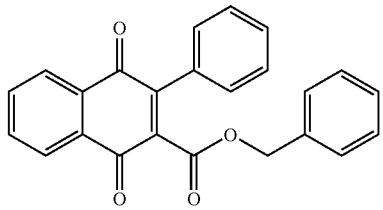

Comparative Example 4-2

The photoconductor 4-14 of Comparative Example 4-2 was produced as similar to Example 4-1 except for using the charge transporting material expressed by the above Structural Formula (16) instead of the one used in Example 4-6.

Comparative Example 4-3

The photoconductor 4-15 of Comparative Example 4-3 was produced as similar to Example 4-1 except for using the charge transporting material expressed by the following Structural Formula (17) instead of the one used in Example 4-5.

Structural Formula (17)

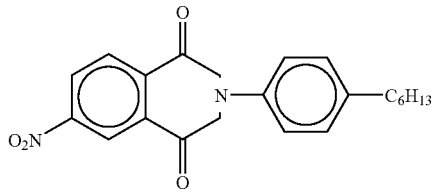

Comparative Example 4-4

The photoconductor 4-16 of Comparative Example 4-4 was produced as similar to Example 4-1 except for using the charge transporting material expressed by the above Structural Formula (17) instead of the one used in Example 4-6.

Comparative Example 4-5

The photoconductor 4-17 of Comparative Example 4-5 was produced as similar to Example 4-1 except for not adding perfluoroalkoxy resin particle to the protective layer as in Example 4-5.

Comparative Example 4-6

The photoconductor 4-18 of Comparative Example 4-6 was produced as similar to Example 4-1 except for not adding perfluoroalkoxy resin particle to the protective layer as in Example 4-6.

<Evaluation 1>

The coefficients of surface friction for produced photoconductors 4-1 to 4-18 were evaluated by using an Euler belt method disclosed in JP-A No. 9-166919. The belt in this case was a medium-thick quality paper extended along ¼ of circumference of the photoconductor so as for the direction of paper fiber to be in a longitudinal direction as shown in FIG. 19 and a load of W=100 g was applied on one side of the belt, a force gauge (spring scale) was set on the other side, movement of the belt was observed while the force gauge was being pulled gradually and the load at the time when the movement was started was read to calculate by the following equation.

Figure 19:
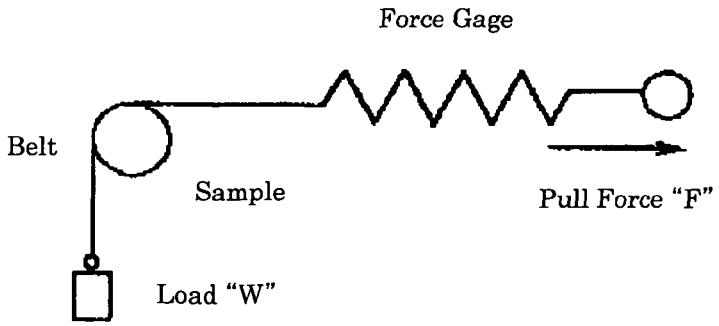
FIG. 19 is an explanatory diagram showing a method for evaluating surface friction coefficient using Euler belt.

The specification of FIG. 19 is as follows:

Load: 100 g weight,

Belt: Type 6200, T-grid, A4 size paper, 30 mm width (cut in a direction of paper fiber)

Number of used double clips: 2

In the following equation, "μ" represents a friction coefficient, "F" represents a tension force and "W" represents a load.

$$\mu=2/\pi\times\ln(F/W)\quad W=100\text{ g}$$

<Evaluation 2>

The produced photoconductors 4-1 to 4-18 were mounted in a remodeled laser printer by Ricoh Company, Ltd. wherein charging device was a scorotron which was reformed for positive charging, LD wavelength was set at 780 nm and the toner produced by the following Toner Production Example 1 was used, and the printing durability test of sequencing 30,000 sheets using a chart paper with 5% black solid portion was conducted.

The evaluation of the images and electric potential of exposed area were conducted before and after the test.

Image evaluation: Images for evaluation were printed and image disturbance due to cleaning defects of the toner, background smear, fog and image density were observed with eyes.

The images were evaluated in 4 stages and images in excellent state were marked as "A", appropriate images were marked as "B", slightly degraded images were marked as "C" and inappropriate images were marked as "D".

Electric potential of exposed area: Surface potential of the photoconductor at the time when the surface was exposed (entire exposure) and moved to the position in the developing unit after primary charging.

Toner Production Example 4-1

(1) Preparation of Monomer Composition

| | |
|---|---|
| styrene monomer | 70 parts |
| n-butyl methacrylate | 30 parts |
| polystyrene | 5 parts |
| zinc salt of 3,5-di-tert-butyl salicylic acid | 2 parts |
| carbon black | 6 parts |

The mixture of above polymerizable monomers were dispersed and mixed for 24 hours by using a ball mill to prepare a monomer composition.

(2) Granulation and Polymerization

First, 400 ml of 2% polyvinyl alcohol solution was put in a flask equipped with stirrer, thermometer, inactive gas introducing tube and poromeric glass tube with a size of 10ϕ×50 mm, a pore diameter of 110,000 unit and a pore volume of 0.42 cc/g and stirred under nitrogen gas flow at a room temperature to substitute oxygen in the reaction vessel with nitrogen.

Next, 1.56 g of azobisisobutylnitrile was added to 113 g of the monomer composition obtained in (1) and dissolved by stirring and the mixture was passed through the poromeric glass tube by using a pump to be added into polyvinyl alcohol solution. After adding, the mixture of polyvinyl alcohol and monomer composition was circulated at a rate of approximately 120 ml/min. for 2 hours by using the pump and poromeric glass tube and then polymerized at 70° C. for 8 hours.

After the mixture was cooled to a room temperature and left undisturbed for one night, clear supernatant liquid was removed and after water was added and stirred for 1 hour, it was then filtered and dried to obtain a toner. When the particle diameter of the toner was measured by means of a Coulter counter, average particle diameter was approximately 8.5 μm and the particle size distribution was notably narrow with particles having a diameter in the range of 5 μm to 0 μm dominating 95% of the entire particles. The degree of circularity of the toner was 0.98.

The results of Evaluation 1 and 2 are shown in Tables 4-1 and 4-2.

In contrast, degraded images due to increase in electric potential of exposed area of the photoconductor and cleaning defects of the toner were observed after repetitive use in Comparative Examples 4-1 to 4-6 which do not satisfy the requirement of the present invention.

TABLE 4-1

| | | | | | Electric Potential of Exposed Area (V) | | | Image Evaluation | | |
|---|---|---|---|---|---|---|---|---|---|---|
| | | Photosensitive Layer Composition | Charge Transporting Material | Fluorine Resin Particle | Surface coefficient of friction | At Beginning | After printing of 30,000 sheets | Surface coefficient of friction | At Beginning | After printing of 30,000 sheets |
| Example 4-1 | Photoconductor 1 | multilayer | Structural Formula (3) | PFA | 0.18 | 100 | 110 | 0.23 | A | B |
| Example 4-2 | Photoconductor 2 | single layer | Structural Formula (3) | PFA | 0.19 | 90 | 110 | 0.22 | A | B |
| Example 4-3 | Photoconductor 3 | multilayer | Structural Formula (3) | PFA | 0.21 | 110 | 120 | 0.26 | A | B |
| Example 4-4 | Photoconductor 4 | single layer | Structural Formula (3) | PFA | 0.21 | 110 | 120 | 0.25 | A | B |
| Example 4-5 | Photoconductor 5 | multilayer | Structural Formula (3) | PFA | 0.18 | 100 | 130 | 0.24 | A | B |
| Example 4-6 | Photoconductor 6 | single layer | Structural Formula (3) | PFA | 0.18 | 100 | 120 | 0.25 | A | B |
| Example 4-7 | Photoconductor 7 | multilayer | Structural Formula (4) | PFA | 0.19 | 110 | 130 | 0.23 | A | B |
| Example 4-8 | Photoconductor 8 | single layer | Structural Formula (4) | PFA | 0.19 | 100 | 130 | 0.25 | A | B |
| Example 4-9 | Photoconductor 9 | multilayer | Structural Formula (5) | PFA | 0.18 | 110 | 130 | 0.24 | A | B |

TABLE 4-2

| | | | | | Electric Potential of Exposed Area (V) | | | Image Evaluation | | |
|---|---|---|---|---|---|---|---|---|---|---|
| | | Photosensitive Layer Composition | Charge Transporting Material | Fluorine Resin Particle | Surface coefficient of friction | At Beginning | After printing of 30,000 sheets | Surface coefficient of friction | At Beginning | After printing of 30,000 sheets |
| Example 4-10 | Photoconductor 10 | single layer | Structural Formula (5) | PFA | 0.19 | 110 | 120 | 0.24 | A | B |
| Example 4-11 | Photoconductor 11 | multilayer | Structural Formula (3) | PTFE | 0.18 | 100 | 130 | 0.25 | A | B |
| Example 4-12 | Photoconductor 12 | single layer | Structural Formula (3) | PTFE | 0.22 | 100 | 120 | 0.24 | A | B |
| Comp. Ex. 4-1 | Photoconductor 13 | multilayer | Structural Formula (16) | PFA | 0.20 | 120 | 200 | 0.23 | A | C |
| Comp. Ex. 4-2 | Photoconductor 14 | single layer | Structural Formula (16) | PFA | 0.21 | 110 | 200 | 0.25 | A | C |
| Comp. Ex. 4-3 | Photoconductor 15 | multilayer | Structural Formula (17) | PFA | 0.19 | 140 | 220 | 0.26 | B | C |
| Comp. Ex. 4-4 | Photoconductor 16 | single layer | Structural Formula (17) | PFA | 0.19 | 150 | 200 | 0.25 | B | C |
| Comp. Ex. 4-5 | Photoconductor 17 | multilayer | Structural Formula (3) | none | 0.42 | 100 | 130 | 0.60 | A | D |
| Comp. Ex. 4-6 | Photoconductor 18 | single layer | Structural Formula (3) | none | 0.45 | 100 | 120 | 0.58 | A | D |

From the results shown in Tables 4-1 and 4-2, it turns out that the properties of the photoconductors of the Examples 4-1 to 4-12 which satisfy the requirement of the present invention are stable even when used repeatedly and it is possible to produce high quality images for prolonged period without causing image degradation caused by cleaning defects of the toner on the photoconductor surface or toner filming or fusion on the electrophotographic photoconductor.

Example 5-1

Preparation of Electrophotographic Photoconductor

First, coating liquids for undercoat layer, charge generating layer and charge transporting layer of the following compositions were prepared.

—Coating Liquid for Undercoat Layer—

The following materials including resins were subject to ball milling for 5 days by means of a ball mill apparatus (an alumina ball of 10 mm diameter was used as media) to prepare a coating liquid for undercoat layer.

| | |
|---|---|
| alkyd resin (Beckozol M6401-50 by Dainippon Ink and Chemicals, Inc.) | 11 parts |
| melamine resin (Super Beckamine G-821-60 by Dainippon Ink and Chemicals, Inc.) | 6 parts |
| Titanium oxide (CR-EL by Ishihara Sangyo Kaisha, Ltd.) | 48 parts |
| methyl ethyl ketone | 185 parts |

—Coating Liquid of Charge Generating Layer—

The following materials including resins were subject to ball milling for 120 minutes by means of a bead mill disperser (PSZ ball of 0.5 mm diameter was used as media) and mixed to prepare a coating liquid for charge generating layer.

| | |
|---|---|
| metal-free phthalocyanine pigment (Fastogen Blue 8120B by Dainippon Ink and Chemicals, Inc.) | 14 parts |
| polyvinylbutyral (BX-1 by Sekisui Chemical Co., Ltd.) | 9 parts |
| cyclohexanone | 270 parts |

—Coating Liquid for Charge Transporting Layer—

The following materials including resins were stirred and dissolved to prepare a coating liquid for charge transporting layer.

| | |
|---|---|
| charge transporting material expressed by the above Structural Formula (3) | 9 parts |
| polycarbonate resin (Z-Polyca by Teijin Chemicals Ltd., viscosity-average molecular weight = 50,000) | 10 parts |
| tetrahydrofran | 120 parts |
| 1% silicone oil tetrahydrofran solution (KF50-100CS by Shin-etsu Chemical Co., Ltd.) | 1 part |

Next, the coating liquids for undercoat layer, charge generating layer and charge transporting layer were applied sequentially on an aluminum drum (a drum with a circumferential run-out of within 20 μm which has been selected in advance) of 30 mm diameter and 340 mm length by dipping and dried respectively at 135° C. for 20 minutes, at 80° C. for 15 minutes and at 120° C. for 20 minutes. The elevating speed was set so as to form an undercoat layer of 3.5 μm thickness, a charge generating layer of 0.15 μm thickness and a charge transporting layer of 24.3 μm thickness.

The charge transporting material expressed by the above Structural Formula (3) was prepared by the following method.

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 2.14 g (18.6 mmol) of 2-aminoheptane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 2.14 g (yield: 31.5%) of monoimide A.

—Second Step—

2.0 g (5.47 mmol) of monoimide A, 0.137 g (2.73 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.668 g (yield: 33.7%) of the charge transporting material expressed by Structural Formula (3). A peak at M/z=726 was observed in mass analysis (FD-MS) and it was identified as the target. The calculated values of element analysis were carbon 69.41%, hydrogen 5.27% and nitrogen 7.71% whereas the observed values were carbon 69.52%, hydrogen 5.09% and nitrogen 7.93%.

Structural Formula (3)

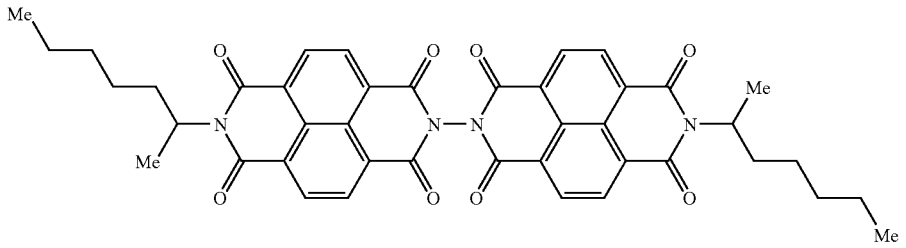

Flanges were fitted to the openings of both ends of the support in the photoconductor prepared as above and circular holes of 7.8 mm diameter were disposed in the center of each flange and a stainless steel shaft of 7.8 mm diameter which run through inside of the photoconductor and each flange were attached to produce the photoconductor for Example 5-1.

The photoconductor for Example 5-1 as produced above was mounted in a remodeled IPSiO Color8100 by Ricoh Company, Ltd. wherein the power pack was changed for positive charging and the writing wavelength of the laser diode was changed to 780 nm and continuous printing of 50,000 sheets of the full-color image in which rectangular patches and characters were mixed with an image area ratio of 6% was performed in the following condition and electric potentials of unexposed area and exposed area and image quality of the image at the beginning and after printing of 50,000 sheets were evaluated.

Electric potentials of unexposed area and exposed area and image quality were evaluated as follows.

<Electric Potential of Unexposed Area>

The electric potential of unexposed area is a surface potential of the photoconductor at the time when the surface was moved to the position in the developing unit after primary charging and applied voltage to the charging device was adjusted to +700V in the beginning and it was kept constant until the end of the test.

<Electric Potential of Exposed Area>

The electric potential of exposed area is a surface potential of the photoconductor at the time when the surface was exposed (entire exposure) and moved to the position in the developing unit after primary charging.

<Image Quality>

Image quality was evaluated based on the presence or absence of color deviation during output of full-color images and background smear caused by charging ununiformity. Printed images were observed with magnifying lens and when a degree of color deviation was within 100 μm, it was marked as "A" and when the degree of color deviation was more than 100 μm, it was marked as "B". And when a background smear was observed even in part of the white portion, it was marked as "B".

Example 5-2

An electrophotographic photoconductor of Example 5-2 was produced and evaluated as similar to Example 5-1 except for using a titanyl phthalocyanine prepared according to the following Synthetic method as a charge generating material instead of the metal-free titanyl phthalocyanine (Fastogen Blue 8120B) as used in Example 5-1.

Titanyl Phthalocyanine used in Example 5-2

A pigment was produced according to JP-A No. 2001-19871. First, 29.2 g of 1,3-diiminoisoindoline and 200 ml of sulfolane were mixed and 20.4 g of titanium tetrabutoxide was allowed to drip into the mixture under nitrogen airflow. After dripping, a temperature of the mixture was raised gradually to 180° C. and stirred for 5 hours while maintaining the reaction temperature in the range of 170° C. to 180° C. to perform reaction. After reaction was completed, the deposit was filtered after cooling, washed until the fine particles were blue with chloroform, washed several times with methanol, dried after further washing with hot water of 80° C. for several times to obtain an unprocessed titanyl phthalocyanine. The unprocessed titanyl phthalocyanine was dissolved in 20 times its volume of a concentrated sulfuric acid, allowed to drip into 100 times its volume of ice water while stirring and the deposited crystals were filtered followed by repetitive washing with water until the wash fluid became neutral (pH value of ion exchange water after washing was 6.8) to obtain a wet cake (water paste) of titanyl phthalocyanine pigment. 40 g of the obtained wet cake (water paste) was put in 200 g of tetrahydrofran, the mixture was filtered after stirring for 4 hours and dried to obtain titanyl phthalocyanine powder. This was defined as a pigment 1.

The density of solid content of the above wet cake was 15%. The mass ratio of the crystal conversion solvent to the wet cake was 33:1. The X-ray diffraction spectrum of the obtained titanyl phthalocyanine powder was measured by the following condition and it turns out that the titanyl phthalocyanine powder had a maximum diffraction peak at Bragg angle 2θ relative to a Cu—Kα characteristic X-ray (1.542 Å wavelength) of 27.2±0.2°, additionally had a peak at the lowest angle 7.3±0.2° and had no peaks between the peak at 7.3° and the peak at 9.4°, and at 26.3°.

[Measurement Condition of X-Ray Diffraction Spectrum]

| | |
|---|---|
| X-ray tube: | Cu |
| Voltage: | 50 kV |
| Electric Current: | 30 mA |
| Scan Speed: | 2°/min. |
| Scan Range: | 3° to 40° |
| Time Constant: | 2 seconds |

Meanwhile, average particle size in the coating liquid for charge generating layer using the titanyl phthalocyanine was 0.29 μm as measured by means of CAPA-700 by Horiba, Ltd.

Example 5-3

The electrophotographic photoconductor used for Example 5-3 was produced as follows.

First, 30 parts of metal-free phthalocyanine pigment (Fastogen Blue 8120B by Dainippon Ink and Chemicals, Inc) as a charge generating material was dispersed with 970 parts of cyclohexanone for 2 hours by means of a ball mill apparatus to prepare a coating liquid for charge generating layer. In addition, 49 parts of polycarbonate resin (Z-Polyca by Teijin Chemicals Ltd., viscosity-average molecular weight=40,000), 20 parts of the charge generating material expressed by the above Structural Formula (3), 29.5 parts of the charge transporting material expressed by the following Structural Formula (14) and 0.1 parts of silicone oil (KF50-100CS by Shin-etsu Chemical Co., Ltd.) were dissolved in 340 parts of tetrahydrofran and then 66.6 parts of the above dispersion liquid of charge generating material was added and stirred to prepare a coating liquid for photosensitive layer.

Structural Formula (14)

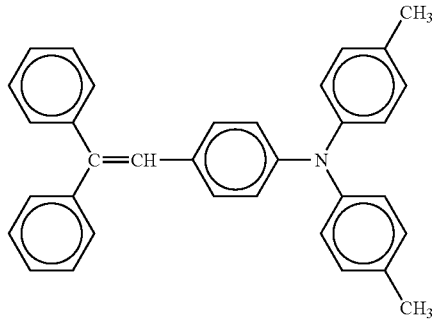

Next, the coating liquid for photosensitive layer was applied on an aluminum drum (a drum with a circumferential run-out of within 20 μm which had been selected in advance) of 30 mm diameter and 340 mm length by dipping for film forming and dried at 120° C. for 15 minutes. The elevating speed was set so as to form a photosensitive layer of 26.4 μm thickness.

The evaluation of the electrophotographic photoconductor of Example 5-3 produced as above was conducted as similar to Example 5-1.

Example 5-4

An electrophotographic photoconductor of Example 5-4 was produced and evaluated as similar to Example 5-3 except for using a titanyl phthalocyanine used in Example 5-2 instead of the metal-free phthalocyanine pigment (Fastogen Blue 8120B by Dainippon Ink and Chemicals, Inc.) as used in Example 5-3.

Example 5-5

An electrophotographic photoconductor of Example 5-5 was produced and evaluated as similar to Example 5-4 except for using the charge transporting material expressed by the above Structural Formula (4) instead of the charge transporting material expressed by Structural Formula (3) as used in Example 5-4.

The charge transporting material expressed by the above Structural Formula (4) was produced by the following method.

—First Step—

First, 10 g (37.3 mmol) of 1,4,5,8-naphthalenetetracarboxylic acid dianhydride, 0.931 g (18.6 mmol) of hydrazine monohydrate, 20 mg of p-toluenesulfonic acid and 100 ml of toluene were put in a 4-necked flask of 200 ml and heated to reflux for 5 hours. After reaction was completed, the container was cooled and then condensed under reduced pressure. The residue was purified by silica gel column chromatography. The recovered product was further recrystallized with toluene/ethyl acetate to obtain 2.84 g (yield: 28.7%) of dimer C.

—Second Step—

2.5 g (4.67 mmol) of dimer C and 30 ml of N,N-dimethylformamide (DMF) were put in a 4-necked flask of 100 ml and heated to reflux. A mixture containing 0.278 g (4.67 mmol) of 2-aminopropane and 10 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 0.556 g (yield: 38.5%) of monoimide C.

—Third Step—

0.50 g (1.62 mmol) of monoimide C and 10 ml of N,N-dimethylformamide (DMF) were put in a 4-necked flask of 50 ml and heated to reflux. A mixture containing 0.186 g (1.62 mmol) of 2-aminoheptane and 5 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.243 g (yield: 22.4%) of the charge transporting material expressed by the above Structural Formula (4). A peak at M/z=670 was observed in mass analysis (FD-MS) and it was identified as the target. The calculated values of element analysis were carbon 68.05%, hydrogen 4.51% and, nitrogen 8.35% whereas the observed values were carbon 68.29%, hydrogen 4.72% and nitrogen 8.33%.

Example 5-6

An electrophotographic photoconductor of Example 5-6 was produced and evaluated as similar to Example 5-4 except for using the charge transporting material expressed by the above Structural Formula (5) instead of the charge transporting material expressed by Structural Formula (3) as used in Example 5-4.

The charge transporting material expressed by the above Structural Formula (5) was produced by the following method.

—First Step—

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.10 g (18.6 mmol) of 2-aminopropane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 2.08 g (yield: 36.1%) of monoimide B.

—Second Step—

2.0 g (6.47 mmol) of monoimide B, 0.162 g (3.23 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.810 g (yield: 37.4%) of the charge transporting material expressed by Structural Formula (5). A peak at M/z=614 was observed in mass analysis (FD-MS) and it was identified as the target. The calculated values of element analysis were carbon 66.45%, hydrogen 3.61% and nitrogen 9.12% whereas the observed values were carbon 66.28%, hydrogen 3.45% and nitrogen 9.33%.

Example 5-7

An electrophotographic photoconductor of Example 5-7 was produced and evaluated as similar to Example 5-4 except for using the charge transporting material expressed by the following Structural Formula (6) instead of the charge transporting material expressed by Structural Formula (3) as used in Example 5-4.

The charge transporting material expressed by the following Structural Formula (6) was produced by the following method.

—First Step—

5.0 g (9.39 mmol) of the above-mentioned dimer C and 50 ml of N,N-dimethylformamide (DMF) were put in a 4-necked flask of 200 ml and heated to reflux. A mixture containing Structural Formula (4)

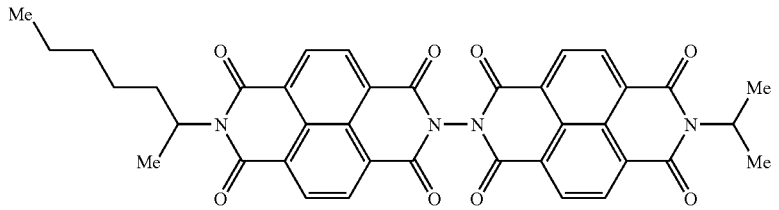

1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography to obtain 1.66 g (yield: 28.1%) of monoimide D.

—Second Step—

1.5 g (2.38 mmol) of monoimide D and 50 ml of N,N-dimethylformamide (DMF) were put in a 4-necked flask of 100 ml and heated to reflux. A mixture containing 0.308 g (2.38 mmol) of 2-aminooctane and 10 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.328 g (yield: 18.6%) of the charge transporting material expressed by Structural Formula (6). A peak at M/z=740 was observed in mass analysis (FD-MS) and it was identified as the target. The calculated values of element analysis were carbon 69.72%, hydrogen 5.44% and nitrogen 7.56% whereas the observed values were carbon 69.55%, hydrogen 5.26% and nitrogen 7.33%.

The charge transporting material expressed by the following Structural Formula (7) was produced by the following method.

—First Step—

5.0 g (9.39 mmol) of the above-mentioned dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography to obtain 1.66 g (yield: 28.1%) of monoimide D.

—Second Step—

1.5 g (2.38 mmol) of monoimide D and 50 ml of N,N-dimethylformamide (DMF) were put in a 4-necked flask of 100 ml and heated to reflux. A mixture containing 0.408 g (2.38 mmol) of 6-aminoundecane and 10 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.276 g (yield: 14.8%) of the charge transporting material expressed by the following Structural Formula (7). A peak at M/z=782 was observed in mass analysis (FD-MS) and it was identified as the target. The calculated values of element analysis were carbon 70.57%, hydrogen 5.92% and nitrogen 7.16% whereas the observed values were carbon 70.77%, hydrogen 6.11% and nitrogen 7.02%.

Structural Formula (6)

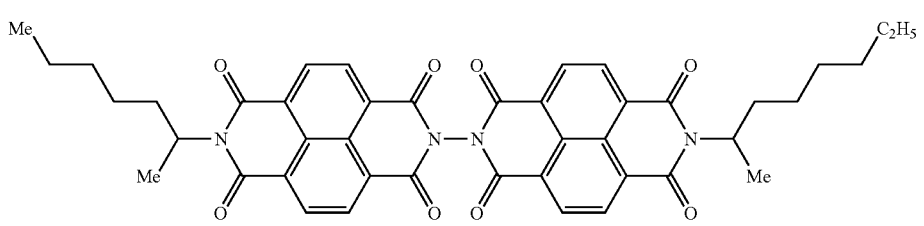

Example 5-8

An electrophotographic photoconductor of Example 5-8 was produced and evaluated as similar to Example 5-4 except for using the charge transporting material expressed by the following Structural Formula (7) instead of the charge transporting material expressed by Structural Formula (3) as used in Example 5-4.

Structural Formula (7)

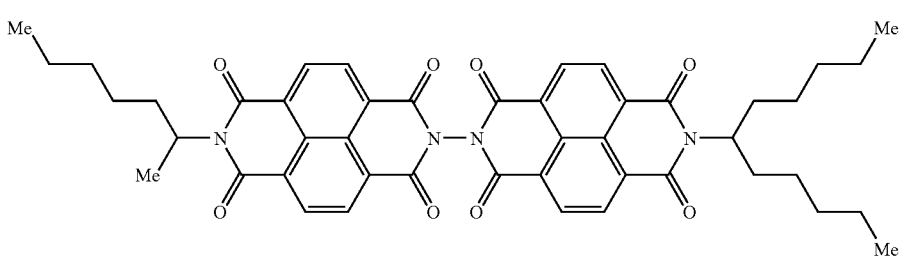

Example 5-9

An electrophotographic photoconductor of Example 5-9 was produced and evaluated as similar to Example 5-4 except for having circular holes of 4.2 mm diameter disposed on the center of each flange and attaching a stainless steel shaft of 4.2 mm diameter which run through inside of the photoconductor and each flange.

Example 5-10

An electrophotographic photoconductor of Example 5-10 was produced and evaluated as similar to Example 5-4 except for having circular holes of 18.0 mm diameter disposed on the center of each flange and attaching a stainless steel shaft of 18.0 mm diameter which run through inside of the photoconductor and each flange.

Example 5-11

An electrophotographic photoconductor of Example 5-11 was produced and evaluated as similar to Example 5-4 except for attaching an aluminum shaft instead of the stainless steel shaft.

Example 5-12

An electrophotographic photoconductor of Example 5-12 was produced and evaluated as similar to Example 5-4 except for using a tungsten wire of 40 μm to 80 μm diameter extended inside of a shield case as a charging member and changing the charging method to corona charging in which a high voltage of −6 kV is applied for charging.

Comparative Example 5-1

An electrophotographic photoconductor of Comparative Example 5-1 was produced and evaluated as similar to Example 5-4 except for not attaching shaft to the photoconductor.

Comparative Example 5-2

An electrophotographic photoconductor of Comparative Example 5-2 was produced and evaluated as similar to Example 5-4 except for not attaching shaft to the photoconductor and inserting a filling material (vibration suppressing material) made of butyl rubber into inside of the photoconductor to be firmly attached.

Comparative Example 5-3

An electrophotographic photoconductor of Comparative Example 5-3 was produced and evaluated as similar to Example 5-4 except for not attaching shaft to the photoconductor and inserting a filling material (vibration suppressing material) made of ABS into inside of the photoconductor to be firmly attached.

Comparative Example 5-4

An electrophotographic photoconductor of Comparative Example 5-4 was produced and evaluated as similar to Example 5-1 except for using the charge transporting material expressed by the following Structural Formula (13) instead of the charge transporting material expressed by Structural Formula (3) used for the photosensitive layer.

Structural Formula (13)

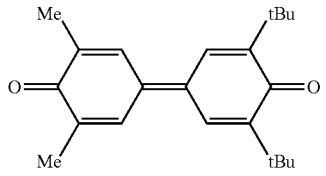

Comparative Example 5-5

An electrophotographic photoconductor of Comparative Example 5-5 was produced and evaluated as similar to Example 5-3 except for using the charge transporting material expressed by the above Structural Formula (13) instead of the charge transporting material expressed by Structural Formula (3) used for the photosensitive layer in Example 5-3.

Comparative Example 5-6

An electrophotographic photoconductor of Comparative Example 5-6 was produced and evaluated as similar to Example 5-4 except for using the charge transporting material expressed by the following Structural Formula (16) instead of the charge transporting material expressed by Structural Formula (3) used for the photosensitive layer in Example 5-4.

Structural Formula (16)

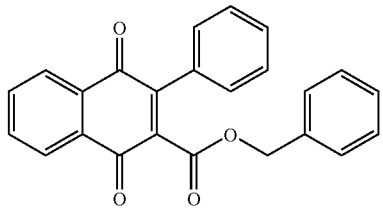

The evaluation results of Examples 5-1 to 5-12 and Comparative Examples 5-1 to 5-6 are shown in Table 5-1.

TABLE 5-1

| | At Beginning | | | After Printing of 50,000 Sheets | | |
|---|---|---|---|---|---|---|
| | Electric Potential of Unexposed Area (+V) | Electric Potential of Exposed Area (+V) | Image Quality | Electric Potential of Unexposed Area (+V) | Electric Potential of Exposed Area (+V) | Image Quality |
| Example 5-1 | 700 | 90 | A | 680 | 120 | A |
| Example 5-2 | 700 | 140 | A | 670 | 160 | A |
| Example 5-3 | 700 | 80 | A | 690 | 110 | A |

TABLE 5-1-continued

| | At Beginning | | | After Printing of 50,000 Sheets | | |
|---|---|---|---|---|---|---|
| | Electric Potential of Unexposed Area (+V) | Electric Potential of Exposed Area (+V) | Image Quality | Electric Potential of Unexposed Area (+V) | Electric Potential of Exposed Area (+V) | Image Quality |
| Example 5-4 | 700 | 130 | A | 670 | 160 | A |
| Example 5-5 | 700 | 140 | A | 680 | 150 | A |
| Example 5-6 | 700 | 130 | A | 700 | 160 | A |
| Example 5-7 | 700 | 150 | A | 690 | 170 | A |
| Example 5-8 | 700 | 140 | A | 660 | 170 | A |
| Example 5-9 | 700 | 130 | A | 670 | 160 | A |
| Example 5-10 | 700 | 130 | A | 670 | 160 | A |
| Example 5-11 | 700 | 130 | A | 670 | 160 | A |
| Example 5-12 | 700 | 130 | A | 670 | 160 | A |
| Comp. Ex. 5-1 | 700 | 130 | A | 670 | 160 | B (due to color deviation) |
| Comp. Ex. 5-2 | 700 | 130 | A | 670 | 160 | B (due to color deviation) |
| Comp. Ex. 5-3 | 700 | 130 | A | 670 | 160 | B (due to color deviation) |
| Comp. Ex. 5-4 | 700 | 160 | A | 750 | 320 | B (due to degraded density) |
| Comp. Ex. 5-5 | 700 | 180 | A | 780 | 330 | B (due to degraded density) |
| Comp. Ex. 5-6 | 700 | 170 | A | 790 | 450 | B (due to degraded density) |

From the results shown in Table 5-1, it turns out that it is possible to reduce the noise at the time of charging and obtain high quality images without occurrence of color deviation and degraded images caused by background smear or charging roller smear due to charging defects when printing full-color images in Examples which satisfy the constituent requirement of the present invention.

In Comparative Examples which do not satisfy the requirement of the present invention, degradation of images such as color deviation and degraded image density due to increase in electric potential of exposed area were observed.

Synthetic Example of Charge Transporting Material 6-1

First Step

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 2.14 g (18.6 mmol) of 2-aminoheptane and 25 ml of N,N-dimethylformamide (DMF) were allowed to drip into the flask while stirring. After dripping, it was heated to reflux for 6 hours. After reaction was completed, the container was cooled and then condensed under reduced pressure. Toluene was added to the residue and it was purified by silica gel column chromatography. The recovered product was further recrystallized with toluene/hexane to obtain 2.14 g (yield: 31.5% by mass) of monoimide A.

Second Step 2.0 g (5.47 mmol) of monoimide A, 0.137 g (2.73 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.668 g (yield: 33.7%) of the charge transporting material expressed by Structural Formula (3). This was defined as a charge transporting material 6-1.

Structural Formula (3)

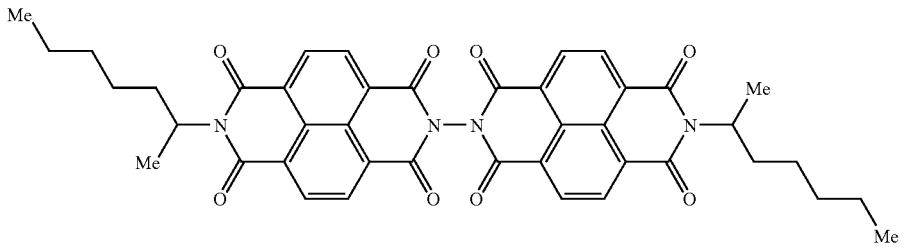

A peak at M/z=726 was observed in mass analysis (FD-MS) and it was identified as the target. The calculated values of element analysis were carbon 69.41%, hydrogen 5.27% and nitrogen 7.71% whereas the observed values were carbon 69.52%, hydrogen 5.09% and nitrogen 7.93%.

Synthetic Example of Charge Transporting Material 6-2

First Step

First, 10 g (37.3 mmol) of 1,4,5,8-naphthalenetetracarboxylic acid dianhydride, 0.931 g (18.6 mmol) of hydrazine monohydrate, 20 mg of p-toluenesulfonic acid and 100 ml of toluene were put in a 4-necked flask of 200 ml and heated to reflux for 5 hours. After reaction was completed, the container was cooled and then condensed under reduced pressure. The residue was purified by silica gel column chromatography. The recovered product was further recrystallized with toluene/ethyl acetate to obtain 2.84 g (yield: 28.7%) of dimer C.

Second Step 2.5 g (4.67 mmol) of dimer C and 30 ml of N,N-dimethylformamide (DMF) were put in a 4-necked flask of 100 ml and heated to reflux. A mixture containing 0.278 g (4.67 mmol) of 2-aminopropane and 10 ml of N,N-dimethylformamide (DMF) were allowed to drip into the flask while stirring. After dripping, it was then heated to reflux for 6 hours. After reaction was completed, the container was cooled and condensed under reduced pressure. Toluene was added to the residue and it was purified by silica gel column chromatography to obtain 0.556 g (yield: 38.5%) of monoimide C.

Third Step 0.50 g (1.62 mmol) of monoimide C and 10 ml of N,N-dimethylformamide (DMF) were put in a 4-necked flask of 50 ml and heated to reflux. A mixture containing 0.186 g (1.62 mmol) of 2-aminoheptane and 5 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.243 g (yield: 22.4%) of the charge transporting material expressed by Structural Formula (4). This was defined as the charge transporting material 6-2.

A peak at M/z=670 was observed in mass analysis (FD-MS) and it was identified as the target. The calculated values of element analysis were carbon 68.05%, hydrogen 4.51% and nitrogen 8.35% whereas the observed values were carbon 68.29%, hydrogen 4.72% and nitrogen 8.33%.

Synthetic Example of Charge Transporting Material 6-3

First Step 5.0 g (9.39 mmol) of the above-mentioned dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography to obtain 1.66 g (yield: 28.1%) of monoimide D.

Second Step 1.5 g (2.38 mmol) of monoimide D and 50 ml of N,N-dimethylformamide (DMF) were put in a 4-necked flask of 100 ml and heated to reflux. A mixture containing 0.308 g (2.38 mmol) of 2-aminooctane and 10 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.328 g (yield: 18.6%) of the charge transporting material expressed by Structural Formula (6). This was defined as the charge transporting material 6-3.

Structural Formula (4)

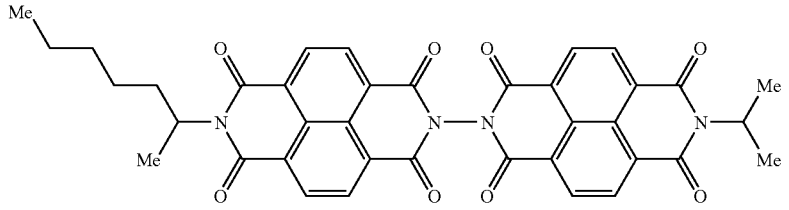

Structural Formula (6)

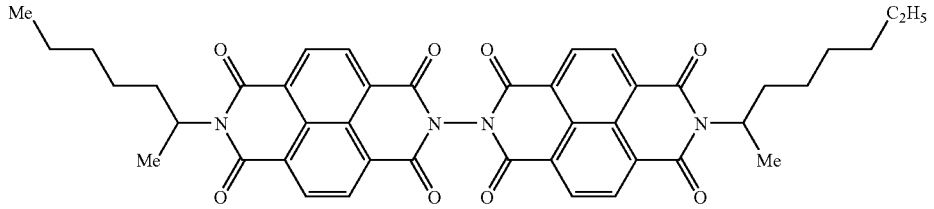

A peak at M/z=740 was observed in mass analysis (FD-MS) and it was identified as the target. The calculated values of element analysis were carbon 69.72%, hydrogen 5.44% and nitrogen 7.56% whereas the observed values were carbon 69.55%, hydrogen 5.26% and nitrogen 7.33%.

Synthetic Example of Charge Transporting Material 6-4

First Step

First, 5.0 g (18.6 mmol) of 1,4,5,8-naphthalenetetracarboxylic acid dianhydride and 50 ml of N,N-dimethylformamide (DMF) were put in a 4-necked flask of 200 ml and heated to reflux. A mixture containing 1.10 g (18.6 mmol) of 2-aminopropane and 25 ml of N-dimethylformamide (DMF) were allowed to drip into the flask while stirring. After dripping, it was heated to reflux for 6 hours. After reaction was completed, the reaction container was cooled and then condensed under reduced pressure. Toluene was added to the residue and it was purified by silica gel column chromatography. The recovered product was further recrystallized with toluene/hexane to obtain 2.08 g (yield: 36.1%) of monoimide B.

Second Step 2.0 g (6.47 mmol) of monoimide B, 0.162 g (3.23 mmol) of hydrazine monohydrate, 10 mg of p-toluenesulfonic acid and 50 ml of toluene were put in a 4-necked flask of 100 ml and heated to reflux for 5 hours. After reaction was completed, the container was cooled and condensed under reduced pressure. The residue was purified by silica gel column chromatography. The recovered product was further recrystallized with toluene/ethyl acetate to obtain 0.810 g (yield: 37.4%) of the charge transporting material expressed by Structural Formula (5). This was defined as the charge transporting material 6-4.

Structural Formula (5)

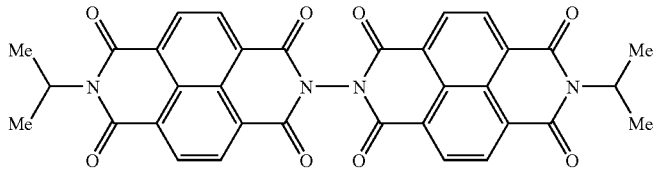

A peak at M/z=614 was observed in mass analysis (FD-MS) and it was identified as the target. The calculated values of element analysis were carbon 66.45%, hydrogen 3.61% and nitrogen 9.12% whereas the observed values were carbon 66.28%, hydrogen 3.45% and nitrogen 9.33%.

Synthetic Example of Charge Transporting Material 6-5

First Step 5.0 g (9.39 mmol) of the above-mentioned dimer C and 50 ml of N,N-dimethylformamide (DMF) were put in a 4-necked flask of 200 ml and heated to reflux. A mixture containing 1.08 g (9.39 mmol) of 2-aminoheptane and 25 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography to obtain 1.66 g (yield: 28.1%) of monoimide D.

Second Step 1.5 g (2.38 mmol) of monoimide D and 50 ml of N,N-dimethylformamide (DMF) were put in a 4-necked flask of 100 ml and heated to reflux. A mixture containing 0.408 g (2.38 mmol) of 6-aminoundecane and 10 ml of N,N-dimethylformamide (DMF) were allowed to drip into the flask while stirring. After dripping, it was then heated to reflux for 6 hours. After reaction was completed, the reaction container was cooled and condensed under reduced pressure. Toluene was added to the residue and it was purified by silica gel column chromatography. The recovered product was further recrystallized with toluene/hexane to obtain 0.276 g (yield: 14.8%) of the charge transporting material expressed by Structural Formula (7).

Structural Formula (7)

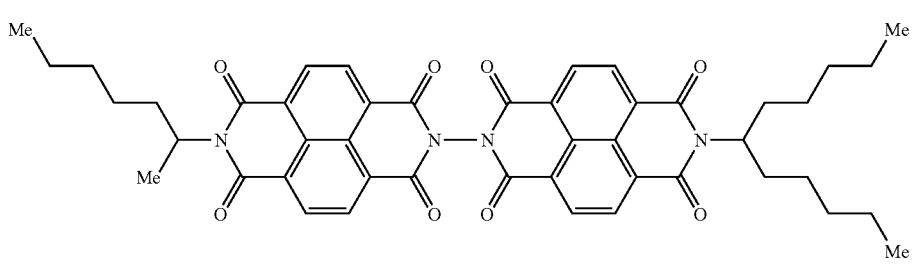

A peak at M/z=782 was observed in mass analysis (FD-MS) and it was identified as the target. The calculated values of element analysis were carbon 70.57%, hydrogen 5.92% and nitrogen 7.16% whereas the observed values were carbon 70.77%, hydrogen 6.11% and nitrogen 7.02%.

Pigment Synthetic Example 6-1

A pigment was prepared according to the method stated in production examples of JP-A No. 2-8256 (JP-B No. 7-91486). First, 9.8 g of phthalodinitrile and 75 ml of 1-chloronaphthalene were mixed by stirring and the mixture was allowed to drip into 2.2 ml of titanium tetracholoride under nitrogen airflow. After dripping, it was then heated gradually to a temperature of 200° C. and stirred for 3 hours for reaction while maintaining the reaction temperature in the range of 200° C. to 220° C. After reaction was completed, it was cooled to a temperature of 130° C. and filtered in a hot condition, washed until the fine particles were blue with 1-chloronaphthalene, washed with methanol for several times, further washed with hot water of 80° C. for several times and dried to obtain a pigment. (This was defined as a pigment 1.)

The X-ray diffraction spectrum of the obtained titanyl phthalocyanine powder was measured by the following condition and it turns out that the spectrum of the obtained titanyl phthalocyanine powder was the same as the one disclosed in JP-A No. 2-8256 (JP-B No. 7-91486).

Measurement Condition of X-ray Diffraction Spectrum

| | |
|---|---|
| X-ray tube: | Cu |
| Voltage: | 50 kV |
| Electric Current: | 30 mA |
| Scan Speed: | 2°/min. |
| Scan Range: | 3° to 40° |
| Time Constant: | 2 seconds |

Pigment Synthetic Example 6-2

A pigment was produced according to JP-A No. 2001-19871. First, 29.2 g of 1,3-diiminoisoindoline and 200 ml of sulfolane were mixed and 20.4 g of titanium tetrabutoxide was allowed to drip into the mixture under nitrogen airflow. After dripping, a temperature of the mixture was raised gradually to 180° C. and stirred for 5 hours while maintaining the reaction temperature in the range of 170° C. to 180° C. to perform reaction. After reaction was completed, the deposit was filtered after cooling, washed until the fine particles were blue with chloroform, washed several times with methanol, dried after further washing with hot water of 80° C. for several times to obtain an unprocessed titanyl phthalocyanine. The unprocessed titanyl phthalocyanine was dissolved in 20 times its volume of a concentrated sulfuric acid, allowed to drip into 100 times its volume of ice water while stirring and the deposited crystals were filtered followed by repetitive washing with water until the wash fluid became neutral to obtain a wet cake (water paste) of titanyl phthalocyanine pigment. 2 g of the obtained wet cake (water paste) was put in 20 g of tetrahydrofran, the mixture was filtered after stirring for 4 hours and dried to obtain titanyl phthalocyanine powder. This was defined as a pigment 2.

The X-ray diffraction spectrum of the obtained titanyl phthalocyanine powder was measured by the condition of Pigment Synthetic Example 6-1 and it turns out that the titanyl phthalocyanine powder had a maximum diffraction peak at least at 27.2 as a diffraction peak (±0.2°) at Bragg angle 2θ relative to a Cu—Kα ray (1.542 Å wavelength), additionally had main peaks at 9.4°, 9.6° and 24.0°, a peak at 7.3° as a diffraction peak at the lowest angle and had no peaks between the peak at 7.3° and the peak at 9.4° as stated in JP-A No. 2001-19871.

Production Example of Photoconductor 6-1

A pigment dispersion liquid was prepared by dispersing metal-free phthalocyanine with the following composition and condition.

| | |
|---|---|
| metal-free phthalocyanine pigment | 3 parts |
| (Fastogen Blue 8120B by Dainippon Ink and Chemicals, Inc.) | |
| cyclohexanone | 97 parts |

The above materials were put in a glass pot of 9 cm diameter and dispersed at a rotation frequency of 100 rpm for 5 hours by using PSZ ball of 0.5 mm diameter.

The coating liquid for photoconductor of the following composition was prepared by using the above dispersion liquid.

| | |
|---|---|
| above dispersion liquid | 80 parts |
| hole transporting material expressed by the following Structural Formula (14) | 60 parts |

Structural Formula (14)

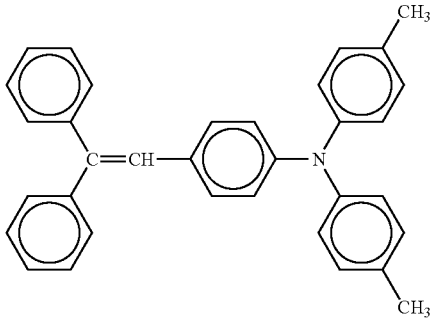

| | |
|---|---|
| synthetic example of charge transporting material 1 | 40 parts |
| Z-type polycarbonate resin (Panlite ® TS-2050 by Teijin Chemicals Ltd.) | 100 parts |
| silicone oil (KF50 by Shin-etsu Chemical Co., Ltd.) | 0.02 parts |
| tetrahydrofran | 700 parts |

The coating liquid for photosensitive layer obtained as above was applied on an aluminum drum of 30 mm diameter and 340 mm length by dipping and dried at 120° C. for 20 minutes to form a photosensitive layer of 25 μm thickness to thereby obtain a photoconductor drum. Moreover, the coating liquid for photosensitive layer was simultaneously applied on an aluminum plate by using a blade coater and dried at 120° C. for 20 minutes to form a photosensitive layer of 25 μm thickness to thereby obtain a sheet photoconductor. Both photoconductors were defined as production example of photoconductor 6-1.

Production Examples of Photoconductor 6-2 to 6-16

The photoconductors 6-2 to 6-16 were obtained by producing photoconductor drums and sheet photoconductors as similar to the production example of photoconductor 6-1 except for changing the type of the charge generating material, additive amount of hole transporting material relative to 100 parts of the resin, the type of the charge transporting material and additive amount thereof relative to 100 parts of the resin.

TABLE 6-1

| | Type of Charge Generating Material | Additive Amount of Hole Transporting Material | Charge Transporting Material: Type | Charge Transporting Material: Additive Amount |
|---|---|---|---|---|
| Photoconductor 6-1 | metal-free phthalocyanine | 60 | Synthetic Example of Charge Transporting Material 1 | 40 |
| Photoconductor 6-2 | metal-free phthalocyanine | 40 | Synthetic Example of Charge Transporting Material 1 | 60 |
| Photoconductor 6-3 | Pigment Synthetic Example 1 | 60 | Synthetic Example of Charge Transporting Material 1 | 40 |
| Photoconductor 6-4 | Pigment Synthetic Example 1 | 40 | Synthetic Example of Charge Transporting Material 1 | 60 |
| Photoconductor 6-5 | Pigment Synthetic Example 2 | 80 | Synthetic Example of Charge Transporting Material 1 | 20 |
| Photoconductor 6-6 | Pigment Synthetic Example 2 | 60 | Synthetic Example of Charge Transporting Material 1 | 40 |
| Photoconductor 6-7 | Pigment Synthetic Example 2 | 40 | Synthetic Example of Charge Transporting Material 1 | 60 |
| Photoconductor 6-8 | Pigment Synthetic Example 2 | 20 | Synthetic Example of Charge Transporting Material 1 | 80 |
| Photoconductor 6-9 | Pigment Synthetic Example 1 | 60 | Synthetic Example of Charge Transporting Material 2 | 40 |
| Photoconductor 6-10 | Pigment Synthetic Example 1 | 40 | Synthetic Example of Charge Transporting Material 2 | 60 |
| Photoconductor 6-11 | Pigment Synthetic Example 2 | 60 | Synthetic Example of Charge Transporting Material 3 | 40 |
| Photoconductor 6-12 | Pigment Synthetic Example 2 | 40 | Synthetic Example of Charge Transporting Material 3 | 60 |
| Photoconductor 6-13 | metal-free phthalocyanine | 60 | Structural Formula (16) | 40 |
| Photoconductor 6-14 | metal-free phthalocyanine | 40 | Structural Formula (16) | 60 |
| Photoconductor 6-15 | Pigment Synthetic Example 1 | 60 | Structural Formula (13) | 40 |
| Photoconductor 6-16 | Pigment Synthetic Example 1 | 40 | Structural Formula (13) | 60 |

Structural Formula (16)

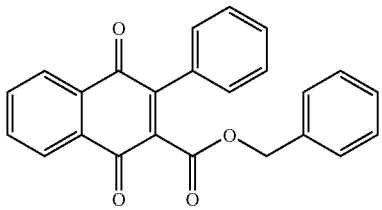

Structural Formula (13)

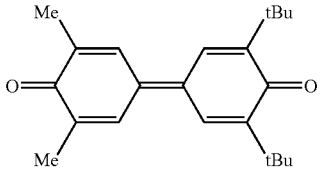

<Evaluation of Optical Sensitivity E½ of Photoconductor>

The obtained sheet photoconductors were mounted in Model EPA 8100 by Hikariken and exposure and charge removal were performed with a single light of 780 nm after charging at ±800V to measure half light exposure (E½) of each charging polarity to thereby obtain its ratio. The results are shown in Tables 6-2 and 6-3.

<Evaluation of Degraded Image by Transfer>

Figure 20:
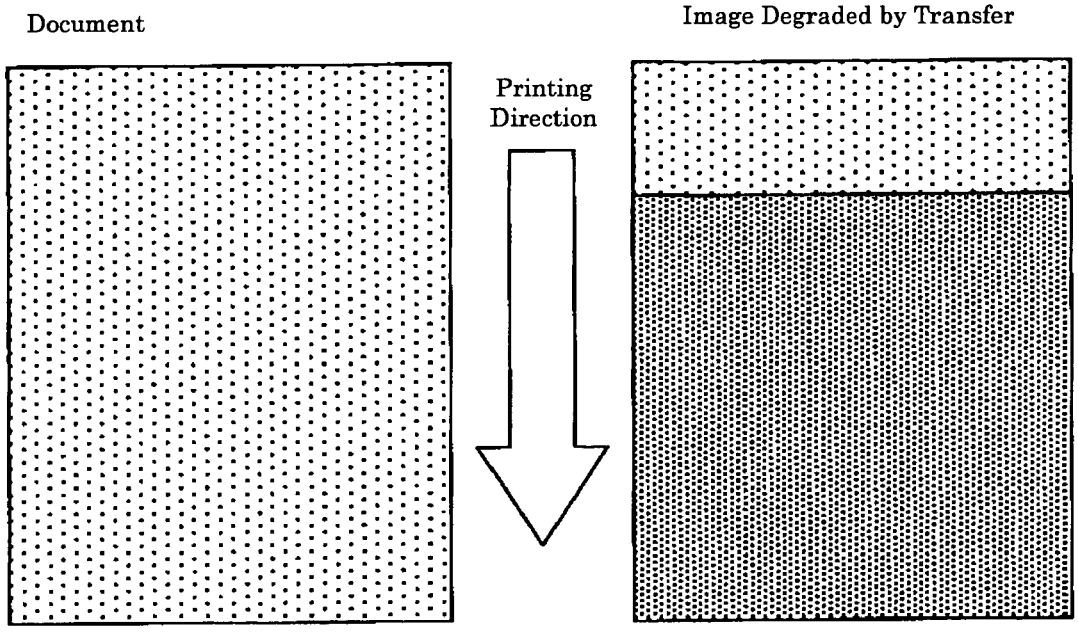
FIG. 20 is a view showing an evaluation copy for degradation by transfer and an image degraded by transfer.

The photoconductors were mounted in an image forming apparatus, documents for evaluation of degradation by transfer as shown in FIG. 20 were printed and density changes caused by degradation by transfer were evaluated with eyes. The density of the area affected by transfer is increased in the halftone image density region. The evaluation of image degraded by transfer was conducted before and after printing durability test according to evaluation criteria as follows.

| | |
|---|---|
| A: very good | B: good |
| C: somewhat inferior | D: no good |

<Evaluation of Degraded Image by Image Exposure>

Figure 21:
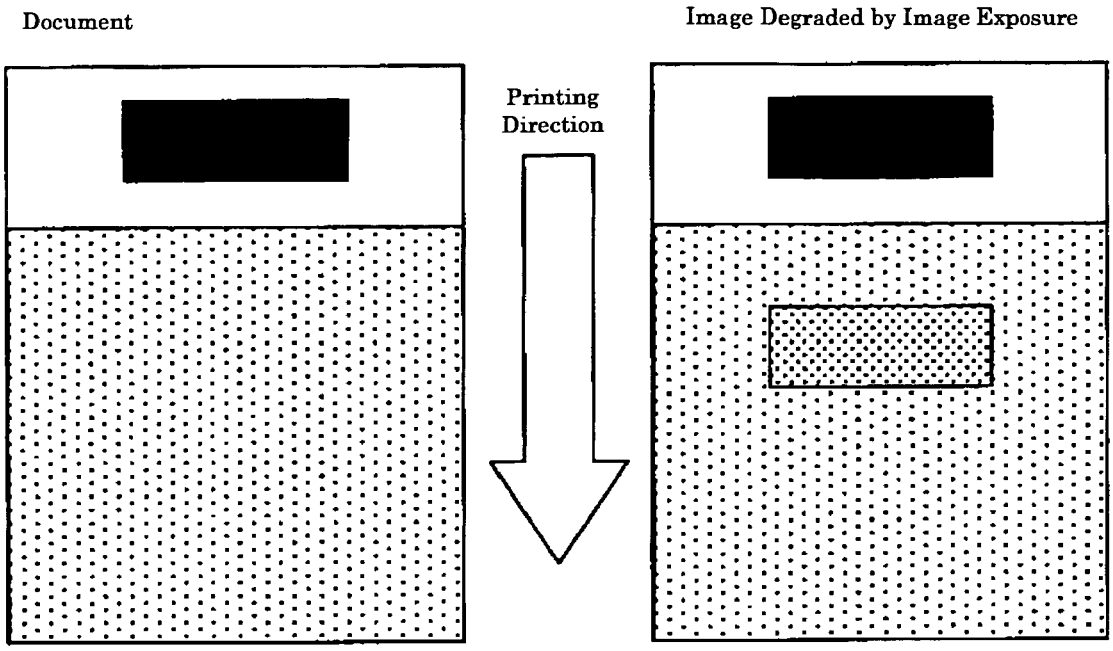
FIG. 21 is a view showing an evaluation copy for degradation by image exposure and an image degraded by image exposure.

The photoconductors were mounted in an image forming apparatus, documents for evaluation of degradation by image exposure as shown in FIG. 21 were printed and density changes caused by degradation by image exposure were evaluated with eyes. The density of the area affected by strong image exposure is increased in the halftone image density region. The evaluation of image degraded by image exposure was conducted before and after printing durability test according to evaluation criteria as follows.

| | |
|---|---|
| A: very good | B: good |
| C: somewhat inferior | D: no good |

Examples 6-1 to 6-12 and Comparative Examples 6-1 to 6-4

The photoconductors 6-1 to 6-16 were mounted in an image forming apparatus 1, a remodeled imagio Neo 270 by Ricoh Company, Ltd. with writing laser wavelength of 780 nm and charge removing LED, in which power pack was changed, charging and transfer were changed to roller charging (positive polarity) and roller transfer (negative polarity) and toner and developer were changed for positive charging, and 10,000 A4 size sheets were printed out in a horizontal direction by using a chart of 5% writing ratio for printing durability test. The electric potential of the photoconductor was set at +600V at the beginning of the test and this was maintained until the end of the test. The developing bias was set at +450V. The test was conducted in an environment of 23° C. and 55% RH. The evaluations of image degraded by transfer and image exposure were conducted before and after the printing durability test. The results are shown in Table 6-2.

TABLE 6-2

| | | | | | Before Printing Durability Test | | After Printing of 10,000 Sheets | |
|---|---|---|---|---|---|---|---|---|
| | Photoconductor | E½ (positive) (uJ/cm$^2$) | E½ (negative) (uJ/cm$^2$) | E½ (negative)/ E½ (positive) Type | Degradation by Transfer | Degradation by Image Exposure | Degradation by Transfer | Degradation by Image Exposure |
| Example 6-1 | Photoconductor 6-1 | 0.41 | 1.20 | 2.93 | A | A | B | B |
| Example 6-2 | Photoconductor 6-2 | 0.38 | 1.01 | 2.66 | A | A | A | A |
| Example 6-3 | Photoconductor 6-3 | 0.23 | 0.25 | 1.09 | A | A | A | A |
| Example 6-4 | Photoconductor 6-4 | 0.21 | 0.22 | 1.05 | A | A | A | A |
| Example 6-5 | Photoconductor 6-5 | 0.28 | 0.39 | 1.39 | A | A | A | A |
| Example 6-6 | Photoconductor 6-6 | 0.22 | 0.24 | 1.09 | A | A | A | A |
| Example 6-7 | Photoconductor 6-7 | 0.20 | 0.20 | 1.00 | A | A | A | A |
| Example 6-8 | Photoconductor 6-8 | 0.35 | 0.27 | 0.77 | A | A | A | B |
| Example 6-9 | Photoconductor 6-9 | 0.25 | 0.29 | 1.16 | A | A | A | A |
| Example 6-10 | Photoconductor 6-10 | 0.23 | 0.26 | 1.13 | A | A | A | A |
| Example 6-11 | Photoconductor 6-11 | 0.22 | 0.24 | 1.09 | A | A | A | A |
| Example 6-12 | Photoconductor 6-12 | 0.21 | 0.22 | 1.05 | A | A | A | A |
| Comp. Ex. 6-1 | Photoconductor 6-13 | 0.50 | 2.25 | 4.50 | B | A | D | C |
| Comp. Ex. 6-2 | Photoconductor 6-14 | 0.44 | 1.85 | 4.20 | B | A | D | C |
| Comp. Ex. 6-3 | Photoconductor 6-15 | 0.46 | 1.72 | 3.74 | B | A | D | C |
| Comp. Ex. 6-4 | Photoconductor 6-16 | 0.43 | 1.51 | 3.51 | B | A | D | C |

Examples 6-13 to 6-24 and Comparative Examples 6-5 to 6-8

The photoconductors 6-1 to 6-16 were mounted in an image forming apparatus 2, a remodeled imagio Neo 270 by Ricoh Company, Ltd. with writing laser wavelength of 780 nm and charge removing LED, in which charge removing LED was removed, power pack was changed, charging and transfer were changed to roller charging (positive polarity) and roller transfer (negative polarity) and toner and developer were changed for positive charging, and 10,000 A4 size sheets were printed out in a horizontal direction by using a chart of 5% writing ratio for printing durability test. The electric potential of the photoconductor was set at +600V at the beginning of the test and this was maintained until the end of the test. The developing bias was set at +450V. The test was conducted in an environment of 23° C. and 55% RH. The evaluations of image degraded by transfer and image exposure were conducted before and after the printing durability test. The results are shown in Table 6-3.

TABLE 6-3

| | Photoconductor | E½ (positive) (uJ/cm²) | E½ (negative) (uJ/cm²) | E½ (negative)/ E½ (positive) Type | Before Printing Durability Test | | After Printing of 10,000 Sheets | |
|---|---|---|---|---|---|---|---|---|
| | | | | | Degradation by Transfer | Degradation by Image Exposure | Degradation by Transfer | Degradation by Image Exposure |
| Example 6-13 | Photoconductor 6-1 | 0.41 | 1.20 | 2.93 | A | A | B | B |
| Example 6-14 | Photoconductor 6-2 | 0.38 | 1.01 | 2.66 | A | A | A | A |
| Example 6-15 | Photoconductor 6-3 | 0.23 | 0.25 | 1.09 | A | A | A | A |
| Example 6-16 | Photoconductor 6-4 | 0.21 | 0.22 | 1.05 | A | A | A | A |
| Example 6-17 | Photoconductor 6-5 | 0.28 | 0.39 | 1.39 | A | A | A | A |
| Example 6-18 | Photoconductor 6-6 | 0.22 | 0.24 | 1.09 | A | A | A | A |
| Example 6-19 | Photoconductor 6-7 | 0.20 | 0.20 | 1.00 | A | A | A | A |
| Example 6-20 | Photoconductor 6-8 | 0.35 | 0.27 | 0.77 | A | A | B | A |
| Example 6-21 | Photoconductor 6-9 | 0.25 | 0.29 | 1.16 | A | A | A | A |
| Example 6-22 | Photoconductor 6-10 | 0.23 | 0.26 | 1.13 | A | A | A | A |
| Example 6-23 | Photoconductor 6-11 | 0.22 | 0.24 | 1.09 | A | A | A | A |
| Example 6-24 | Photoconductor 6-12 | 0.21 | 0.22 | 1.05 | A | A | A | A |
| Comp. Ex. 6-5 | Photoconductor 6-13 | 0.50 | 2.25 | 4.50 | A | B | D | D |
| Comp. Ex. 6-6 | Photoconductor 6-14 | 0.44 | 1.85 | 4.20 | A | B | D | D |
| Comp. Ex. 6-7 | Photoconductor 6-15 | 0.46 | 1.72 | 3.74 | A | C | C | D |
| Comp. Ex. 6-8 | Photoconductor 6-16 | 0.43 | 1.51 | 3.51 | A | C | C | D |

From the results shown above, it turns out that it is possible to output appropriate images without having image defects caused by transfer and image exposure even when used repeatedly with examples which satisfy the requirement of the present invention.

Examples 6-25 to 6-29 and Comparative Examples 6-9 to 6-10

The photoconductors 6-2, 6-4, 6-7, 6-10, 6-12, 6-14 and 6-16 were mounted in an image forming apparatus 3, a remodeled imagio Neo 270 by Ricoh Company, Ltd. with writing laser wavelength of 780 nm and charge removing LED, in which charging and transfer were changed to roller charging (negative polarity) and roller transfer (negative/positive polarity) and toner and developer were changed for negative charging, and 10,000 A4 size sheets were printed out in a horizontal direction by using a chart of 5% writing ratio for printing durability test. The electric potential of the photoconductor was set at −600V at the beginning of the test and this was maintained until the end of the test. The developing bias was set at −450V. The test was conducted in an environment of 23° C. and 55% RH. The evaluations of images degraded by transfer and image exposure were conducted before and after the printing durability test. The results are shown in Table 6-4.

TABLE 6-4

| | Photoconductor | E1/2 (positive) (uJ/cm²) | E1/2 (negative) (uJ/cm²) | E1/2 (negagive)/ E1/2 (positive) Type | Before Printing Durability Test | | After Printing of 10,000 Sheets | |
|---|---|---|---|---|---|---|---|---|
| | | | | | Degradation by Transfer | Degradation by Image Exposure | Degradation by Transfer | Degradation by Image Exposure |
| Example 6-25 | Photoconductor 6-2 | 0.38 | 1.01 | 2.66 | A | A | A | B |
| Example 6-26 | Photoconductor 6-4 | 0.21 | 0.22 | 1.05 | A | A | A | A |
| Example 6-27 | Photoconductor 6-7 | 0.20 | 0.20 | 1.00 | A | A | A | A |
| Example 6-28 | Photoconductor 6-10 | 0.23 | 0.26 | 1.13 | A | A | A | A |
| Example 6-29 | Photoconductor 6-12 | 0.21 | 0.22 | 1.05 | A | A | A | A |
| Comp. Ex. 6-9 | Photoconductor 6-14 | 0.44 | 1.85 | 4.20 | A | D | C | D |
| Comp. Ex. 6-10 | Photoconductor 6-16 | 0.43 | 1.51 | 3.51 | A | D | C | D |

Figure 22:
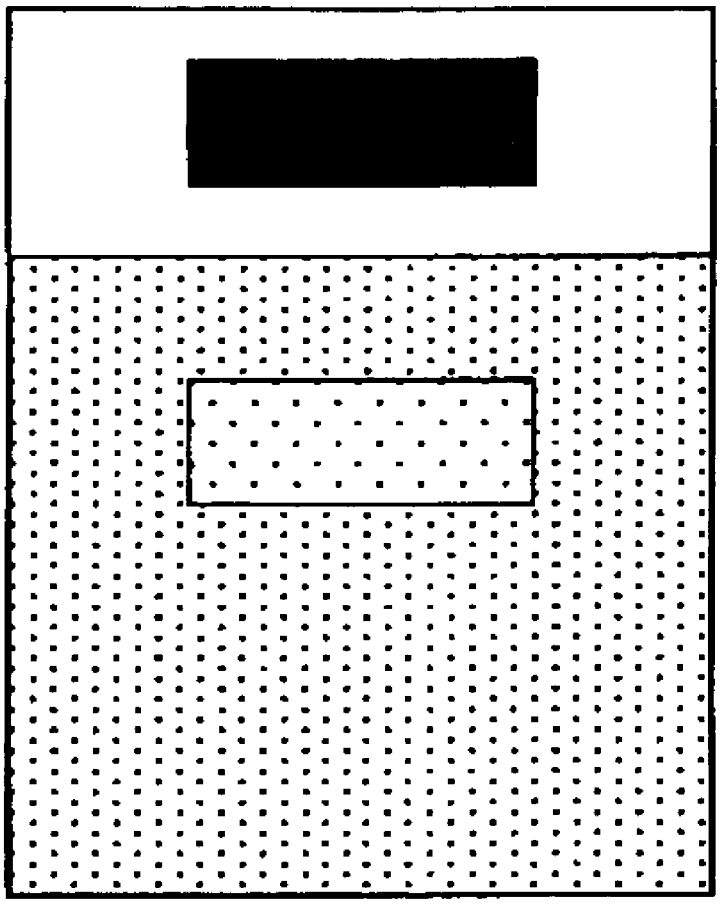
FIG. 22 is a view showing an image degraded by image exposure which had been observed.

Meanwhile, the image degraded by image exposure observed at this time became a negative afterimage as shown in FIG. 22. This was thought to be because when the optical sensitivity for negative charging is inappropriate as in Comparative Examples, negative space charge is accumulated by image exposure and halftone potential of image exposing unit is increased, resulting in degradation of density.

Examples 6-30 to 6-34 and Comparative Examples 6-11 to 6-12

The photoconductors 6-2, 6-4, 6-7, 6-10, 6-12, 6-14 and 6-16 were mounted in an image forming apparatus 3, a remodeled imagio Neo 270 by Ricoh Company, Ltd. with writing laser wavelength of 780 nm and charge removing LED, in which charging and transfer were changed to roller charging (negative polarity) and roller transfer (negative/positive polarity), charge removing LED was removed and toner and developer were changed for negative charging, and 10,000 A4 size sheets were printed out in a horizontal direction by using a chart of 5% writing ratio for printing durability test. The electric potential of the photoconductor was set at −600V at the beginning of the test and this was maintained until the end of the test. The developing bias was set at −450V. The test was conducted in an environment of 23° C. and 55% RH. The evaluations of images degraded by transfer and image exposure were conducted before and after the printing durability test. The results are shown in Table 6-5.

TABLE 6-5

| | Photoconductor | E1/2 (positive) (uJ/cm$^2$) | E1/2 (negative) (uJ/cm$^2$) | E1/2 (negagive)/ E1/2 (positive) | Before Printing Durability Test: Degradation by Transfer | Before Printing Durability Test: Degradation by Image Exposure | After Printing of 10,000 Sheets: Degradation by Transfer | After Printing of 10,000 Sheets: Degradation by Image Exposure |
|---|---|---|---|---|---|---|---|---|
| Example 6-30 | Photoconductor 6-2 | 0.38 | 1.01 | 2.66 | A | A | A | C |
| Example 6-31 | Photoconductor 6-4 | 0.21 | 0.22 | 1.05 | A | A | A | A |
| Example 6-32 | Photoconductor 6-7 | 0.20 | 0.20 | 1.00 | A | A | A | A |
| Example 6-33 | Photoconductor 6-10 | 0.23 | 0.26 | 1.13 | A | A | A | A |
| Example 6-34 | Photoconductor 6-12 | 0.21 | 0.22 | 1.05 | A | A | A | A |
| Comp. Ex. 6-11 | Photoconductor 6-14 | 0.44 | 1.85 | 4.20 | B | D | C | D |
| Comp. Ex. 6-12 | Photoconductor 6-16 | 0.43 | 1.51 | 3.51 | B | D | C | D |

Meanwhile, the image degraded by image exposure observed at this time became a negative afterimage as shown in FIG. 22. The reason for this was thought to be as described above.

Example 7-1

Preparation of Electrophotographic Photoconductor

First, coating liquids for undercoat layer, charge generating layer and charge transporting layer of the following compositions were prepared.

[Preparation of Coating Liquid for Undercoat Layer]

The following materials were subject to ball milling for 5 days by means of a ball mill apparatus (an alumina ball of 10 mm diameter was used as media) to prepare a coating liquid for undercoat layer.

| | |
|---|---|
| alkyd resin (Beckozol M-6401-50 by Dainippon Ink and Chemicals, Inc.) | 10 parts |
| melamine resin (Super Beckamine L-121-60 by Dainippon Ink and Chemicals, Inc.) | 7 parts |
| Titanium oxide (CR-EL by Ishihara Sangyo Kaisha, Ltd.) | 48 parts |
| methyl ethyl ketone | 155 parts |

[Preparation of Coating Liquid for Charge Generating Layer]

The following composition was subject to ball milling for 40 minutes by means of a bead mill disperser using PSZ ball of 0.5 mm diameter as media to prepare a coating liquid for charge generating layer.

| | |
|---|---|
| metal-free phthalocyanine pigment (Fastogen Blue 8120B by Dainippon Ink and Chemicals, Inc.) | 14 parts |

-continued

| | |
|---|---|
| polyvinylbutyral (BX-1 by Sekisui Chemical Co., Ltd.) | 9 parts |
| cyclohexanone | 270 parts |

[Preparation of Coating Liquid for Charge Transporting Layer]

The following composition was dissolved by stirring to prepare a coating liquid for charge transporting layer.

| | |
|---|---|
| charge transporting material expressed by the following Structural Formula (3) | 9 parts |

Structural Formula (3)

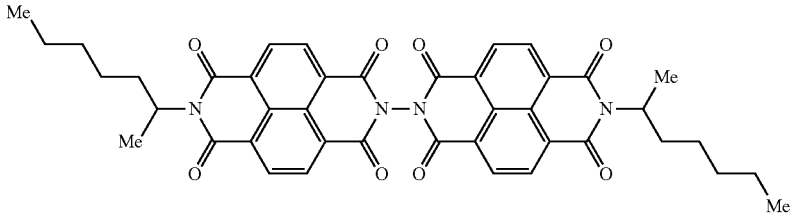

In the Structural Formula (3), "Me" represents a methyl group.

| | |
|---|---|
| polycarbonate resin (Z-Polyca by Teijin Chemicals Ltd., viscosity-average molecular weight = 40,000) | 10 parts |
| tetrahydrofran | 120 parts |
| 1% silicone oil (KF50-100CS by Shin-etsu Chemical Co., Ltd.) | 1 part |

Next, the coating liquids for undercoat layer, charge generating layer and charge transporting layer were applied sequentially on an aluminum drum of 30 mm diameter and 340 mm length by dipping and dried at 135° C. for 20 minutes, 80° C. for 15 minutes and 120° C. for 20 minutes respectively. The elevating speed was set as to form an undercoat layer of 4.5 μm thickness, a charge generating layer of 0.15 μm thickness and a charge transporting layer of 22.1 μm thickness respectively to thereby obtain a latent electrostatic image bearing member used for Example 7-1.

<Image Forming>

The latent electrostatic image bearing member produced as above was mounted in a remodeled full-color image forming apparatus of tandem type (IPSiO CX8200 by Ricoh Company, Ltd.) in which image forming elements of each color of black, yellow, magenta and cyan were disposed, power pack was changed for positive charging and the light source was changed to laser diode with a writing wavelength of 780 nm. A pre-production toner with a volume average particle diameter of 6 μm was used as a toner.

10,000 sheets of the full-color mixed image with 5% image density of each black, yellow, magenta and cyan were printed out for durability test by using the image forming apparatus.

The charging roller which was arranged so as to be in contact with the electrophotographic photoconductor was used as a charging unit of the image forming apparatus.

<Evaluation>

Moreover, applied voltage was set so that the initial electric potential of the photoconductor becomes +500V at the start of the test and the charging condition remained the same until the end of the test. Moreover, developing bias was set at +350V. The test was conducted in an environment of 23° C. and 60% RH.

The surface potential of the photoconductor in exposing unit during writing (exposing) of whole area and image quality of output image were evaluated respectively at the start of the test (at beginning) and after completing output of 10,000 images. The results are shown in Table 7-1.

Image qualities such as change in color tone, background smear, image density and presence or absence of cracks of output image were evaluated. Presence or absence of defects and the rank of image quality were observed with eyes and determined by the following evaluation criteria.

[Evaluation Criteria]

5: Image defects are not observed at all and the image is appropriate.

4: Slight change in color tone, image density and background smear are observed as compared with the original image, however, there is no problem for practical use and the image is appropriate.

3: Slight change in color tone, image density and background smear are observed, however, there is no problem for use in general temperature and humidity environment.

2: Change in color tone, image density and background smear are observed to a certain degree.

1: Change in color tone, image density and background smear are notable, posing problems.

Example 7-2

Preparation of Electrophotographic Photoconductor

First, 30 parts of metal-free phthalocyanine pigment (Fastogen Blue 8120B by Dainippon Ink and Chemicals, Inc) as a charge generating material was dispersed with 970 parts of cyclohexanone for 2 hours by means of a ball mill apparatus to prepare a dispersion liquid of charge generating material. In addition, 49 parts of polycarbonate resin (Z-Polyca by Teijin Chemicals Ltd., viscosity-average molecular weight=40,000), 20 parts of the charge generating material expressed by the above Structural Formula (3), 29.5 parts of the compound expressed by the following Structural Formula (14) and 0.1 parts of silicone oil (KF50-100CS by Shin-etsu Chemical Co., Ltd.) were dissolved in 340 parts of tetrahydrofran and then 66.6 parts of the above dispersion liquid of charge generating material was added and stirred to prepare a coating liquid for photosensitive layer.

Stuctural Formula (14)

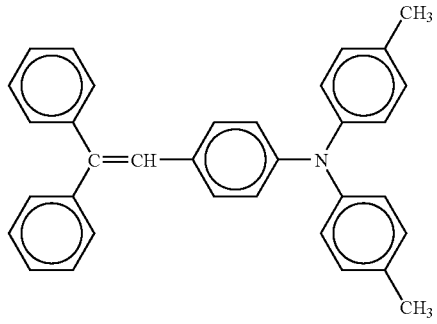

Next, the coating liquid for photosensitive layer was applied on an aluminum drum of 30 mm diameter and 340 mm length by dipping and dried at 120° C. for 15 minutes to form a photosensitive layer. The elevating speed was set so as to form a photosensitive layer of 22.5 μm thickness.

—Image Forming and Evaluation—

Next, the electrophotographic photoconductor obtained as above was mounted and evaluated as similar to Example 7-1. The result is shown in Table 7-1.

Example 7-3

Preparation of Electrophotographic Photoconductor, Image Forming and Evaluation

The electrophotographic photoconductor of Example 7-3 was produced as similar to Example 7-1 except for using a titanyl phthalocyanine prepared according to the following Pigment Synthetic Example 7-1 instead of metal-free phthalocyanine pigment (Fastogen Blue 8120B) used in Example 7-1 and image forming was performed and evaluated. The result is shown in Table 7-1.

Pigment Synthetic Example 7-1

A pigment was produced according to JP-A No. 2001-19871. First, 29.2 g of 1,3-diiminoisoindoline and 200 ml of sulfolane were mixed and 20.4 g of titanium tetrabutoxide was allowed to drip into the mixture under nitrogen airflow. After dripping, a temperature of the mixture was raised gradually to 180° C. and stirred for 5 hours while maintaining the reaction temperature in the range of 170° C. to 180° C. to perform reaction. After reaction was completed, the deposit was filtered after cooling, washed until the fine particles were blue with chloroform, washed several times with methanol, dried after further washing with hot water of 80° C. for several times to obtain an unprocessed titanyl phthalocyanine. The unprocessed titanyl phthalocyanine was dissolved in 20 times its volume of a concentrated sulfuric acid, allowed to drip into 100 times its volume of ice water while stirring and the deposited crystals were filtered followed by repetitive washing with water until the wash fluid became neutral (pH value of ion exchange water after washing was 6.8) to obtain a wet cake (water paste) of titanyl phthalocyanine pigment. 40 g of the obtained wet cake (water paste) was put in 200 g of tetrahydrofran, the mixture was filtered after stirring for 4 hours and dried to obtain titanyl phthalocyanine powder. This was defined as a pigment 1.

The density of solid content of the above wet cake was 15%. The mass ratio of the crystal conversion solvent to the wet cake was 33:1. Meanwhile, halogen compound was not used for raw material of Synthetic Example 1.

The X-ray diffraction spectrum of the obtained titanyl phthalocyanine powder was measured by the following condition and it turns out that the titanyl phthalocyanine powder had a maximum diffraction peak at Bragg angle 2θ relative to a Cu—Kα characteristic X-ray (1.542 Å wavelength) of 27.2±0.2°, additionally had a peak at the lowest angle 7.3°±0.2° and had no peaks between the peak at 7.3° and the peak at 9.4°, and at 26.3°. The result is shown in FIG. 10.

—Measurement Condition of X-Ray Diffraction Spectrum—

| | |
|---|---|
| X-ray tube: | Cu |
| Voltage: | 50 kV |
| Electric Current: | 30 mA |
| Scan Speed: | 2°/min. |
| Scan Range: | 3° to 40° |
| Time Constant: | 2 seconds |

Meanwhile, average particle size in the coating liquid for charge generating layer using the titanyl phthalocyanine was 0.31 μm as measured by means of CAPA-700 by Horiba, Ltd.

Example 7-4

Preparation of Electrophotographic Photoconductor, Image Forming and Evaluation

The electrophotographic photoconductor of Example 7-4 was produced as similar to Example 7-2 except for using a titanyl phthalocyanine prepared according to the Pigment Synthetic Example 7-1 of Example 7-3 instead of metal-free phthalocyanine pigment (Fastogen Blue 8120B) used in Example 7-2 and image forming was performed and evaluated. The result is shown in Table 7-1.

Meanwhile, the volume average particle diameter of the primary particle in the coating liquid for charge generating layer using the titanyl phthalocyanine was 0.62 μm as measured by means of CAPA-700 by Horiba, Ltd.

Example 7-5

Preparation of Electrophotographic Photoconductor, Image Forming and Evaluation

The electrophotographic photoconductor of Example 7-5 was produced as similar to Example 7-1 except for using a titanyl phthalocyanine prepared according to the following Pigment Synthetic Example 7-2 instead of metal-free phthalocyanine pigment (Fastogen Blue 8120B) used in Example 7-1 and image forming was performed and evaluated. The result is shown in Table 7-1.

Pigment Synthetic Example 7-2

A water paste of titanyl phthalocyanine pigment was synthesized according to the above Pigment Synthetic Example 7-1 and crystal conversion was performed as follows to obtain a phthalocyanine crystal having primary particles smaller than that of Pigment Synthetic Example 7-1.

First, 400 parts of tetrahydrofran was added to 60 parts of the water paste before crystal conversion obtained in Synthetic Example 7-1 and stirred powerfully at 2,000 rpm at a room temperature by means of a homomixer (MARKIIf model by Kenis Ltd.). Stirring was stopped when the color of navy blue paste was turned to light blue (20 minutes after the start of stirring) and the mixture was filtered under reduced pressure. The crystal obtained in the filtering device was washed with tetrahydrofran to obtain a pigment wet cake. This was dried at 70° C. for 2 days under reduced pressure of 5 mmHg to obtain 8.5 parts of titanyl phthalocyanine crystal. The pigment obtained as above was defined as a pigment 2. Halogen compounds were not used for raw material of the Pigment Synthetic Example 7-2.

The density of solid content of the above wet cake was 15%. The mass ratio of the crystal conversion solvent to the wet cake was 44:1.

Meanwhile, the volume average particle diameter of the primary particle in the coating liquid for charge generating layer using the titanyl phthalocyanine was 0.45 μm as measured by means of CAPA-700 by Horiba, Ltd.

Example 7-6

Preparation of Electrophotographic Photoconductor, Image Forming and Evaluation

The electrophotographic photoconductor of Example 7-6 was produced as similar to Example 7-2 except for using a titanyl phthalocyanine prepared according to the Pigment Synthetic Example 7-2 of Example 7-5 instead of metal-free phthalocyanine pigment (Fastogen Blue 8120B) used in Example 7-2 and image forming was performed and evaluated. The result is shown in Table 7-1.

Meanwhile, the volume average particle diameter of the primary particle in the coating liquid for charge generating layer using the titanyl phthalocyanine was 0.54 μm as measured by means of CAPA-700 by Horiba, Ltd.

Example 7-7

Preparation of Electrophotographic Photoconductor, Image Forming and Evaluation

The electrophotographic photoconductor of Example 7-7 was produced as similar to Example 7-1 except for using a titanyl phthalocyanine prepared according to the following Pigment Synthetic Example 7-3 instead of metal-free phthalocyanine pigment (Fastogen Blue 8120B) used in Example 7-1 and image forming was performed and evaluated. The result is shown in Table 7-1.

Pigment Synthetic Example 7-3

A pigment was produced according to the method stated in Example 1 disclosed in JP-A No. 1-299874 (JP-B No. 2512081). The wet cake prepared according to Pigment Synthetic Example 7-1 of Example 7-3 was dried, 1 g of dried product was added to 50 g of polyethylene glycol and sand milled by using 100 g of glass beads. After crystal transition, the obtained product was washed with diluted sulfuric acid and ammonium hydroxide solution sequentially and dried to obtain a pigment. This was defined as a pigment 3. Meanwhile, halogen compounds were not used for raw material of Pigment Synthetic Example 7-3.

Meanwhile, the volume average particle diameter of the primary particle in the coating liquid for charge generating layer using the titanyl phthalocyanine was 0.43 μm as measured by means of CAPA-700 by Horiba, Ltd.

Example 7-8

Preparation of Electrophotographic Photoconductor, Image Forming and Evaluation

The electrophotographic photoconductor of Example 7-8 was produced as similar to Example 7-2 except for using a titanyl phthalocyanine prepared according to the Pigment Synthetic Example 7-3 of Example 7-7 instead of metal-free phthalocyanine pigment (Fastogen Blue 8120B) used in Example 7-2 and image forming was performed and evaluated. The result is shown in Table 7-1.

Example 7-9

Preparation of Electrophotographic Photoconductor, Image Forming and Evaluation

The electrophotographic photoconductor of Example 7-9 was produced as similar to Example 7-5 except for using the charge transporting material expressed by the following Structural Formula (5) instead of the charge transporting material expressed by Structural Formula (3) in Example 7-5 and image forming was performed and evaluated. The result is shown in Table 7-1.

Structural Formula (5)

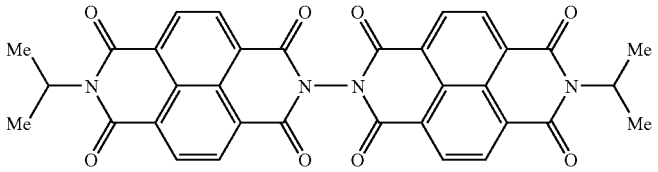

In the above Structural Formula (5), "Me" represents a methyl group.

Example 7-10

Preparation of Electrophotographic Photoconductor, Image Forming and Evaluation

The electrophotographic photoconductor of Example 7-10 was produced as similar to Example 7-5 except for using the charge transporting material expressed by the following Structural Formula (4) instead of the charge transporting material expressed by Structural Formula (3) in Example 7-5 and image forming was performed and evaluated. The result is shown in Table 7-1.

Structural Formula (4)

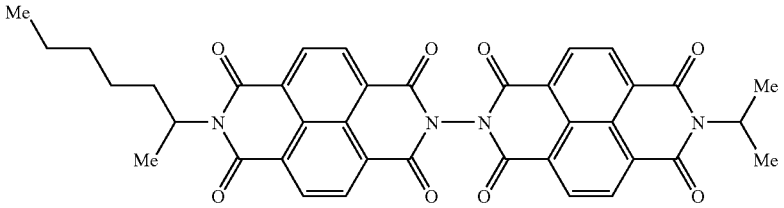

In the above Structural Formula (4), "Me" represents a methyl group.

Example 7-11

Preparation of Electrophotographic Photoconductor, Image Forming and Evaluation

The electrophotographic photoconductor of Example 7-11 was produced as similar to Example 7-6 except for using the charge transporting material expressed by the following Structural Formula (5) instead of the charge transporting material expressed by Structural Formula (3) in Example 7-6 and image forming was performed and evaluated. The result is shown in Table 7-1.

Structural Formula (5)

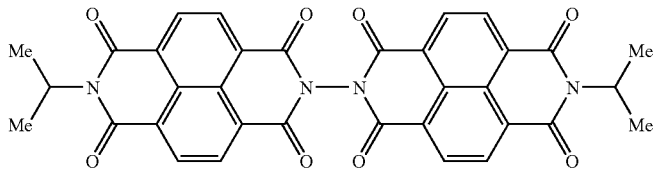

In the above Structural Formula (5), "Me" represents a methyl group.

Example 7-12

Preparation of Electrophotographic Photoconductor, Image Forming and Evaluation

The electrophotographic photoconductor of Example 7-12 was produced as similar to Example 7-6 except for using the charge transporting material expressed by the following Structural Formula (4) instead of the charge transporting material expressed by Structural Formula (3) in Example 7-6 and image forming was performed and evaluated. The result is shown in Table 7-1.

Structural Formula (4)

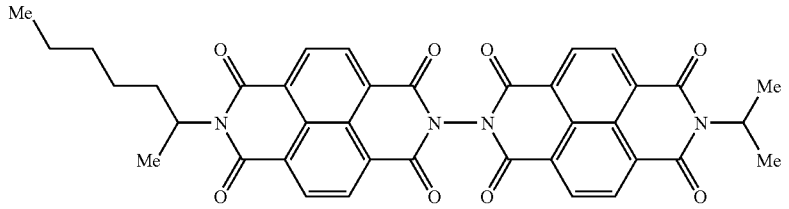

In the above Structural Formula (4), "Me" represents a methyl group.

Example 7-13

Preparation of Electrophotographic Photoconductor, Image Forming and Evaluation

The electrophotographic photoconductor of Example 7-13 was produced as similar to Example 7-6 except for using the charge transporting material expressed by the following Structural Formula (8) instead of the charge transporting material expressed by Structural Formula (3) in Example 7-6 and image forming was performed and evaluated. The result is shown in Table 7-1.

Structural Formula (8)

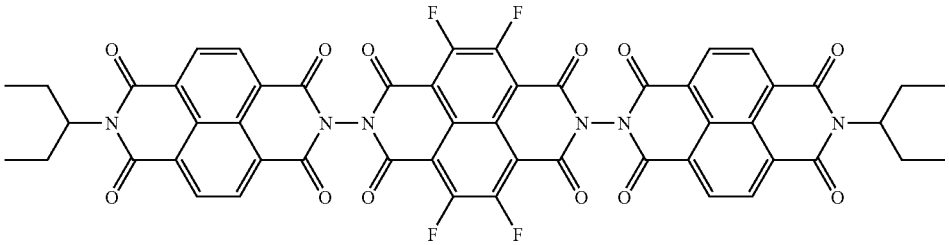

In the above Structural Formula (8), end groups represent "Me" (methyl group).

Example 7-14

Preparation of Electrophotographic Photoconductor, Image Forming and Evaluation

The electrophotographic photoconductor of Example 7-14 was produced as similar to Example 7-6 except for using the charge transporting material expressed by the following Structural Formula (9) instead of the charge transporting material expressed by Structural Formula (3) in Example 7-6 and image forming was performed and evaluated. The result is shown in Table 7-1.

Structural Formula (9)

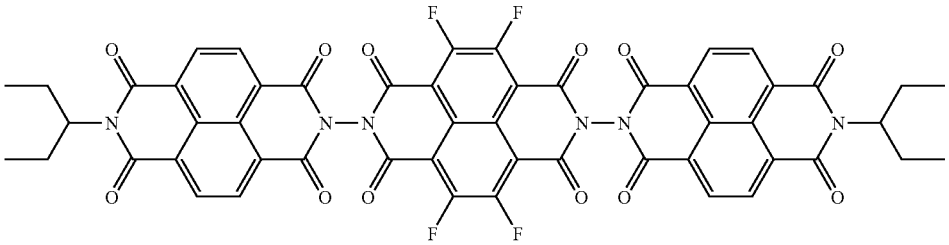

In the above Structural Formula (9), end groups represent "Me" (methyl group).

Example 7-15

Preparation of Electrophotographic Photoconductor, Image Forming and Evaluation

The electrophotographic photoconductor of Example 7-15 was produced as similar to Example 7-6 except for using the charge transporting material expressed by the following Structural Formula (10) instead of the charge transporting material expressed by Structural Formula (3) in Example 7-6 and image forming was performed and evaluated. The result is shown in Table 7-1.

Structural Formula (10)

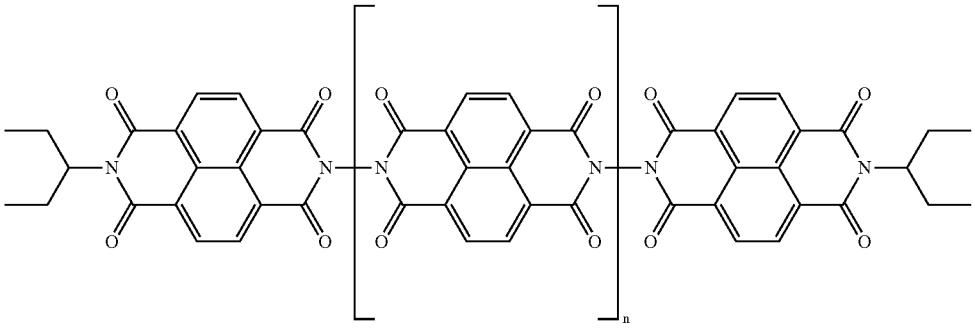

In the above Structural Formula (10), end groups represent Me (methyl group) and "n" is an integer of 1 to 100 and a mixed product of this range.

Example 7-16

Preparation of Electrophotographic Photoconductor, Image Forming and Evaluation

The electrophotographic photoconductor of Example 7-16 was produced as similar to Example 7-6 except for changing the content of the charge transporting material expressed by Structural Formula (3) in Example 7-6 from 20 parts to 15 parts and adding 5 parts of the charge transporting material expressed by the following Structural Formula (11) and image forming was performed and evaluated. The result is shown in Table 7-1.

Structural Formula (11)

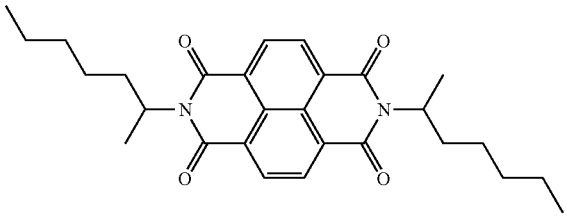

In the above Structural Formula (11), end groups represent Me (methyl group).

Example 7-17

Image Forming and Evaluation

The electrophotographic photoconductor produced in Example 7-5 was packaged and mounted in a remodeled full-color image forming apparatus of tandem type (IPSiO CX400 by Ricoh Company, Ltd.) in which image forming elements of each color of black, yellow, magenta and cyan were disposed, power pack was changed for positive charging and the light source was changed to laser diode with a writing wavelength of 780 nm. A pre-production toner with a volume average particle diameter of 6 μm was used as a toner.

10,000 sheets of the full-color mixed image with 5% image density of each black, yellow, magenta and cyan were printed out for durability test by using the image forming apparatus.

The charging roller which was arranged so as to be in contact with the electrophotographic photoconductor was used as a charging unit of the image forming apparatus.

<Evaluation>

Moreover, applied voltage was set so that the initial surface potential of the photoconductor becomes +500V at the start of the test and the charging condition remained the same until the end of the test. Moreover, developing bias was set at +350V. The test was conducted in an environment of 23° C. and 60% RH. The surface potential of the photoconductor in exposing unit during writing (exposing) of whole area and image quality of output image were evaluated respectively at the start of the test (at beginning) and after completing output of 10,000 images. The result is shown in Table 7-1.

Image qualities such as change in color tone, background smear, image density and presence or absence of cracks of output image were evaluated. Presence or absence of defects and the rank of image quality were observed with eyes and determined by the following evaluation criteria.

[Evaluation Criteria]

5: Image defects are not observed at all and the image is appropriate.

4: Slight change in color tone, image density and background smear are observed as compared with the original image, however, there is no problem for practical use and the image is appropriate.

3: Slight change in color tone, image density and background smear are observed, however, there is no problem for use in general temperature and humidity environment.

2: Change in color tone, image density and background smear are observed to a certain degree.

1: Change in color tone, image density and background smear are notable, posing problems.

Example 7-18

Image Forming and Evaluation

After packaging the electrophotographic photoconductor prepared in Example 7-6, image forming and evaluation were conducted as similar to Example 7-17. The result is shown in Table 7-1.

Example 7-19

The electrophotographic photoconductor used for evaluation of Example 7-6 and printing test of 10,000 sheets was taken out and left in environments of 5 ppm ozone density and 5 ppm nitrogen oxide gas (a mixed gas of NO and $NO_2$ in equal amount) density for 5 days respectively for gas exposure test. After the test, the electrophotographic photoconductor was mounted again in the image forming apparatus as similar to the one used for Example 7-1 and images were printed out for evaluation on electric potentials of unexposed area and exposed area and image quality. The result is shown in Table 7-2.

Example 7-20

The electrophotographic photoconductor used for evaluation of Example 7-16 and printing test of 10,000 sheets was taken out and left in environments of 5 ppm ozone density and 5 ppm nitrogen oxide gas (a mixed gas of NO and $NO_2$ in equal amount) density for 5 days respectively for gas exposure test. After the test, the electrophotographic photoconductor was mounted again in the image forming apparatus as similar to the one used for Example 7-1 and images were printed out for evaluation on electric potentials of unexposed area and exposed area and image quality. The result is shown in Table 7-2.

Comparative Example 7-1

Preparation of Electrophotographic Photoconductor, Image Forming and Evaluation

The electrophotographic photoconductor of Comparative Example 7-1 was produced as similar to Example 7-1 except for using the charge transporting material expressed by the following Structural Formula (13) instead of the charge transporting material expressed by Structural Formula (3) in Example 7-1 and image forming was performed and evaluated. The result is shown in Table 7-1.

Structural Formula (13)

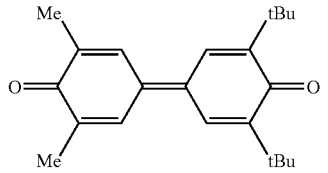

In the above Structural Formula (13), "Me" represents a methyl group and "t-Bu" represents a t-butyl group.

Comparative Example 7-2

Preparation of Electrophotographic Photoconductor, Image Forming and Evaluation

The electrophotographic photoconductor of Comparative Example 7-2 was produced as similar to Example 7-1 except for using the charge transporting material expressed by the following Structural Formula (15) instead of the charge transporting material expressed by Structural Formula (3) in Example 7-1 and image forming was performed and evaluated. The result is shown in Table 7-1.

Structural Formula (15)

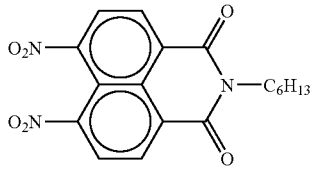

Comparative Example 7-3

Preparation of Electrophotographic Photoconductor, Image Forming and Evaluation

The electrophotographic photoconductor of Comparative Example 7-3 was produced as similar to Example 7-2 except for using the charge transporting material expressed by the following Structural Formula (13) instead of the charge transporting material expressed by Structural Formula (3) in Example 7-2 and image forming was performed and evaluated. The result is shown in Table 7-1.

Structural Formula (13)

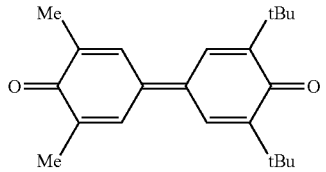

In the above Structural Formula (13), "Me" represents a methyl group and "t-Bu" represents a t-butyl group.

Comparative Example 7-4

Preparation of Electrophotographic Photoconductor, Image Forming and Evaluation

The electrophotographic photoconductor of Comparative Example 7-4 was produced as similar to Example 7-2 except for using the charge transporting material expressed by the following Structural Formula (15) instead of the charge transporting material expressed by Structural Formula (3) in Example 7-2 and image forming was performed and evaluated. The result is shown in Table 7-1.

Structural Formula (15)

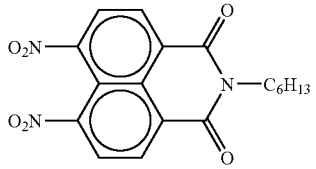

Comparative Example 7-5

Preparation of Electrophotographic Photoconductor, Image Forming and Evaluation

The electrophotographic photoconductor of Comparative Example 7-5 was produced as similar to Example 7-5 except for using the charge transporting material expressed by the following Structural Formula (13) instead of the charge transporting material expressed by Structural Formula (3) in Example 7-5 and image forming was performed and evaluated. The result is shown in Table 7-1.

Structural Formula (13)

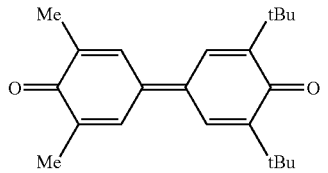

In the above Structural Formula (13), "Me" represents a methyl group and "t-Bu" represents a t-butyl group.

Comparative Example 7-6

Preparation of Electrophotographic Photoconductor, Image Forming and Evaluation

The electrophotographic photoconductor of Comparative Example 7-6 was produced as similar to Example 7-5 except for using the charge transporting material expressed by the following Structural Formula (15) instead of the charge transporting material expressed by Structural Formula (3) in Example 7-5 and image forming was performed and evaluated. The result is shown in Table 7-1.

Structural Formula (15)

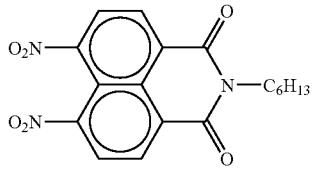

Comparative Example 7-7

Preparation of Electrophotographic Photoconductor, Image Forming and Evaluation

The electrophotographic photoconductor of Comparative Example 7-7 was produced as similar to Example 7-6 except for using the charge transporting material expressed by the following Structural Formula (13) instead of the charge transporting material expressed by Structural Formula (3) in Example 7-6 and image forming was performed and evaluated. The result is shown in Table 7-1.

Structural Formula (13)

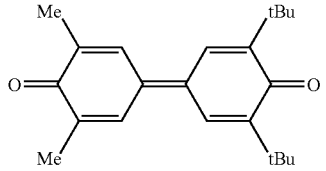

In the above Structural Formula (13), "Me" represents a methyl group and "t-Bu" represents a t-butyl group.

Comparative Example 7-8

Preparation of Electrophotographic Photoconductor, Image Forming and Evaluation

The electrophotographic photoconductor of Comparative Example 7-8 was produced as similar to Example 7-6 except for using the charge transporting material expressed by the following Structural Formula (15) instead of the charge transporting material expressed by Structural Formula (3) in Example 7-6 and image forming was performed and evaluated. The result is shown in Table 7-1.

TABLE 7-1

Structural Formula (15)

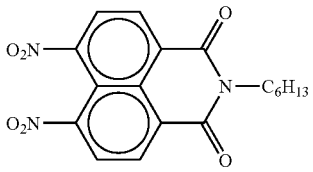

| | | X-ray Diffraction Peak of Titanyl Phthalocyanine | | | | | | Electric Potential of Exposing Unit (+V) | | Image Quality Rank | |
|---|---|---|---|---|---|---|---|---|---|---|---|
| | Composition of Photosensitive Layer | Position of Highest Peak | Position of Peak at Lowest Angle | Peak at 9.4° | Peak at 9.6° | Peak at 7.3° to 9.4° | Peak at 24.0° | At Beginning | After Priniting Test of 10,000 Sheets | At Beginning | After Printing Test of 10,000 Sheets |
| Example 7-1 | multilayer | N/A | N/A | N/A | N/A | N/A | N/A | 80 | 90 | 5 | 5 |
| Example 7-2 | single layer | N/A | N/A | N/A | N/A | N/A | N/A | 80 | 100 | 5 | 5 |
| Example 7-3 | multilayer | 27.2° | 7.3° | present | present | absent | present | 60 | 80 | 5 | 5 |
| Example 7-4 | single layer | 27.2° | 7.3° | present | present | absent | present | 60 | 70 | 5 | 5 |

TABLE 7-1-continued

Structural Formula (15)

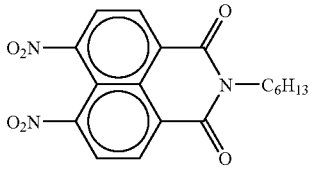

| | Composition of Photosensitive Layer | X-ray Diffraction Peak of Titanyl Phthalocyanine: Position of Highest Peak | Position of Peak at Lowest Angle | Peak at 9.4° | Peak at 9.6° | Peak at 7.3° to 9.4° | Peak at 24.0° | Electric Potential of Exposing Unit (+V): At Beginning | After Priniting Test of 10,000 Sheets | Image Quality Rank: At Beginning | After Printing Test of 10,000 Sheets |
|---|---|---|---|---|---|---|---|---|---|---|---|
| Example 7-5 | multilayer | 27.2° | 7.3° | present | present | absent | present | 40 | 50 | 5 | 5 |
| Example 7-6 | single layer | 27.2° | 7.3° | present | present | absent | present | 40 | 50 | 5 | 5 |
| Example 7-7 | multilayer | 27.2° | 7.3° | absent | absent | absent | present | 90 | 110 | 5 | 4 |
| Example 7-8 | single layer | 27.2° | 7.3° | absent | absent | absent | present | 90 | 110 | 5 | 4 |
| Example 7-9 | multilayer | 27.2° | 7.3° | present | present | absent | present | 40 | 100 | 5 | 5 |
| Example 7-10 | multilayer | 27.2° | 7.3° | present | present | absent | present | 50 | 90 | 5 | 5 |
| Example 7-11 | single layer | 27.2° | 7.3° | present | present | absent | present | 40 | 100 | 5 | 5 |
| Example 7-12 | single layer | 27.2° | 7.3° | present | present | absent | present | 40 | 100 | 5 | 5 |
| Example 7-13 | single layer | 27.2° | 7.3° | present | present | absent | present | 35 | 45 | 5 | 5 |
| Example 7-14 | single layer | 27.2° | 7.3° | present | present | absent | present | 40 | 50 | 5 | 5 |
| Example 7-15 | single layer | 27.2° | 7.3° | present | present | absent | present | 40 | 50 | 5 | 5 |
| Example 7-16 | single layer | 27.2° | 7.3° | present | present | absent | present | 45 | 55 | 5 | 5 |
| Example 7-17 | multilayer | 27.2° | 7.3° | present | present | absent | present | 40 | 60 | 5 | 5 |
| Example 7-18 | single layer | 27.2° | 7.3° | present | present | absent | present | 40 | 60 | 5 | 5 |
| Comp. Ex. 7-1 | multilayer | N/A | N/A | N/A | N/A | N/A | N/A | 110 | 150 | 4 | 1 |
| Comp. Ex. 7-2 | multilayer | N/A | N/A | N/A | N/A | N/A | N/A | 100 | 150 | 4 | 2 |
| Comp. Ex. 7-3 | singlelayer | N/A | N/A | N/A | N/A | N/A | N/A | 110 | 150 | 4 | 1 |
| Comp. Ex. 7-4 | single layer | N/A | N/A | N/A | N/A | N/A | N/A | 110 | 150 | 4 | 2 |
| Comp. Ex. 7-5 | multilayer | 27.2° | 7.3° | present | present | absent | present | 60 | 110 | 5 | 1 |
| Comp. Ex. 7-6 | multilayer | 27.2° | 7.3° | present | present | absent | present | 70 | 120 | 5 | 1 |
| Comp. Ex. 7-7 | single layer | 27.2° | 7.3° | present | present | absent | present | 60 | 130 | 5 | 2 |
| Comp. Ex. 7-8 | single layer | 27.2° | 7.3° | present | present | absent | present | 70 | 140 | 5 | 1 |

From the results shown in Table 7-1, it turns out that it is possible to obtain images of distinctly high quality without having degraded images such as change in color tone, background smear and density degradation in Examples 7-1 to 7-18 in contrast with Comparative Examples 7-1 to 7-8.

TABLE 7-2

| | Composition of Photosensitive Layer | X-ray Diffraction Peak of Titanyl Phthalocyanine: Position of Highest Peak | Position of Peak at Lowest Angle | Peak at 9.4° | Peak at 9.6° | Peak at 7.3°to 9.4° | Peak at 24.0° | Electric Potential of Exposing Unit (+V): Before Gas Exposure Test | After Gas Exposure Test | Image Quality Rank: Before Gas Exposure Test | After Gas Exposure Test |
|---|---|---|---|---|---|---|---|---|---|---|---|
| Example 7-19 | single layer | 27.2° | 7.3° | present | present | absent | present | 50 | 65 | 5 | 4 |
| Example 7-20 | single layer | 27.2° | 7.3° | present | present | absent | present | 55 | 55 | 5 | 5 |

What is claimed is:

1. An electrophotographic photoconductor, comprising:

a support; and at least a photosensitive layer disposed on the support, wherein the photosensitive layer comprises at least a charge generating material and a charge transporting material expressed by the following Structural Formula (1-1), and Structural Formula (1–1)

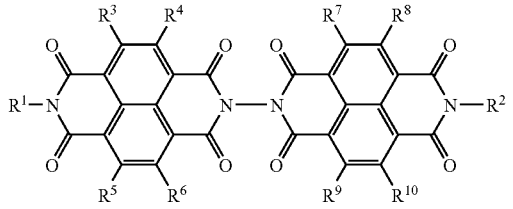

wherein, in the Structural Formula (1-1), $R^1$ and $R^2$ may be identical to each other or different, and represent any one of hydrogen atom, alkyl group which may be substituted, cycloalkyl group which may be substituted and aralkyl group which may be substituted; $R^3$, $R^4$, $R^5$, $R^6$, $R^7$, $R^8$, $R^9$, and $R^{10}$ may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted;

wherein the electrophotographic photoconductor comprises a bipolar optical sensitivity of positive and negative, and a ratio of optical sensitivity at each polarity, E½ (positive) and E½ (negative), [E½ (negative)/E½ (positive)], where "E½" is an exposure energy (μJ/cm$^2$) required for a surface potential to be 1/2 by exposing with a single light after the electrophotographic photoconductor is charged at ±800V, is 0.5 to 3.0.

2. The electrophotographic photoconductor according to claim 1, wherein the photosensitive layer comprises a compound further expressed by the following Structural Formula (2), and Structural Formula (2)

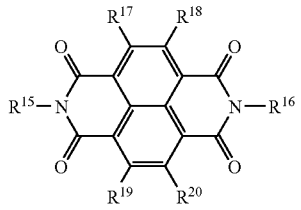

wherein, in the Structural Formula (2), "$R^{15}$" and "$R^{16}$" may be identical to each other or different, and represent any one of hydrogen atom, alkyl group which may be substituted, cycloalkyl group which may be substituted and aralkyl group which may be substituted; "$R^{17}$", "$R^{18}$", "$R^{19}$" and "$R^{20}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted.

3. The electrophotographic photoconductor according to claim 1, wherein the charge generating material is a phthalocyanine.

4. The electrophotographic photoconductor according to claim 3, wherein the phthalocyanine is a titanyl phthalocyanine.

5. The electrophotographic photoconductor according to claim 4, wherein the titanyl phthalocyanine comprises a maximum diffraction peak at least at 27.2° as a diffraction peak)(±0.2° at Bragg angle 2θ relative to a Cu—Kα ray (1.542 Å wavelength), additionally comprises main peaks at 9.4°, 9.6° and 24.0°, a peak at 7.3° as a diffraction peak at the lowest angle and no peaks between the peak at 7.3° and the peak at 9.4°.

6. An image forming apparatus, comprising:

at least an electrophotographic photoconductor;

a charging unit configured to charge the photoconductor;

an exposing unit configured to expose the charged photoconductor to form a latent electrostatic image;

a developing unit configured to develop the latent electrostatic image by using a toner;

a transfer unit configured to transfer the visible image developed by the toner to a recording medium, wherein the electrophotographic photoconductor comprises:

a support; and at least a photosensitive layer disposed on the support, wherein the photosensitive layer comprises at least a charge generating material and a charge transporting material expressed by the following Structural Formula (1-1), and Structural Formula (1-1)

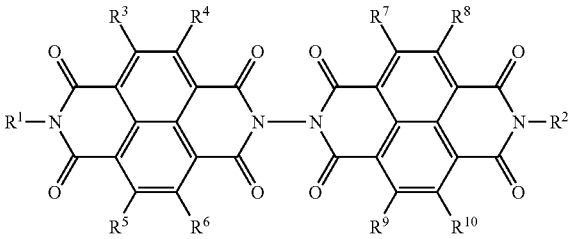

wherein, in the Structural Formula (1-1), $R^1$ and $R^2$ may be identical to each other or different, and represent any one of hydrogen atom, alkyl group which may be substituted, cycloalkyl group which may be substituted and aralkyl group which may be substituted; $R^3$, $R^4$, $R^5$, $R^6$, $R^7$, $R^8$, $R^9$, and $R^{10}$ may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted;

wherein the electrophotographic photoconductor comprises a bipolar optical sensitivity of positive and negative, and a ratio of optical sensitivity at each polarity, E½ (positive) and E½ (negative), [E½ (negative)/E½ (positive)], where "E½" is an exposure energy (μJ/cm$^2$) required for a surface potential to be ½ by exposing with a single light after the electrophotographic photoconductor is charged at ±800V, is 0.5 to 3.0.

7. The image forming apparatus according to claim 6, wherein the transfer unit is of any one of roller-shaped and belt-shaped.

8. The image forming apparatus according to claim 6, wherein the image forming apparatus comprises a number of electrophotographic photoconductors, and unicolor visible images developed on each electrophotographic photoconductor are overlapped with each other sequentially to form a color image.

9. The image forming apparatus according to claim 6, wherein the image forming apparatus comprises an intermediate transfer unit configured to secondarily transfer a visible image on an intermediate transfer member to a recording medium after the visible image developed on the electrophotographic photoconductor is primarily transferred to the intermediate transfer member, and the multicolor visible images are overlapped with each other sequentially on the intermediate transfer member to form a color image and the color image is secondarily transferred at once to the recording medium.

10. A process cartridge, comprising:

at least an electrophotographic photoconductor; and a developing unit configured to develop a latent electrostatic image formed on the electrophotographic photoconductor by using a toner to form a visible image, wherein the process cartridge can be attached to and removed from an image forming apparatus body, the process cartridge comprises a bipolar optical sensitivity of positive and negative, and a ratio of optical sensitivity at each polarity, E½ (positive) and E½ (negative), [E½ (negative)/E½ (positive)], where "E½" is an exposure energy (μJ/cm$^2$) required for a surface potential to be ½ by exposing with a single light after the electrophotographic photoconductor is charged at ±800V, is 0.5 to 3.0, and wherein the electrophotographic photoconductor comprises:

a support; and at least a photosensitive layer disposed on the support, wherein the photosensitive layer comprises at least a charge generating material and a charge transporting material expressed by the following Structural Formula (1-1), and Structural Formula (1-1)

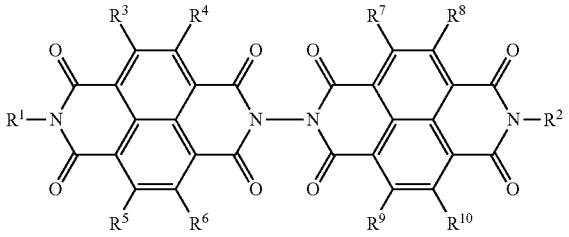

wherein, in the Structural Formula (1-1), $R^1$ and $R^2$ may be identical to each other or different, and represent any one of hydrogen atom, alkyl group which may be substituted, cycloalkyl group which may be substituted and aralkyl group which may be substituted; $R^3$, $R^4$, $R^5$, $R^6$, $R^7$, $R^8$, $R^9$, and $R^{10}$ may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted.

11. An image forming apparatus, comprising:

at least an electrophotographic photoconductor;

a charging unit configured to charge the photoconductor;

an exposing unit configured to expose the charged photoconductor to form a latent electrostatic image;

a developing unit configured to develop the latent electrostatic image by using a toner;

a transfer unit configured to transfer the visible image developed by the toner to a recording medium; and a cleaning unit configured to remove the residual toner on the photoconductor, wherein the electrophotographic photoconductor comprises:

a support; and at least a photosensitive layer disposed on the support, wherein the photosensitive layer comprises a charge generating material and a charge transporting material expressed by the following Structural Formula (1-1), and Structural Formula (1–1)

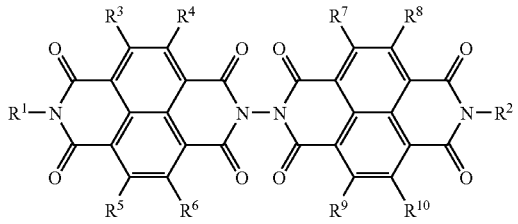

wherein, in the Structural Formula (1-1), $R^1$ and $R^2$ may be identical to each other or different, and represent any one of hydrogen atom, alkyl group which may be substituted, cycloalkyl group which may be substituted and aralkyl group which may be substituted; $R^3$, $R^4$, $R^5$, $R^6$, $R^7$, $R^8$, $R^9$, and $R^{10}$ may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted.

12. The image forming apparatus according to claim 11, wherein the photosensitive layer comprises a compound further expressed by the following Structural Formula (2), and Structural Formula (2)

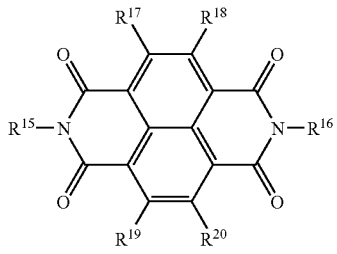

wherein, in the Structural Formula (2), "$R^{15}$" and "$R^{16}$" may be identical to each other or different, and represent any one of hydrogen atom, alkyl group which may be substituted, cycloalkyl group which may be substituted and aralkyl group which may be substituted; "$R^{17}$", "$R^{18}$", "$R^{19}$" and "$R^{20}$" may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted.

13. The image forming apparatus according to claim 11, wherein the image forming apparatus is in contact with the electrophotographic photoconductor, and further comprises a contact member configured to feed a solid lubricant agent to the photoconductor.

14. The image forming apparatus according to claim 11, wherein the cleaning unit comprises a brush with a loop-shaped leading end which rotates while in contact with the photoconductor, and the loop-shaped leading end side of the brush is turned to upstream side of the rotation direction of the brush from base side.

15. The image forming apparatus according to claim 14, wherein a rotation direction of the brush is in the same direction of the rotation direction of the photoconductor in contact area.

16. The image forming apparatus according to claim 14, wherein the image forming apparatus comprises an elastic rubber blade which is in contact with the photoconductor on downstream side of the rotation direction of the brush.

17. The image forming apparatus according to claim 16, wherein the direction of contact of the elastic rubber blade with the photoconductor is in the counter direction of the rotation direction of the photoconductor.

18. The image forming apparatus according to claim 16, wherein a contact pressure between the elastic rubber blade and the photoconductor is 10 g/cm to 30 g/cm.

19. The image forming apparatus according to claim 11, wherein the support is drum-shaped, and the image forming apparatus comprises a flange which comprises a pair of roller bearing holes which are fitted in an opening of both ends of the support and the drum-shaped support and a shaft which is fixed to the center of each flange and run through the support as a central rotating axis.

20. The image forming apparatus according to claim 19, wherein a relation in which a diameter L of the shaft is 3 mm≦L≦20 mm in at least part of a longer direction is satisfied.

21. The image forming apparatus according to claim 19, wherein the shaft is made of metal.

22. The image forming apparatus according to claim 19, wherein the shaft is made of stainless steel.

23. The image forming apparatus according to claim 11, wherein a number of image forming elements which comprise at least an electrophotographic photoconductor, a latent electrostatic image forming unit configured to form a latent electrostatic image on the electrophotographic photoconductor, a developing unit configured to develop the latent electrostatic image by using a toner to form a visible image, and a transfer unit configured to transfer the visible image to a recording medium is arranged.

24. The image forming apparatus according to claim 11, wherein the image forming elements comprises the electrophotographic photoconductor and at least one unit selected from the charging unit, developing unit, transfer unit, cleaning unit and charge removing unit, and the image forming elements are process cartridges which can be attached to and removed from the image forming apparatus body.

25. The image forming apparatus according to claim 11, wherein the charge generating material is a phthalocyanine.

26. The image forming apparatus according to claim 25, wherein the phthalocyanine is a titanyl phthalocyanine.

27. The image forming apparatus according to claim 26, wherein the titanyl phthalocyanine comprises a maximum diffraction peak at least at 27.2° as a diffraction peak)(±0.2°) at Bragg angle 2θ relative to a Cu—Kα characteristic X-ray (1.542 Å wavelength), additionally comprises main peaks at 9.4°, 9.6° and 24.0°, a peak at 7.3° as a diffraction peak at the lowest angle and no peaks between the peak at 7.3° and the peak at 9.4°.

28. The image forming apparatus according to claim 26, wherein a volume average particle diameter of primary particle of the titanyl phthalocyanine is 0.60 μm or less.

29. The image forming apparatus according to claim 11, wherein the photosensitive layer comprises a single layer composition.

30. The image forming apparatus according to claim 11, wherein the photosensitive layer comprises a laminated composition of a charge generating layer which comprises the charge generating material and a charge transporting layer which comprises a charge transporting material.

31. The image forming apparatus according to claim 11, wherein the image forming apparatus comprises an intermediate transfer member to which a visible image formed on the electrophotographic photoconductor is primarily transferred and a transfer unit configured to secondarily transfer the visible image on the intermediate transfer member to a recording medium, and the multicolor visible images are overlapped with each other sequentially on the intermediate transfer member to form a color image and the color image is secondarily transferred to the recording medium at once.

32. A process cartridge, comprising:

at least an electrophotographic photoconductor;

a developing unit configured to develop a latent electrostatic image formed on the electrophotographic photoconductor by using a toner to form a visible image; and a cleaning unit, wherein the process cartridge can be attached to and removed from an image forming apparatus body, the electrophotographic photoconductor comprises a support and at least a photosensitive layer on the support, the photosensitive layer comprises a charge generating material and a charge transporting material expressed by the following Structural Formula (1-1), and Structural Formula (1-1)

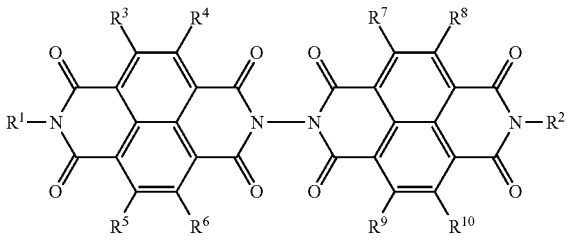

wherein, in the Structural Formula (1-1), $R^1$ and $R^2$ may be identical to each other or different, and represent any one of hydrogen atom, alkyl group which may be substituted, cycloalkyl group which may be substituted and aralkyl group which may be substituted; $R^3$, $R^4$, $R^5$, $R^6$, $R^7$, $R^8$, $R^9$, and $R^{10}$ may be identical to each other or different, and represent any one of hydrogen atom, halogen atom, cyano group, nitro group, amino group, hydroxyl group, alkyl group which may be substituted, cycloalkyl group which may be substituted and aralkyl group which may be substituted.

* * * * *